US012178344B2

(12) United States Patent
Redford

(10) Patent No.: US 12,178,344 B2
(45) Date of Patent: Dec. 31, 2024

(54) COLLAPSIBLE SECURITY CONTAINER FOR PACKAGES

(71) Applicant: The Redford Group, Inc., Prince Albert (CA)

(72) Inventor: Tom Redford, Prince Albert (CA)

(73) Assignee: The Redford Group, Inc., Prince Albert (CA)

( * ) Notice: Subject to any disclaimer, the term of this patent is extended or adjusted under 35 U.S.C. 154(b) by 356 days.

(21) Appl. No.: 17/589,999

(22) Filed: Feb. 1, 2022

(65) Prior Publication Data

US 2022/0257041 A1 Aug. 18, 2022

Related U.S. Application Data

(60) Provisional application No. 63/149,713, filed on Feb. 16, 2021.

(51) Int. Cl.
*A47G 29/20* (2006.01)
*B65D 8/00* (2006.01)
(Continued)

(52) U.S. Cl.
CPC ..... *A47G 29/20* (2013.01); *B65D 15/22* (2013.01); *B65D 15/24* (2013.01); *B65D 25/14* (2013.01);
(Continued)

(58) Field of Classification Search
CPC ..... A47G 29/141; A47G 29/20; A47G 2029/144; B65D 15/22; B65D 15/24;
(Continued)

(56) References Cited

U.S. PATENT DOCUMENTS 3,934,434 A 1/1976 Law
4,703,850 A 11/1987 Walker
(Continued)

FOREIGN PATENT DOCUMENTS

CA 2831255 C * 12/2020 ..... B65D 11/1853
CA 3147318 A1 * 8/2022 ..... A47G 29/20
(Continued)

OTHER PUBLICATIONS

Doorbox, World's No. 1 Package Delivery Box With Anti-Theft Alarm Protection, https://www.doorbox.co/, at least as early as Jan. 14, 2022, 13 pages.
(Continued)

*Primary Examiner* — William L Miller
(74) *Attorney, Agent, or Firm* — SMART & BIGGAR LP

(57) ABSTRACT

A collapsible security container is disclosed. The collapsible security container comprises a collapsible box and a hinged-lid connected to the collapsible box. The collapsible box comprises a bottom panel: a front panel, a left side panel, a right side panel and a back panel connected to the bottom panel by fold lines along respective edges of the bottom panel, wherein the bottom panel, front panel, left side panel, right side panel and back panel define an interior compartment. A locking system secures the hinged-lid to the collapsible box. A strap is attached to the collapsible box. The strap has an attachment end that is attached to the collapsible box and a free end that terminates in a fastener or stopper for securing the security container about or to a structure such as a door or wall.

21 Claims, 40 Drawing Sheets

(51) Int. Cl.

| | |
|---|---|
| ***B65D 25/14*** | (2006.01) |
| ***B65D 25/20*** | (2006.01) |
| ***B65D 55/14*** | (2006.01) |
| *A47G 29/14* | (2006.01) |

(52) U.S. Cl.
CPC ..... *B65D 25/20* (2013.01); *B65D 55/14* (2013.01); *A47G 2029/144* (2013.01)

(58) Field of Classification Search
CPC ..... B65D 25/14; B65D 25/20; B65D 55/14; B65D 11/10; B65D 11/16; B65D 11/18; B65D 11/1833; B65D 11/184; B65D 11/1846; B65D 11/1853; B65D 11/186
See application file for complete search history.

(56) References Cited

U.S. PATENT DOCUMENTS

| | | | | |
|---|---|---|---|---|
| 5,590,608 | A | 1/1997 | Yore et al. | |
| 5,622,276 | A * | 4/1997 | Simmons | B65D 11/1833 220/495.08 |
| 6,330,816 | B1 | 12/2001 | O'Conner | |
| 6,889,891 | B2 | 5/2005 | Correll | |
| 7,624,913 | B2 | 12/2009 | Lutzig | |
| 8,020,697 | B2 | 9/2011 | Chatelain | |
| 8,902,040 | B2 | 12/2014 | Greisen | |
| 8,985,432 | B2 * | 3/2015 | Cullen | B65D 5/36 206/170 |
| 9,990,787 | B2 | 6/2018 | Capaldi-Tallon | |
| 10,321,780 | B1 * | 6/2019 | James | A47G 29/141 |
| 10,743,694 | B2 * | 8/2020 | Raphael | A47G 29/141 |
| 10,786,103 | B2 * | 9/2020 | Teoh | B65D 11/1853 |
| 11,206,939 | B2 | 12/2021 | Sundaresan | |
| 11,311,132 | B2 * | 4/2022 | Eivaz | A47G 29/141 |
| 11,510,517 | B2 * | 11/2022 | McLean | B65D 11/1853 |
| 11,840,385 | B2 * | 12/2023 | Layton | B65D 7/26 |
| 11,896,150 | B2 * | 2/2024 | Chiappetta | E05G 1/005 |
| 2004/0003257 | A1 | 1/2004 | Mitchell | |
| 2009/0090709 | A1 * | 4/2009 | Shalomoff | B65D 15/24 24/570 |
| 2010/0147838 | A1 * | 6/2010 | Whittam | B65D 11/1853 220/4.29 |
| 2011/0168598 | A1 * | 7/2011 | Rees | B65D 11/186 206/505 |
| 2012/0187118 | A1 * | 7/2012 | Glenn | B65D 15/22 220/6 |
| 2015/0228133 | A1 | 8/2015 | Capaldi-Tallon | |
| 2017/0127868 | A1 * | 5/2017 | Adewuyi | A47G 29/22 |
| 2017/0188737 | A1 * | 7/2017 | Hippert | A47G 29/20 |
| 2018/0091503 | A1 | 3/2018 | Tang | |
| 2018/0296016 | A1 * | 10/2018 | Teoh | A47G 29/20 |
| 2019/0350398 | A1 * | 11/2019 | Raphael | A47G 29/141 |
| 2019/0383421 | A1 | 12/2019 | McKim et al. | |
| 2021/0127880 | A1 * | 5/2021 | Raphael | A47G 29/141 |
| 2021/0298505 | A1 * | 9/2021 | Quastad | A47G 29/22 |
| 2022/0233010 | A1 * | 7/2022 | Sundaresan | A47G 29/141 |
| 2022/0267048 | A1 * | 8/2022 | Rogers | B65D 7/26 |

FOREIGN PATENT DOCUMENTS

| | | | | |
|---|---|---|---|---|
| CN | 206190110 | | 5/2017 | |
| EP | 2992788 | A1 * | 3/2016 | A47G 29/141 |
| FR | 2594797 | A1 * | 8/1987 | |
| JP | H07329952 | A * | 12/1995 | |
| WO | 2014206939 | A1 | 12/2014 | |

OTHER PUBLICATIONS

Summary of Video: BBC News, The front door that parcel thieves hate—BBC News, Jan. 11, 2019, https://www.youtube.com/watch?v=BoTUAgPZE8w, 2 pages.

* cited by examiner

COLLAPSIBLE SECURITY CONTAINER FOR PACKAGES

RELATED APPLICATION DATA

The present application claims priority to, and the benefit of, provisional U.S. patent application No. 63/149,713, filed Feb. 16, 2021, the content of which is incorporated herein by reference.

TECHNICAL FIELD

The present disclosure relates to a collapsible security container, and in particular to a collapsible security container for packages.

BACKGROUND

The theft of packages left at homes on door areas, porches or the like by delivery services is a major problem adversely affecting both buyers and sellers, particularly in relation to package shipments associated with ecommerce. This problem is commonly referred to as the "porch pirate" problem. A variety of solutions have been proposed to address the problem of package theft including computer-controlled locker stations to which packages may be delivered, authorized access to homes by delivery services and the like services and in-door or in-wall lock boxes. Current solutions lack convenience, privacy and security desired by users. Accordingly, there remains a need for an improved security container for packages.

BRIEF DESCRIPTION OF THE DRAWINGS

FIGS. 15-21 are a sequence of views of the collapsible security container of FIG. 1 being transformed from a fully open position to a fully closed position. FIG. 15 is a front perspective view of the collapsible security container in a fully open position. FIG. 18 is a front perspective view of the collapsible security container with the side flap panels in a fully retracted position. FIG. 19 is a front perspective view of the collapsible security container with the flap panels in the fully retracted position with the box being collapsed by a force pushing inwardly on the front panel and back panel. FIG. 20 is a front perspective view of the collapsible security container in a fully closed position. FIG. 21 is a front perspective view of the collapsible security container in a fully closed position with the hinged-lid secured to the box using a locking strap.

DESCRIPTION OF EXAMPLE EMBODIMENTS

Figure 1:
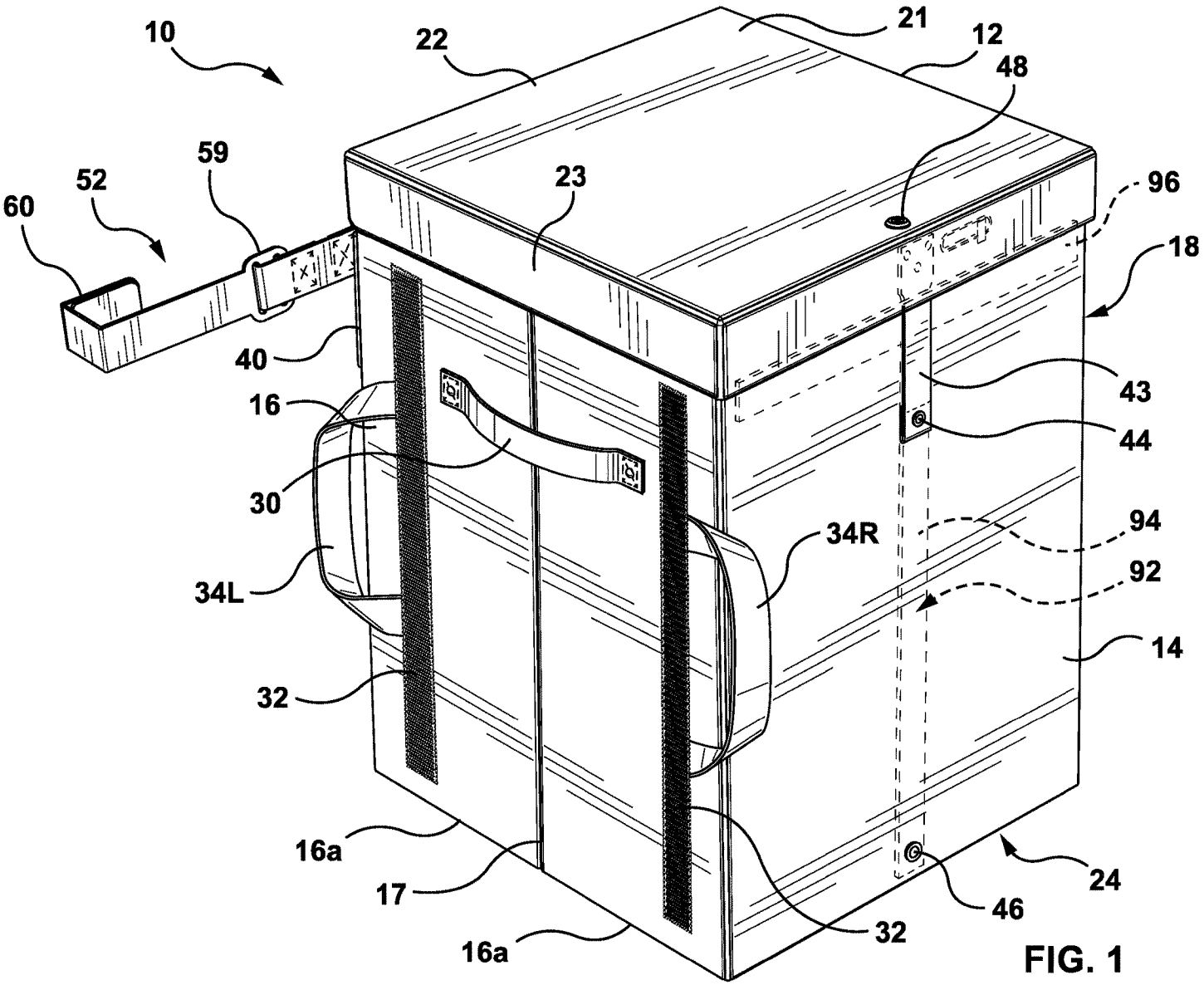
FIG. 1 is a front perspective view of a first embodiment of a collapsible security container in accordance with the present disclosure with a hinged-lid in a closed position.

The present disclosure is made with reference to the accompanying drawings, in which embodiments are shown. However, many different embodiments may be used, and thus the description should not be construed as limited to the embodiments set forth herein. Wherever possible, the same reference numbers are used in the drawings and the following description to refer to the same elements. Lastly, elements referred to in the singular may be plural and vice versa, except where indicated otherwise either explicitly or inherently by context.

In accordance with a first aspect of the present disclosure, there is provided a collapsible security container comprising a collapsible box and a lid connected to the collapsible box by a hinge line. The collapsible box comprises a bottom panel; and a front panel, a left side panel, a right side panel and a back panel connected to the bottom panel by fold lines along respective edges of the bottom panel, wherein the bottom panel, front panel, left side panel, right side panel and back panel define an interior compartment; and a bottom flap panel located within the interior compartment, wherein the bottom flap panel is connected proximate to an intersection between respective edges of the back panel and bottom panel, wherein the bottom flap panel is foldable between a first position in which the bottom flap panel is parallel to the bottom panel and a second position in which the bottom flap panel is parallel to the back panel, and wherein the bottom panel and bottom flap panel form a double panel on the bottom of the collapsible box when the bottom flap panel is the first position; and a hinged-lid connected to the collapsible box.

In at least some examples of the first aspect, the collapsible security container further comprises: a locking system for securing the hinged-lid to the collapsible box.

In at least some examples of the first aspect, the collapsible security container further comprises: a strap attached to the collapsible box, the strap having an attachment end that is attached to the collapsible box and a free end that terminates in a fastener or stopper for securing the security container about or to a structure such as a door or wall.

In at least some examples of the first aspect, front panel, left side panel, right side panel, back panel, and bottom flap panel are rigid panels, and wherein the bottom panel is a flexible panel.

In at least some examples of the first aspect, the bottom flap panel is formed of a rigid plastic sheet.

In at least some examples of the first aspect, the bottom flap panel, front panel, left side panel, right side panel and back panel comprise a rigid insert between an outer fabric layer and inner fabric layer.

In at least some examples of the first aspect, the hinged-lid comprises a top panel and a multi-sided rim. In at least some examples of the first aspect, the top panel and multi-sided rim comprise a rigid insert between an outer fabric layer and inner fabric layer.

In at least some examples of the first aspect, the rigid insert is a corrugated plastic sheet.

In at least some examples of the first aspect, the outer fabric layer is formed of a medium strength, durable and cut resistant material.

In at least some examples of the first aspect, the outer fabric layer is ballistic nylon fabric or similar basketwoven fabric such as Cordura™ basketwoven fabric.

In at least some examples of the first aspect, the outer fabric layer is formed of polyvinyl chloride (PVC)-coated polyester fabric.

In at least some examples of the first aspect, the inner fabric layer is formed of ballistic nylon fabric.

In at least some examples of the first aspect, the inner fabric layer is formed of a low strength material such as nylon 210.

In at least some examples of the first aspect, the bottom panel, front panel, left side panel, right side panel, back panel and top panel are insulated panels. In at least some examples of the first aspect, the inner fabric layer is a reflective foil foam insulation layer.

In at least some examples of the first aspect, the outer fabric layer is formed of a durable water repellent material. In at least some examples of the first aspect, the outer fabric layer of is coated with a durable water repellent coating. In at least some examples of the first aspect, the durable water repellent coating is a perfluorinated carbon polymer coating.

In at least some examples of the first aspect, the outer fabric layer is formed of an antimicrobial and/or antiviral material. In at least some examples of the first aspect, the outer fabric layer is treated to be antimicrobial and/or antiviral. In at least some examples of the first aspect, the outer fabric layer is coated with, or embedded with, a biocide.

In at least some examples of the first aspect, the flexible panel is formed of a high strength, durable and cut resistant material.

In at least some examples of the first aspect, the flexible panel is formed of Kevlar™ or UHMWPE (ultra-high-molecular-weight polyethylene).

In at least some examples of the first aspect, the locking system comprises a hasp lock comprising a hasp mounted to a front panel of the multi-sided rim of the hinged-lid and a swivel handle mounted to the front panel of the collapsible box.

In at least some examples of the first aspect, the locking system comprises: a lock located towards a front of the hinged-lid, wherein a keyway of the lock is exposed by an outer surface of the hinged-lid and a latch of the lock is exposed by an inner surface of the hinged-lid; and a receiver for engaging the latch of the lock attached to the front panel.

In at least some examples of the first aspect, the left side panel and the right side panel each comprise a first portion and a second portion connected about a fold line, wherein the left side panel and the right side panel are each foldable about the respective fold lines.

In at least some examples of the first aspect, the bottom panel, front panel, first portion of the left side panel, second portion of the left side panel, first portion of the right side panel, second portion of the right side panel, and back panel comprise a rigid insert between an outer fabric layer and inner fabric layer.

In at least some examples of the first aspect, the hinged-lid is connected to the collapsible box by a hinge extending across the back panel.

In at least some examples of the first aspect, the strap is formed from a high strength, durable and cut resistant material such as Kevlar™ or UHMWPE (ultra-high-molecular-weight polyethylene).

In at least some examples of the first aspect, the strap is attached to the back panel of the collapsible box in a central part of a top portion thereof via a swivel.

In at least some examples of the first aspect, the collapsible security container further comprises: a left flap panel and a right flap panel located within the interior compartment, wherein the left flap panel is connected proximate to an intersection between respective edges of the back panel and the left side panel, wherein the right flap panel is connected proximate to an intersection between respective sedges of the back panel and the right side panel, wherein the left flap panel and right flap panel are each parallel to the left side panel and right side panel, respectively, and are each foldable to form a double panel on the left and right side of the collapsible box when folded parallel thereto.

In at least some examples of the first aspect, corresponding portions of hook-and-loop fastener are provided on left side panel and left flap panel to releasably secure the left side panel and left flap panel together when folded parallel thereto, and corresponding portions of hook-and-loop fastener are provided on right side panel and right flap panel to releasably secure the right side panel and right flap panel together when folded parallel thereto.

In at least some examples of the first aspect, the left flap panel and the right flap panel are rigid panels.

In at least some examples of the first aspect, the left flap panel and the right flap panel are formed of a rigid plastic sheet.

In at least some examples of the first aspect, the collapsible security container further comprises: a locking strap attached to the hinged-lid, the locking strap having a snap connector for connecting to a corresponding snap fitting connector on the front panel.

In at least some examples of the first aspect, the collapsible security container further comprises: a fastening mechanism for securing the security container to a door or wall, wherein the fastening mechanism comprises a strap that terminates in a fastener for securing the security container about or to a door or wall.

In at least some examples of the first aspect, the fastening mechanism comprises a swivel attached to the back panel in a central part of a top portion thereof and a two-part strap attached to the swivel, the two-part strap terminating in the fastener, the two-part strap comprising a first strap portion connected to the swivel and a connector, and a second strap portion connected to the connector and the fastener.

In at least some examples of the first aspect, the connector is a combination quick release buckle and lock.

In at least some examples of the first aspect, the fastener is a door hook.

In at least some examples of the first aspect, the fastener is a wall plate.

In at least some examples of the first aspect, the collapsible security container further comprises: means for securing the collapsible security container to a mounting surface.

In at least some examples of the first aspect, the collapsible security container further comprises: a lock located in the hinged-lid towards a front of the hinged-lid, wherein a keyway of the lock is exposed by an outer surface of the hinged-lid and a latch of the lock is exposed by an inner surface of the hinged-lid; and a receiver for engaging the latch of the lock attached to the front panel.

In at least some examples of the first aspect, the lock is a slam lock, the latch of the slam lock being a spring-loaded latch.

In at least some examples of the first aspect, the lock is an electronic lock comprising a keypad.

In at least some examples of the first aspect, the collapsible security container further comprises: a support structure attached to the receiver, the support structure comprising a vertical support member extending generally vertically between top and bottom edges of the front panel, and a horizontal support member extending generally horizontally between left and right bottom edges of the front panel.

In at least some examples of the first aspect, the support structure is a general T-shape with the horizontal support member at or near the top edge of the support structure proximate to the top edge of the front panel of the box.

In at least some examples of the first aspect, the receiver is integrally formed with the support structure.

In at least some examples of the first aspect, the support structure is located within fabric layers of the front panel.

In at least some examples of the first aspect, the collapsible security container further comprises: a hand strap attached to a top surface of the bottom flap panel.

In accordance with a first embodiment of a second aspect of the present disclosure, there is provided a kit comprising a collapsible security container in accordance with the present disclosure as described above and herein, and a four-sided temperature control sleeve or a set of temperature control panels sized and configured to be received in the interior compartment of the security container, the temperature control sleeve or a set of temperature control panels comprising a containing a gel or liquid activatable for cooling or heating.

In at least some examples of the second aspect, the kit further comprises a temperature control panel sized and configured to be received in a pocket on an inside surface of the hinged-lid.

In at least some examples of the second aspect, the kit further comprises a temperature control panel sized and configured to be located on the bottom panel.

Figure 8:
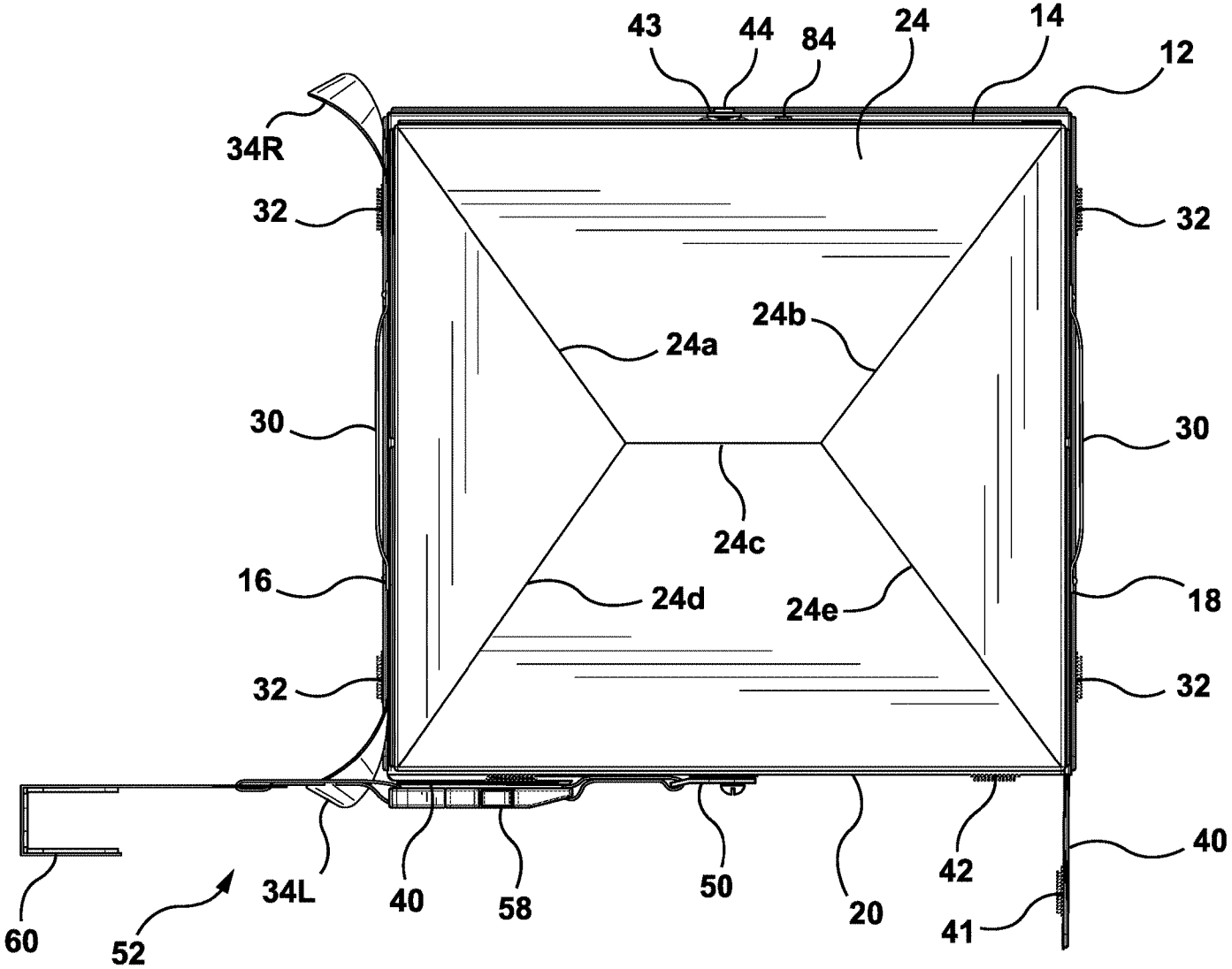
FIG. 8 is a bottom view of the collapsible security container of FIG. 1.
Figure 9:
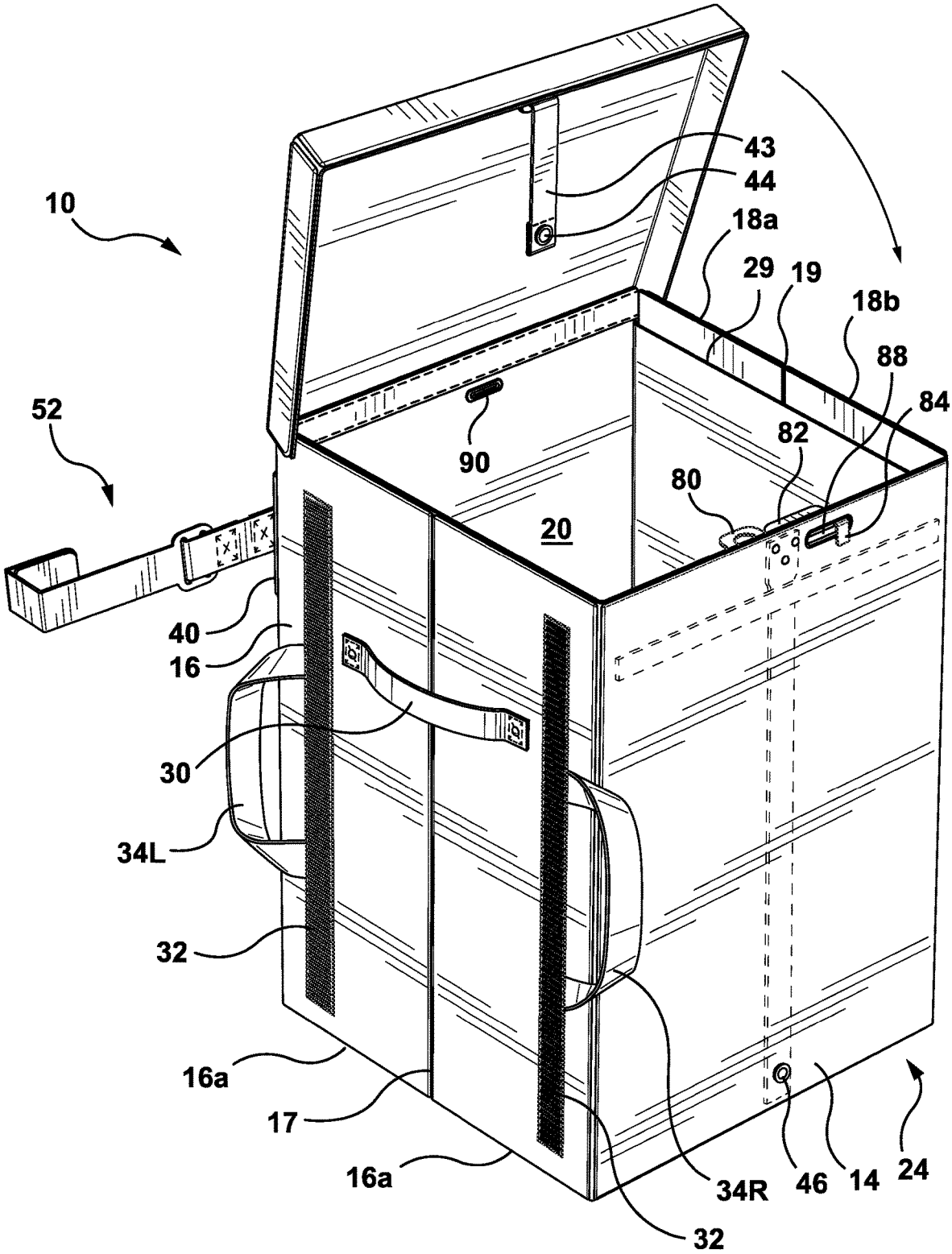
FIG. 9 is a front perspective view of the collapsible security container of FIG. 1 with the hinged-lid in an open position.

FIGS. 1-21 illustrate a first embodiment of a collapsible security container 10 in accordance with the present disclosure. The security container 10 may be secured to a door or the like. The security container 10 comprises a collapsible box 12 having a hinged-lid 22 hingeably connected to the box 12 to provide a hinged-lid container. FIGS. 1-8 illustrate the security container 10 with the hinged-lid 22 in a closed position whereas FIG. 9 illustrates the security container 10 with the hinged-lid 22 in an open position. The box 12 defines an interior space in the form of cavity which can be used for receiving packages, such as deliveries or mail, may be a parcel, box, envelope or other object. The box 12 can alternatively be used for receiving packages to be picked up. Examples of a suitable size of the security container 10 are 16" width×16" depth×22" height, and 18" width×17" depth×24" height. Advantageously, these sizes allow the security container 10 to be large enough to accept most commercial packages and while being small enough to be secured in front or near a residential door and still allow a resident to open the door and secure or unsecure the security container 10 about the door, as described more fully below.

The box 12 is formed from a plurality of panels (or walls). The panels are connected by fold lines or seems between the panels. The panels each have a quadrilateral shape, typically rectangular except where otherwise indicated. The plurality of panels includes a front panel 14, a left side panel 16, a right side panel 18, a back panel 20, and a bottom panel 24.

The hinged-lid 22 is connected to the back panel 20. The hinged-lid 22 may be connected to the collapsible box 12 by a hinge extending across all or substantially all of the back panel 20. The hinge may be located at or near the top edge of the back panel 20. The hinge line may be provided by a fold line where the hinged-lid 22 is connected to the back panel 20 or a flexible flap of the hinged-lid 22, for example. The hinge line may be located at the top of the back panel 22, or the front or back of the back panel 22 near the top thereof. The hinge may be provided by a hinge line in connecting fabric between a top panel in the hinged-lid 22 and the back panel 20, for example, a fabric hinge in embodiments in which the hinged-lid 22 is stitched or glued to the back panel 20. Alternatively, a mechanical hinge such as a piano hinge may be used. For example, the mechanical hinge may extend across the back panel 20 and be secured to the back panel 20 by a series of suitable fasteners such as rivets or the like, the fasteners extending between the outer surface and inner surfaces of the back panel 20. Alternatively, the hinge may be provided by a combination of a fabric hinge and a mechanical hinge.

Figure 32:
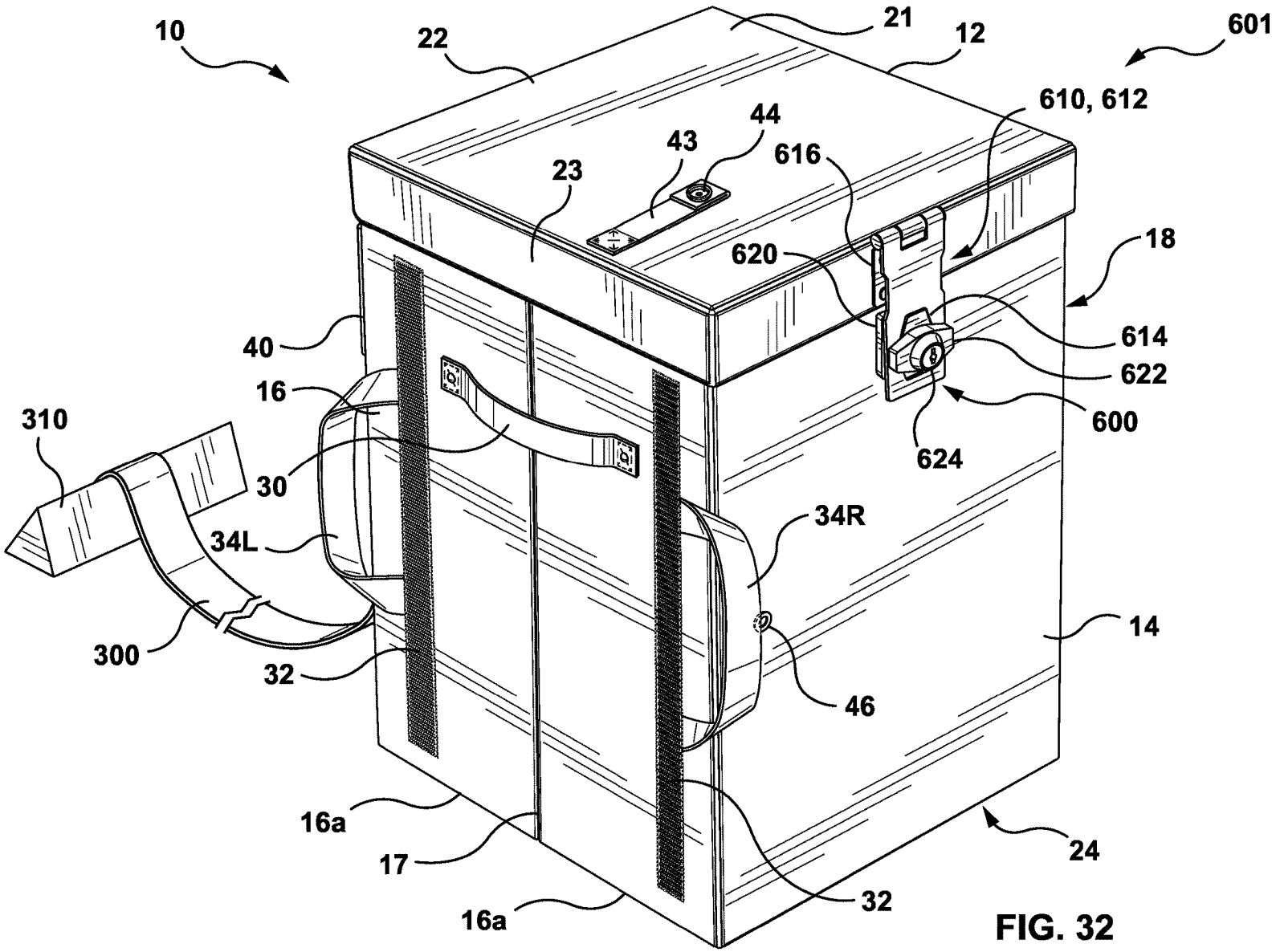
FIG. 32 is a front perspective view of a ninth embodiment of a collapsible security container in accordance with the present disclosure with a hasp lock for securing the hinged-lid in a closed and locked position.
Figure 33:
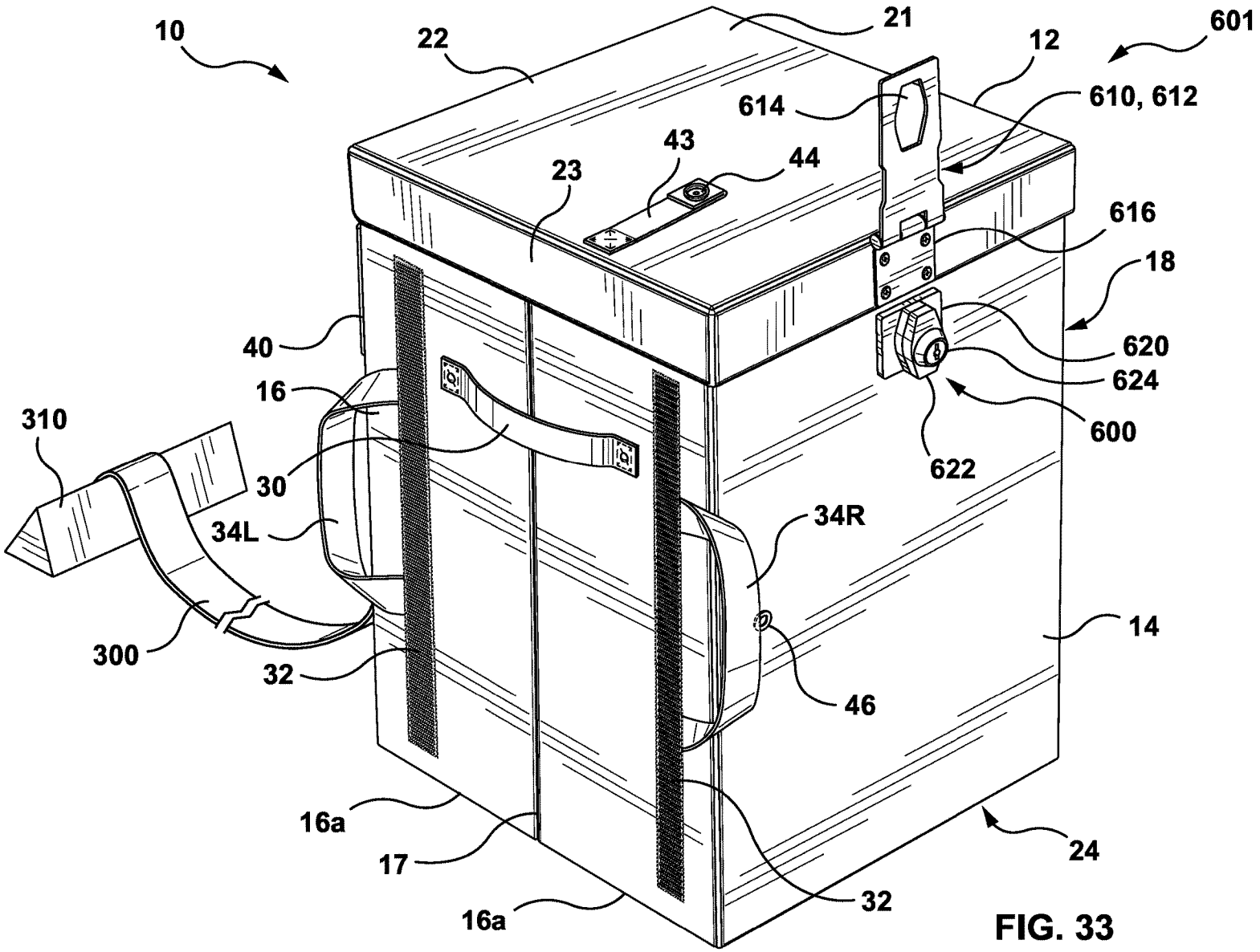
FIG. 33 is a front perspective view of the ninth embodiment of a collapsible security container in accordance with the present disclosure with the hasp lock for securing the hinged-lid in an open position.
Figure 34:
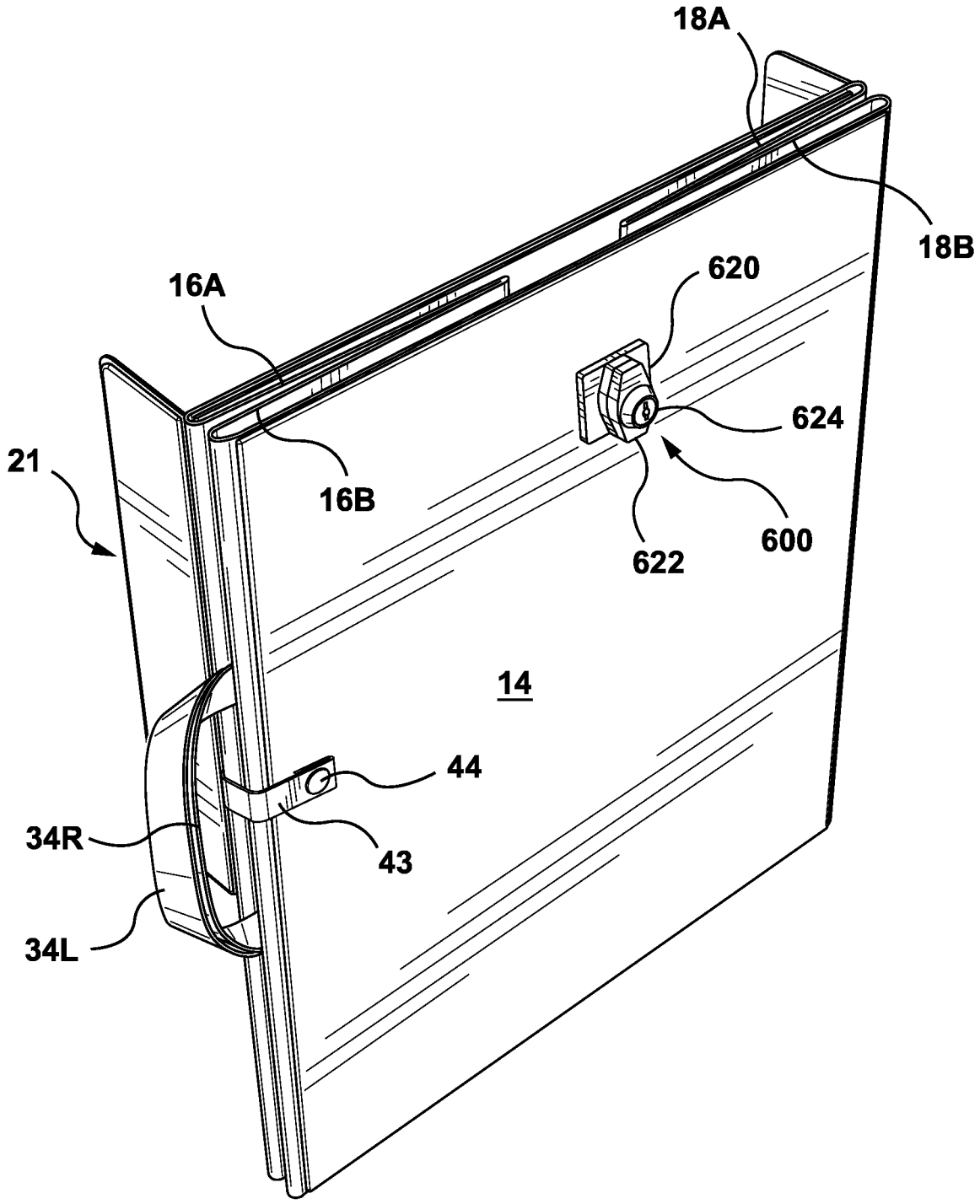
FIG. 34 is a front perspective view of the collapsible security container of the ninth embodiment in a fully closed position with the hinged-lid secured to the box using a locking strap.

The panels also include a bottom flap panel 25 on the interior of the box 12 to create a double-panel bottom when the box 12 is fully opened. The panels also include a left side flap panel 27 and a right side flap 29 on the interior of the box 12 to double-panel side walls when the box 12 is fully opened. The hinged-lid 22 includes a locking strap 43 with a snap fitting (also known as a snap connector or "snap") 44 for connecting to a corresponding snap fitting 46 on the front panel 14 when the security container 10 is collapsed. The snap fitting 44 is one of a male and female snap fitting while the snap fitting 46 is the other of a male and female snap fitting. The locking strap 43 may be made of nylon and may be sewn, rivetted, glued or otherwise attached to the interior of the hinged-lid 22. The location of the point of attachment of the locking strap 43 may vary based on the locking system used to secure the hinged-lid 22 to the box 12 or other reasons. For example, the locking strap 43 may be attached to the inner surface (also known as the underside) of the top panel of the hinged-lid 22 or inner surface (also known as the back side) of a front panel of the multi-sided rim 23 as shown in FIG. 10D. Alternatively, in other embodiments the locking strap 43 may be attached to the outer surface of the top panel of the hinged-lid 22, for example, towards the left or right side thereof. In FIGS. 32 and 33, the locking strap 43 is located toward the left side of the top panel of the hinged-lid 22 and the left side of the multi-side rim 23 in a central region thereof. The snap fitting 46 is located toward the left side of the front panel 14 in a central region thereof for matting with the snap fitting 43 of the locking strap 43 as shown in FIG. 34.

The flap panels 25, 27, 29 are best shown in FIG. 15-21. The flap panels 25, 27, 29. The bottom flap panel 25 includes a hand strap 31 (FIG. 15) to assist in pulling up the bottom flap panel 25 when the box 12 is to be collapsed. The hand strap 31 may be made of nylon and may be sewn, rivetted, glued or otherwise attached to the bottom flap panel 25 for access by a user of the security container 10 when the box 12 is uncollapsed (expanded).

The left side panel 16 and right side panel 18 are each comprised of two portions connecting along a fold line. The division of the left side panel 16 and right side panel 18 into two portions enables, in part, the collapsing of the box 12 and the security container 10. The left side panel 16 comprises a first portion 16*a* and a second portion 16*b* connected by a fold line 17. The right side panel 18 comprises a first portion 18*a* and a second portion 18*b* connected by a fold line 19.

The front panel 14, left side panel 16, right side panel 18, back panel 20, bottom flap panel 25, left side flap panel 27 and right side flap 29 are each rigid panels whereas the bottom panel 24 is a flexible panel. The hinged-lid 22 also has a rigid panel construction and comprises a top panel 21 and a multi-sided rim (or lip) 23 extending around the top panel 21 to partially overlap the front panel 14, left side panel 16, and right side panel 18. The rim 23 may also partially overlap the back panel 20 if connected to the back panel 20 below the top edge. The rim 23 comprises three panels connected to the top panel 21 at the front, left side and right side thereof referred to the front panel, left side panel and right side panel of the rim 23. The rim 23 prevents or inhibits water, dust, moisture and other environmental elements from entering the security container 10 when the hinged-lid 22 is closed. The security container 10 comprises a locking mechanism for securing the hinged-lid 22 to the box 12. The locking mechanism comprises a slam lock 48 located in the top panel 21 of the hinged-lid 22, described more fully below in connection with FIG. 10A-10E. The slam lock 48 allows the security container 10 to be closed and locked from an unlocked state without a key. This is convenient when the security container 10 may be used by delivery people or the like. For example, a user expecting a package may remove the security container 10 from storage in a closet or the like, uncollapse/expand the security container 10, and leave the security container 10 in a door area or porch of their home with the hinged-lid 22 open, in an unlocked state and secured to a wall or door. When a delivery person arrives to deliver a package, they can place the package in the security container 10 and merely close the hinged-lid 22, automatically locking the security container 10 without a key. When the user goes to retrieve the package, the user inserts the lock key into the keyway (also referred to as the key cylinder) of the slam lock 48 and unlocks the security container 10. The user then removes the package from the security container 10, collapses the security container 10, brings the security container 10 back inside their home, and places the security container 10 back into storage.

The rigid outer panels, comprised of the front panel 14, left side panel 16, right side panel 18, back panel 20, top panel 21 and rim 23, are each formed by a rigid insert positioned (e.g., sandwiched) between two layers of fabric, which is stitched at the edges such that the fabric surrounds and fits tightly against the rigid inserts. In other embodiments, flexible sheeting or other flexible material having the same or equivalent functional properties may be used instead of fabrics.

The two fabric layers comprise an outer layer which is exposed to the environment and an inner lawyer which is exposed to the interior compartment of the security container 10. The outer fabric layer comprises a medium strength, durable and cut resistant material, such as a ballistic nylon fabric or similar basketwoven fabric such as Cordura™ basketwoven fabric, or polyvinyl chloride (PVC)-coated polyester fabric. PVC-coated polyester fabric is advantageously strong, durable and cut resistant material and provides a reasonable waterproofing capacity. Alternatively, the outer fabric layer may comprise a high strength, durable and cut resistant material such as Kevlar™ or UHMWPE (ultra-high-molecular-weight polyethylene).

The inner fabric layer may also comprise a medium strength, durable and cut resistant material. Alternatively, the inner fabric layer may be a different fabric. For example, the inner fabric layer may be a low strength material (e.g., nylon 210) to reduce costs or for other reasons or a thermal aluminum foil foam insulation layer or other reflective foil foam insulation layer, as described below.

The rigid insert may comprise a rigid plastic sheet, such as a rigid polycarbonate or rigid polyethylene sheet. The rigid insert is preferably corrugated plastic sheet to be light in weight while providing the desired strength but may be solid. For example, the rigid insert may be 5 mm corrugated plastic sheet having a density/weight of 0.15 lbs./sq. ft. The first portion 16*a* and second portion 16*b* of the left side panel 16 and the first portion 18*a* and second portion 18*b* of the right side panel 18 each comprise a rigid insert. The fold lines 17, 19 are formed between the rigid panels of the respective rigid inserts by stitching or the like in the fabric layers.

The rigid inner panels, comprised of the bottom flap panel 25, left side flap panel 27 and right side flap 29, typically consist of a rigid plastic sheet, such as a polycarbonate sheet, without a fabric covering on either side. Alternatively, the flap panels 25, 27 and 29 may have a construction the same as or like the rigid outer panels 14, 16, 18 and 20. The panels are attached together at the edges by stitching or other suitable means to form flexible hinges, flexibly connecting the panels together. Similarly, the hinged-lid 22 is stitched to the box 12 at or near the top of the back panel 20 by stitching or other suitable means. The flap panels 25, 27 and 29 are attached at the edges of the back panel 20 and bottom panel 24, back panel 20 and left side panel 16, and back panel 20 and right side panel 18, respectively, by stitching or other suitable means.

The bottom panel 24, which is flexible and not rigid, comprises a high strength, durable and cut resistant material such as Kevlar™ or UHMWPE (ultra-high-molecular-weight polyethylene).

The outer fabric layer may be formed of a durable water repellent material. For example, the fabric may be coated with a durable water repellent (DWR) to make it water resistant (hydrophobic). Example DWR coatings may be perfluorinated carbon polymer coatings based on perfluorobutanesulfonic acid or perfluorooctanoic acid.

The outer fabric layer may be formed of an antimicrobial and/or antiviral material, i.e. a fabric having antimicrobial and/or antiviral properties. For example, the fabric may be treated to be antimicrobial and/or antiviral in addition to, or instead, of being treated to be water resistant. For example, the fabric may have an antimicrobial and/or antiviral coating. As an example of a suitable coating, the fabric may be coated with, or embedded with, a biocide. A biocide is a chemical substance or microorganism intended to destroy, deter, render harmless or exert a controlling effect on any harmful organism by chemical or biological means.

The outer panels of the box 12 and the top panel 21 of the hinged-lid 22 may be insulated with a suitable insulation material, such as a polyester foam insulation layer. The insultation material is typically separate from the rigid insert of the rigid panels, however it is contemplated that the insultation material and rigid inserts may be provided by an integrally formed body. In some examples, the inward facing side fabric layer may comprise a thermal aluminum foil foam insulation layer or other reflective foil foam insulation layer. This insulation layer comprise a one layer closed-cell foam bonded between two layers of fabric or film, one or both of which comprises a highly reflective metalized aluminum polyester film, which is easy to clean with a wet cloth or the like.

The above-noted panel construction provides a tamper resistant, water resistant, antimicrobial and/or antiviral container that is durable and strong.

A pair of hook-and-loop (HNL) fastener portions, such as HNL fastener strips 32 (also known as hook-and-pile fastener strips or touch fastener strips), are attached to the left side panel 16 and right side panel 18 extending between top and bottom portion of the first portions 16*a*, 18*a* and second portions 16*b*, 18*b*, respectively. Examples HNL fastener strips 32 are those sold under the Velcro™ brand. Each pair of HNL fastener strips 32 consists of two components: a linear fabric strip of hooks and a linear fabric strip of loops. Alternatively, square or rectangular patches may be used instead of strips. For example, 2"×2" patches may be located proximate to the corners of the facing surface of the left side and right side panels 16, 18 and the left flap panel and right flap panel. The patches may be located 2"-4" from the top and side edges of the panels. The HNL fastener strips 32 are correspondingly located on the first portions and second portions of the left side panel 16 and right side panel 18 for engagement with each other when the box 12 is collapsed. The HNL fastener strips 32 on the first portion of the left side panel 16 and right side panel 18 is one of a linear fabric strip of hooks and a linear fabric strip of loops, whereas the HNL fastener strips 32 on the second portion of the left side panel 16 and right side panel 18 is the other of a linear fabric strip of hooks and a linear fabric strip of loops. When the HNL fastener strips 32 are pressed together, the hooks catch in the loops and the strips fasten or bind temporarily until separated by pulling or peeling the two surfaces apart. In the first embodiment, the HNL fastener strips 32 are approximately 1" wide and extend between 50-70% of the height of the box 12 with the hinged-lid 22 closed. The % coverage of the HNL fastener strips 32 may vary.

HNL fastener portions 66 are located on the inside (inwardly facing side) of the left side panel 16 and right side panel 18. HNL fastener portions 64 are correspondingly located on the outside (outwardly facing side) of the left side flap panel 27 and the right side flap panel 29. The HNL fastener portions 66 comprise one of a fabric patch (or strip) of hooks and a fabric patch (or strip) of loops whereas the HNL fastener portions 64 are the other of a fabric patch (or strip) of hooks and a fabric patch (or strip) of loops. When the HNL fastener portions 66 and HNL fastener portions 64 are pressed together, the hooks catch in the loops and the HNL fastener portions fasten or bind temporarily until separated by pulling or peeling the two surfaces apart.

In the first embodiment, the HNL fastener portions 66 comprise a pair of HNL strips of approximately 1" width on the inside of the left and right side panels 16, 18 in the first and second portions thereof, and the HNL fastener portions 64 comprise a pair of HNL strips of approximately 1" width on the outside of the left flap panel 27 and right flap panel 29 in a corresponding location for engagement with the HNL fastener portions 66 when the box 12 is collapsed. The HNL fastener portions 66, 64 extend between 50-70% of the height of the box 12 with the hinged-lid 22 closed. The % coverage of the HNL fastener portions 64, 66 may vary between embodiments. For example, in other embodiments the HNL fastener portions 64, 66 may comprise a single strip proximate to the second portions 16*b*, 18*b* of the left and right side panels 16, 18. For another example, in other embodiments the HNL fastener portions 66 may comprise HNL fastener patches (e.g., 2"×2") located in the upper and lower portions (e.g., proximate to the corners) of proximate to the second portions 16*b*, 18*b* of the left and right side panels 16, 18, resulting in 4 sets or pairs of HNL patches. For yet another example, in other embodiments the HNL fastener portions 66 may comprise HNL fastener patches located in upper-left, upper-right, bottom-left and bottom-right portions of the inside surface of the left side panel 16 and right side panel 18, and the HNL fastener portions 64 may comprise a set of HNL fastener patches located near the upper-left, upper-right, bottom-left and bottom-right portions of the outside surface of the left side flap panel 27 and the right side flap panel 29. This results in 8 sets or pairs of HNL patches.

The handles 30 are intended for use when the security container 10 is uncollapsed/expanded. A set of secondary handles (or hand straps) 34L, 34R are attached to the left side panel 16, with the secondary handle 34L located in the first portion 16*a* of the left side panel 16 towards the edge thereof just outside the strip of HNL fastener 32, and the secondary handle 34R located in the second portion 16*b* of the left side panel 16 towards the edge thereof just outside the strip of HNL fastener 32. In other embodiments, the secondary handles 34L, 34R may be located at an equivalent position on the right side panel 18. The handles 30, 34L, 34R may be made of nylon and may be sewn, rivetted, glued or otherwise attached to the corresponding panel of the box 12.

The front panel 14, left side panel 16, right side panel 18 and back panel 20 are each connected to the bottom panel 24 along its edges. As best shown in FIG. 8, the bottom panel 24 may have fold lines that assist the bottom panel 24 in folding when the box 12 is collapsed. In the first embodiment, the bottom panel 22 has fold lines 24*a*, 24*b*, 24*c*, 24*d*, and 24*e*. The fold lines 24*a*, 24*b*, 24*c*, 24*d*, and 24*e* may be formed by sewn lines or other means. Fold line 24*c* is a lateral fold line extending across the bottom panel 24 between the left side panel 16 and the right side panel 18, with diagonal fold lines 24*a*, 24*d* and 24*b*, 24*c* extending from the ends of the fold line 24*c* towards the corners of the left side panel 16 and the right side panel 18, respectively. In other embodiments, the lateral fold line may be omitted and the fold lines may consist of four diagonal fold lines extending from the four corners of the bottom panel 24 to its center. In yet other embodiments, the fold lines may be omitted.

The security container 10 also comprises a fastening (or securing) mechanism 52 for securing the security container 10 to a structure such as a door, wall or the like. The fastening mechanism 52 comprises a strap attached to the collapsible box 12. In some examples, the strap is 24" in length or longer. The strap may comprise a buckle so that the length of the strap may be adjusted after the security container 10 has been secured to structure (e.g., door) to secure, move or snug the security container 10 as close to the structure (e.g., door) as possible, thereby limiting the freedom of movement of the security container 10 after it has been secured to the structure (e.g., door). The strap has an attachment end that is attached to the collapsible box 12 and a free end that terminates in a fastener or stopper for securing the security container about or to the structure, such as a door, wall or the like. The strap is preferable attached to the back panel 20 may be attached to another panel such as the bottom panel 22, left side panel 16, right side panel 18.

Figure 28:
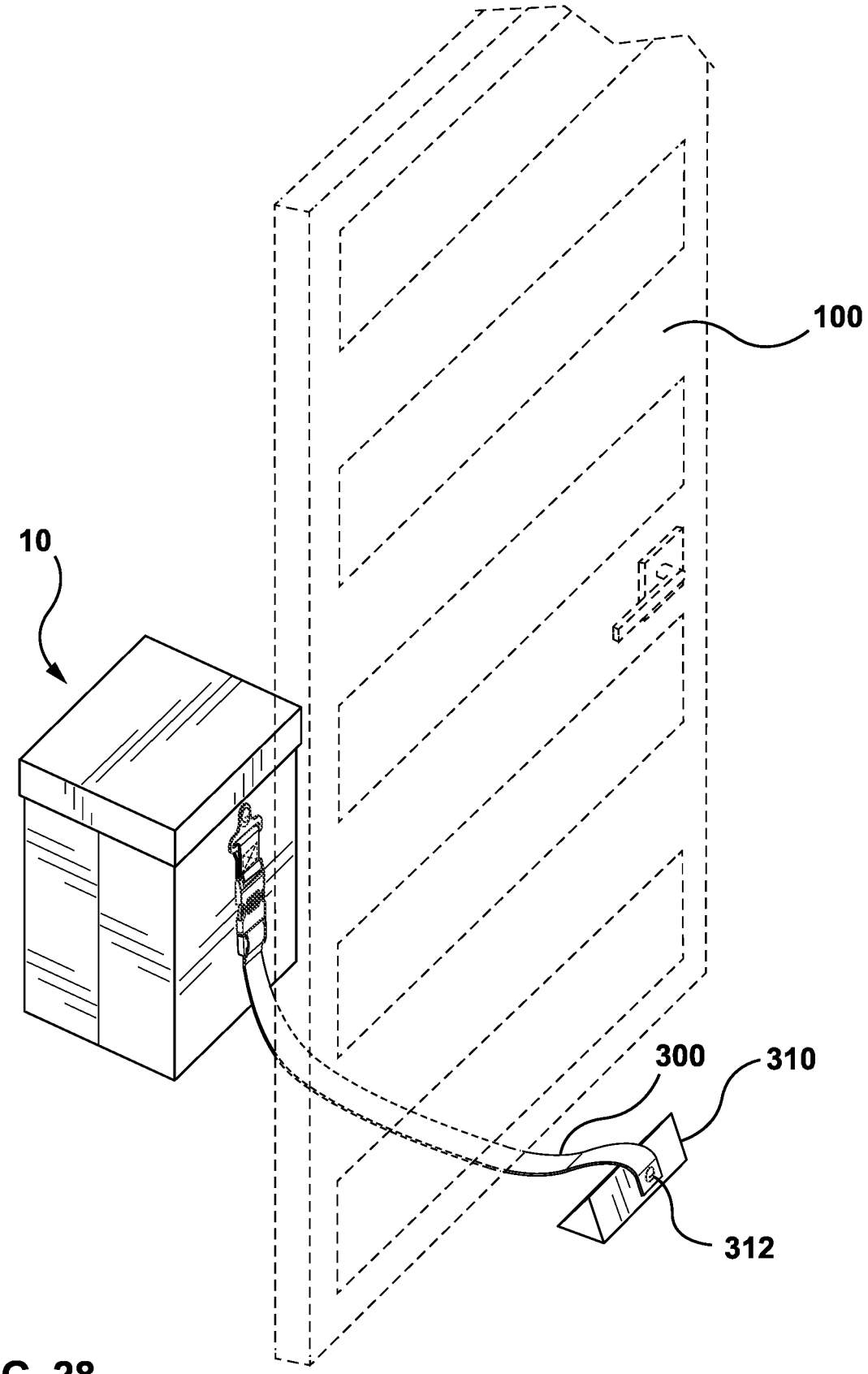
FIG. 28 is a front perspective view of a seventh embodiment of a collapsible security container in accordance with the present disclosure with the hinged-lid in a closed position.

The fastener (or anchor, mount or other securing means) at the free end of the strap may be used to secure or connect the security container 10 about or to the structure, such as a door, wall or the like. A stopper is a mechanical stop that brings a halt or causes to stop the movement of the security container 10 when it is secured about a structure, thereby limiting the range of movement of the security container and preventing its removal from the structure to which it is secured. The stopper may be received in a dedicated receiver attached to the structure, such as a socket, for example, a lockable or latchable socket. The stopper may be received inside a residence or other structure, for example, with the strap passing under the door as shown in FIG. 28 with the security container 10 located on the outside of the door. The stopper is configured to be caught or wedged between the door and the floor should any one attempt to remove the security container 10 from the door area or porch in an act or theft of the like. Examples of suitable shapes for the stopper include an elongate member having a square, circular, triangular, X-shaped or L-shaped cross-section. Examples of a suitable size of the stopper are 3-4" in diameter, 3-4" in length and 1-2" in cross-section. The size and shape of the stopper may vary.

Figure 2:
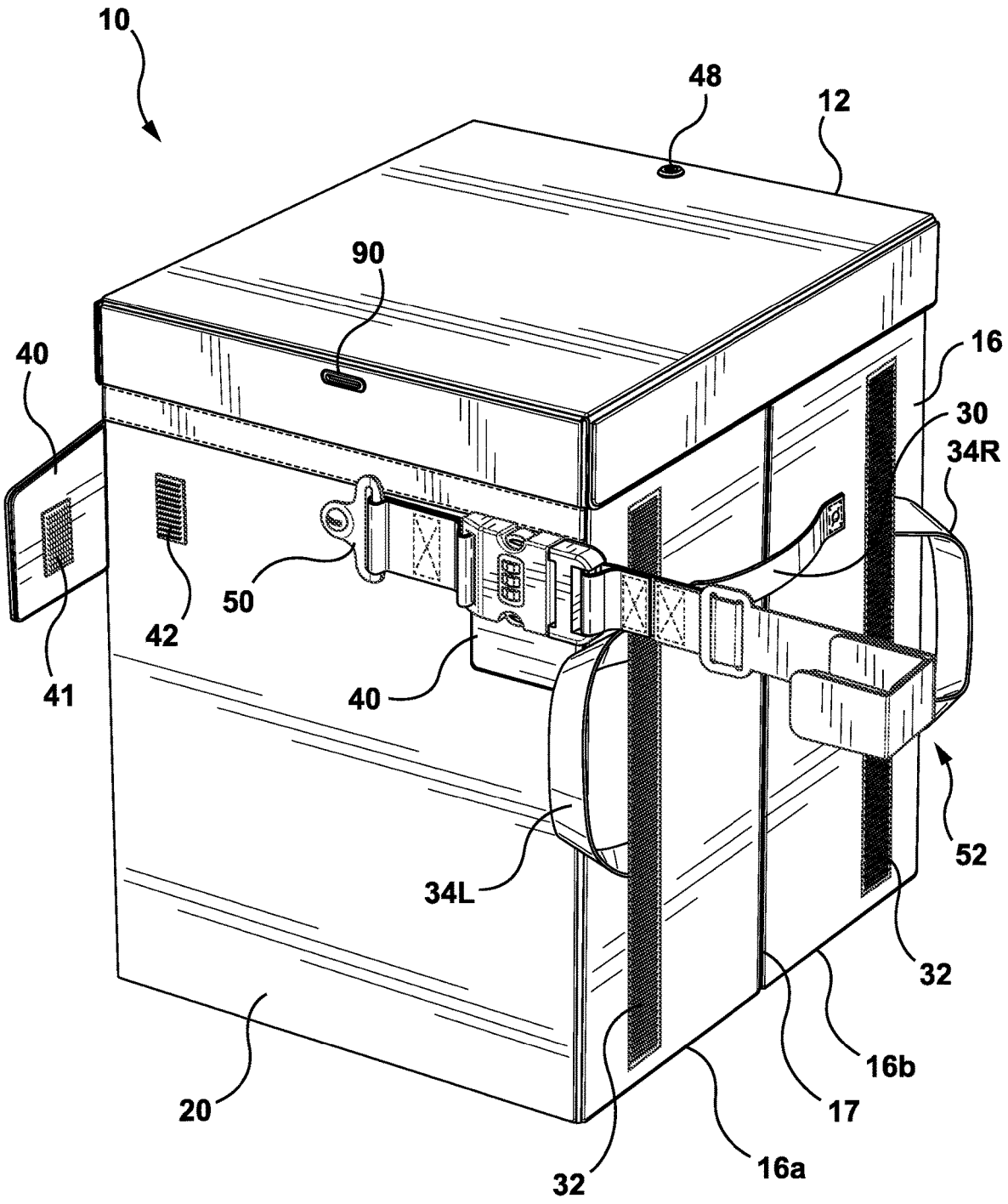
FIG. 2 is a rear perspective view of the collapsible security container of FIG. 1.
Figure 3:
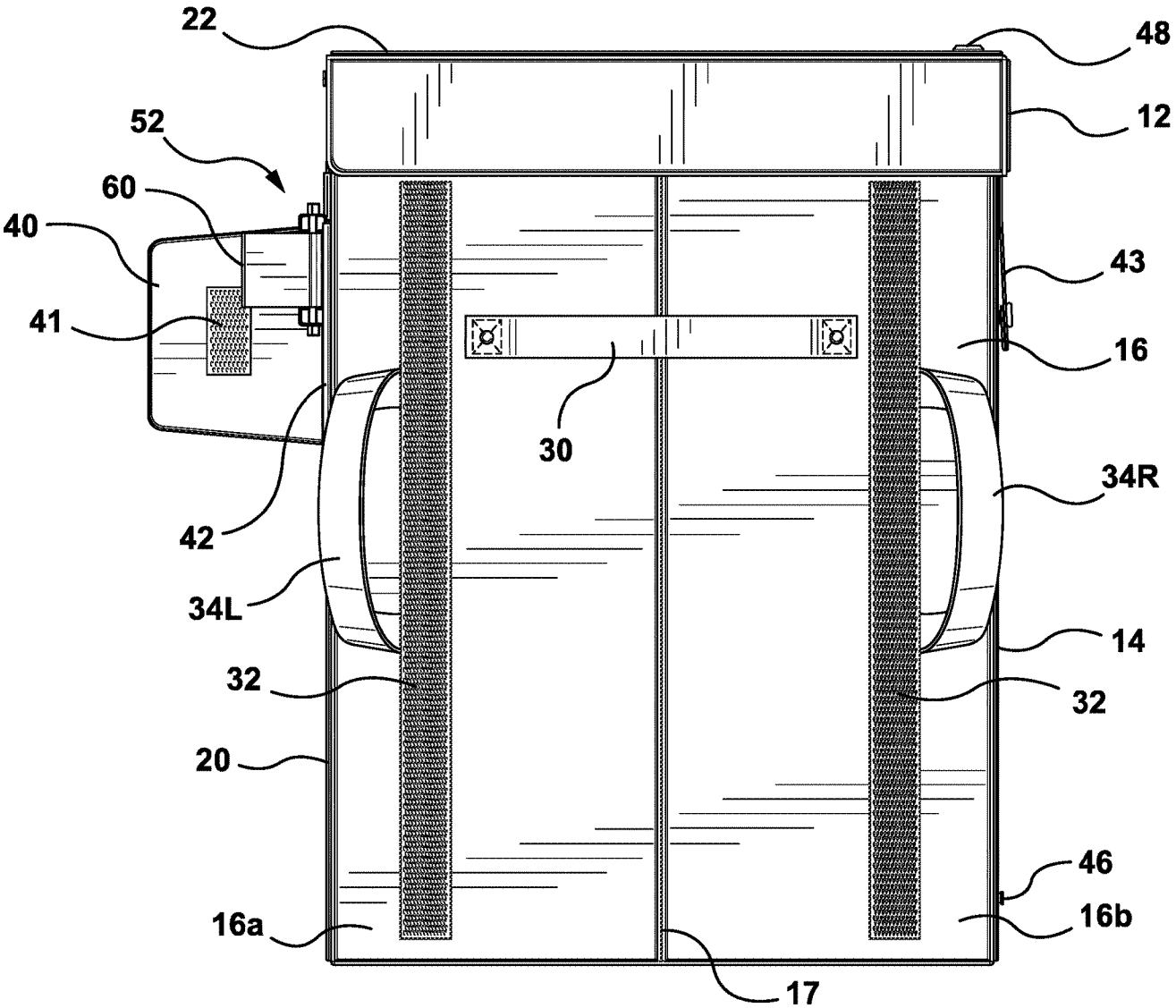
FIG. 3 is a left side view of the collapsible security container of FIG. 1.
Figure 4:
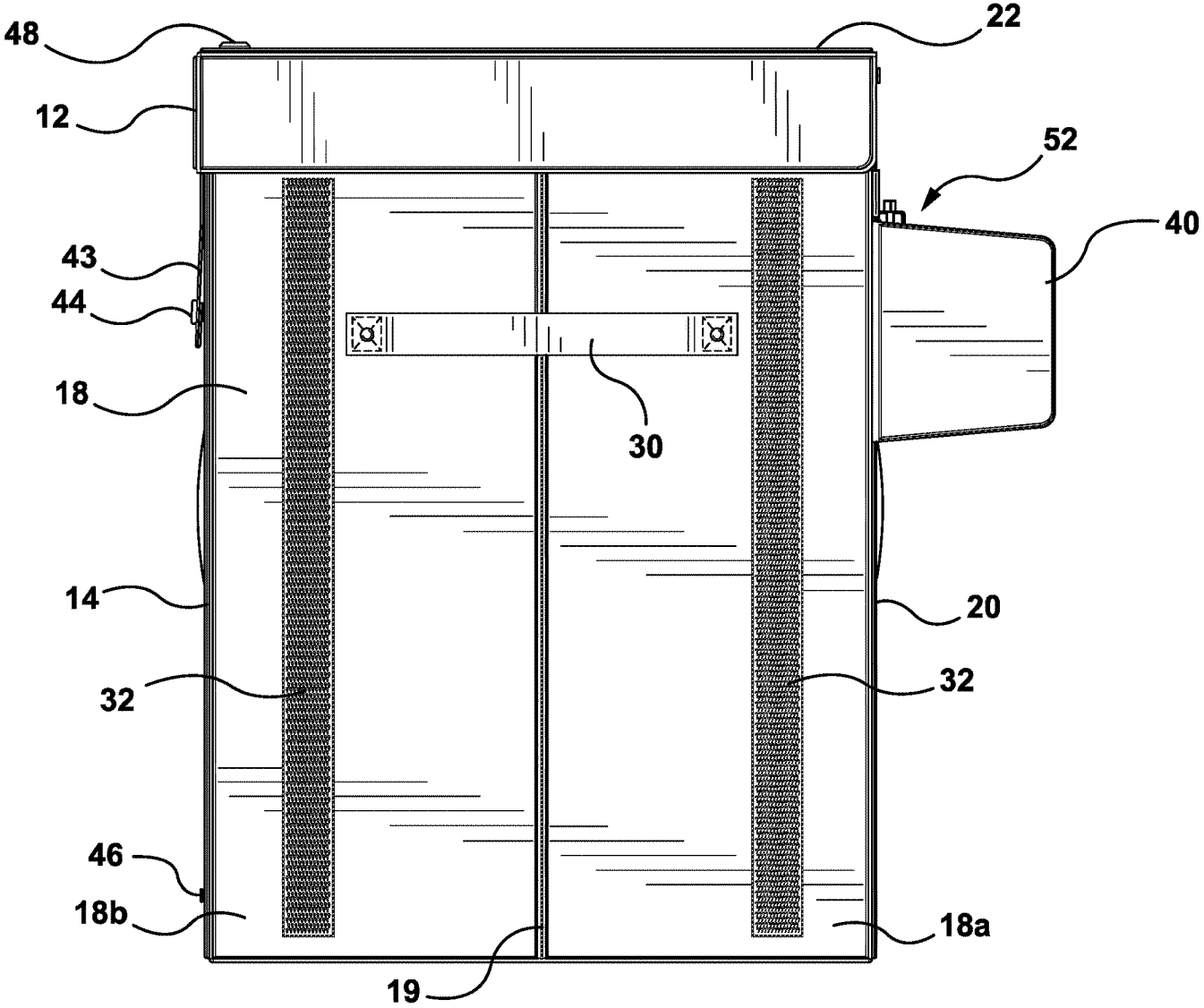
FIG. 4 is a right side view of the collapsible security container of FIG. 1.
Figure 5:
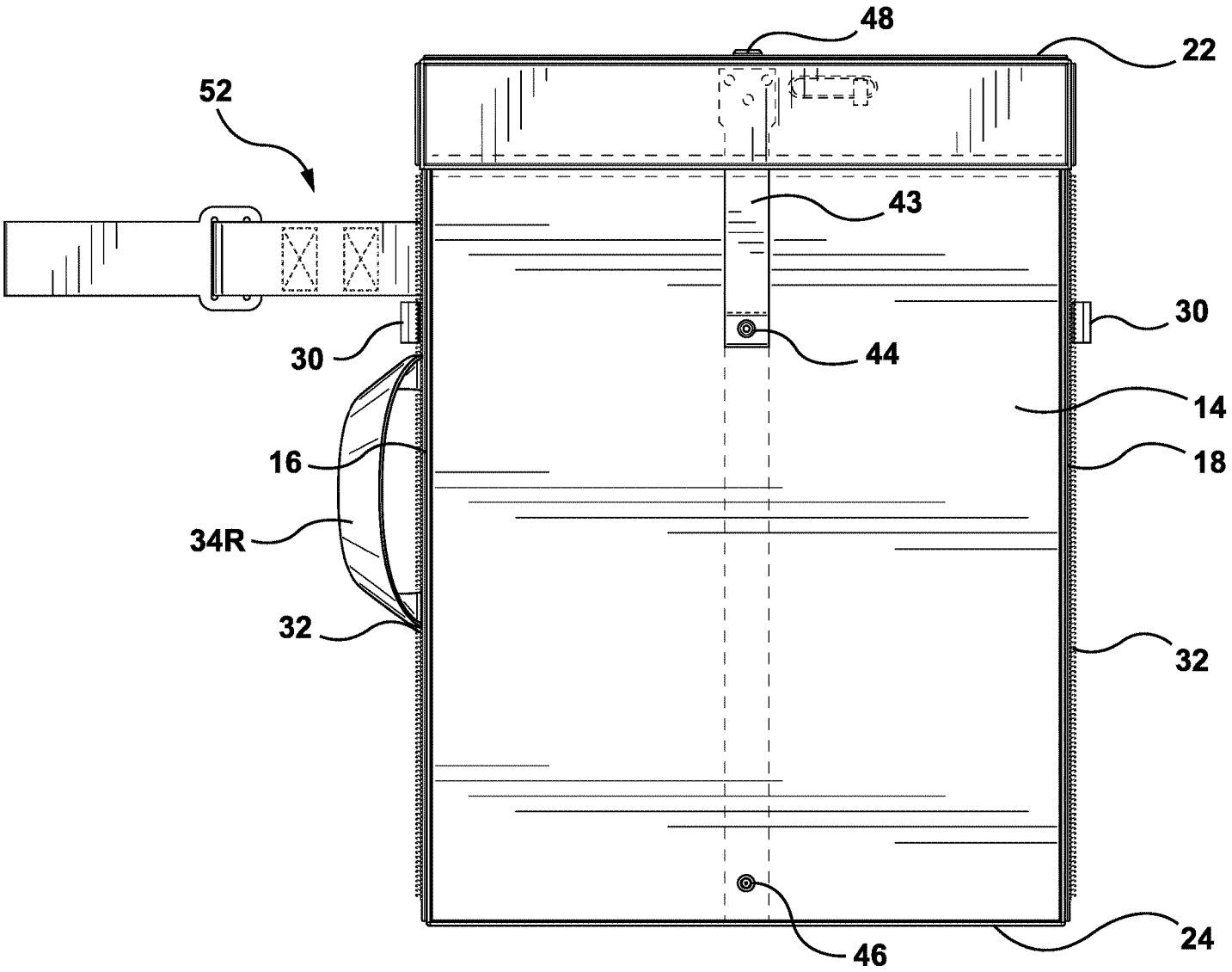
FIG. 5 is a front view of the collapsible security container of FIG. 1.
Figure 6:
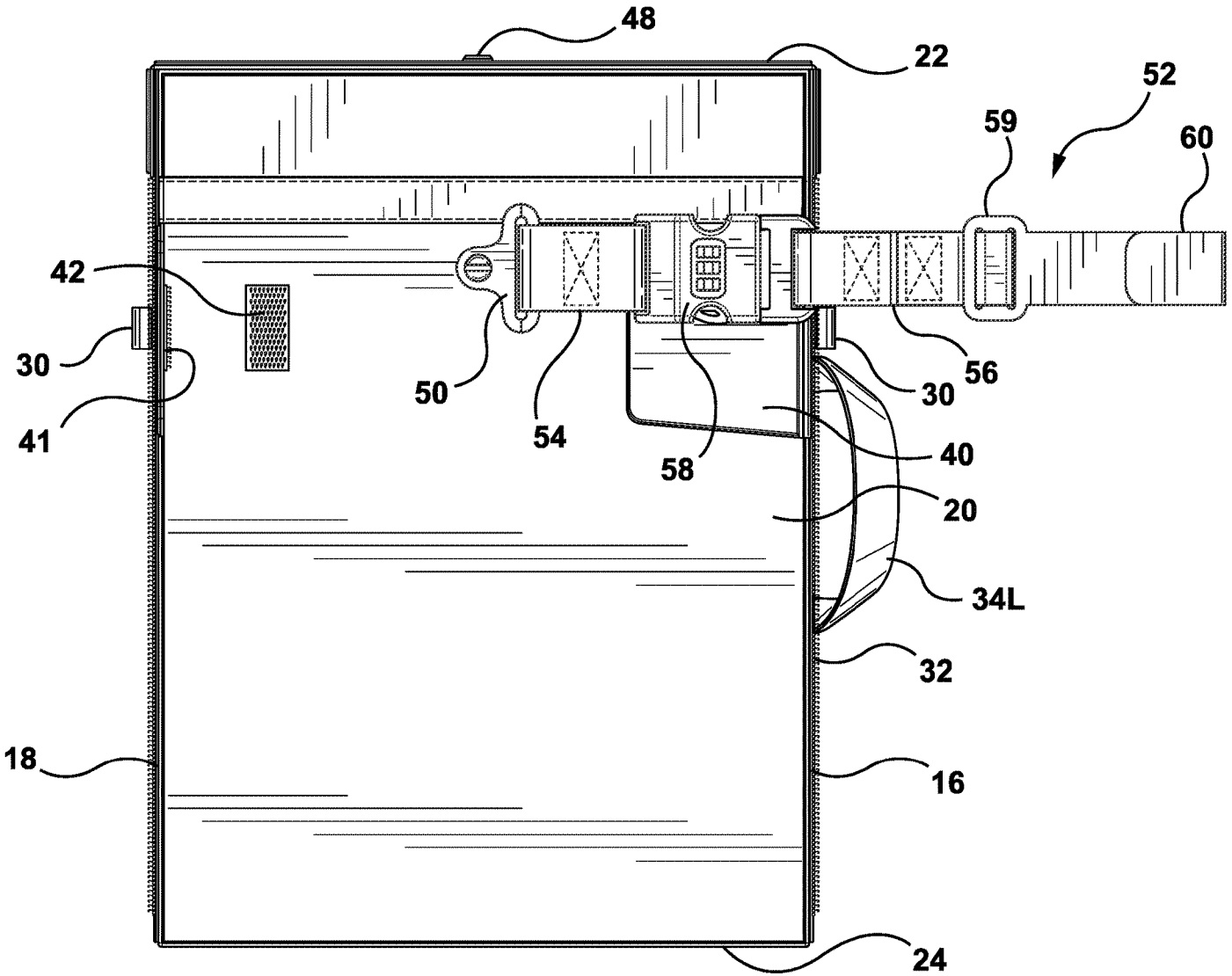
FIG. 6 is a rear view of the collapsible security container of FIG. 1.
Figure 7:
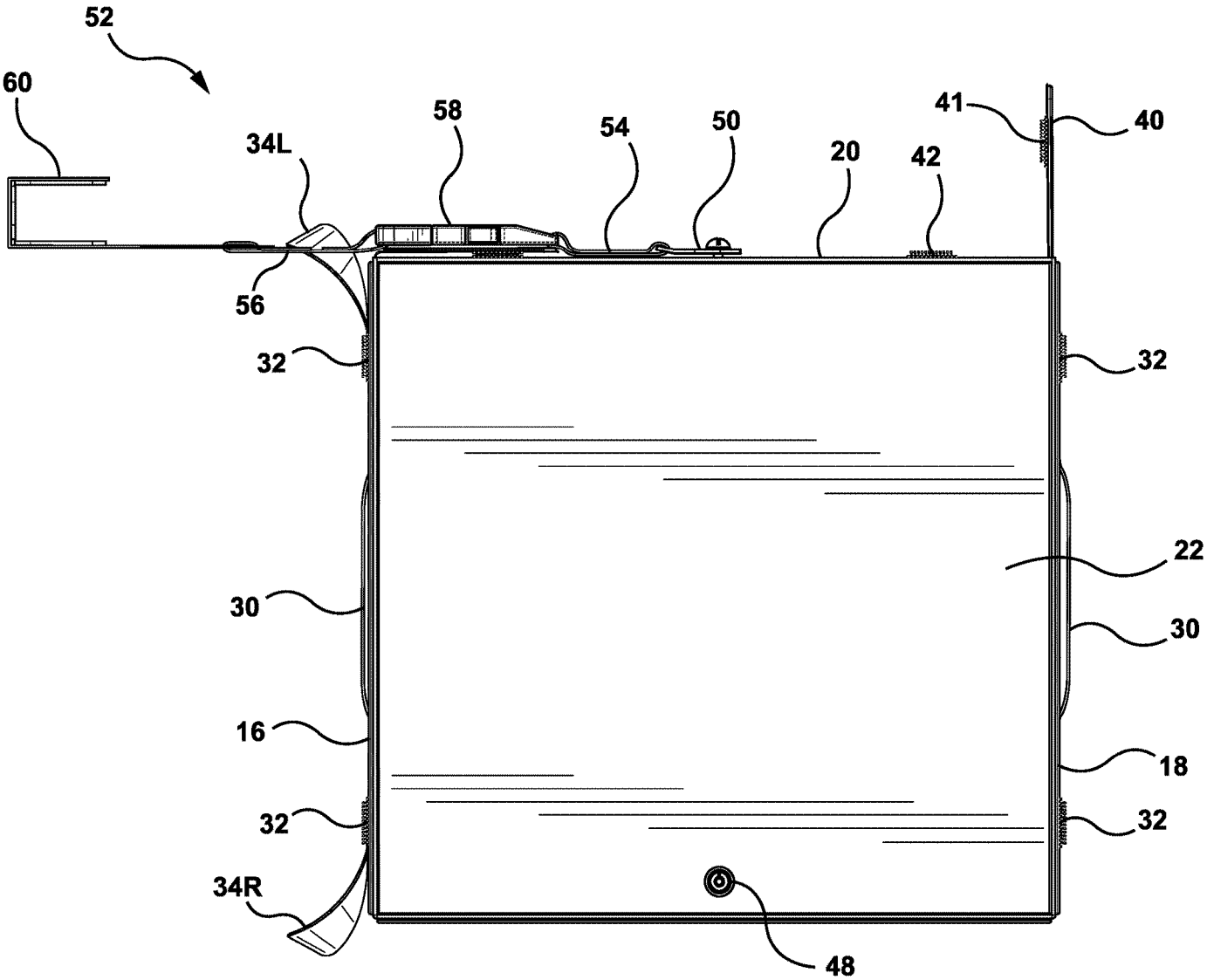
FIG. 7 is a top view of the collapsible security container of FIG. 1.

As best shown in FIGS. 2 and 6, in the first embodiment the fastening mechanism 52 comprises a swivel 50 and a two-part strap comprising a first strap 54 and a second strap 56 attached to the swivel 50. The two-parts of the strap are connected by a connector which, in the first embodiment, is a combination quick release buckle and lock 58. The two-part strap allows the fastener, anchor, mount or other securing means of the fastening mechanism 52 to be changed depending on the mounting environment. This allows the fastening mechanism 52 to be used to secure the security container 10 about a residential door or a wall, for example. When not in use, the second part of the two-part strap may be disconnected via the combination quick release buckle and lock 58 and stored in the collapsible box 12. In other embodiments, the fastening mechanism 52 may comprise a one-piece strap connected to the swivel 50 at one end and a fastener or stopper at the other end. The one-piece strap may further comprise a buckle for adjusting the length of the strap, thereby providing an adjustable strap. In yet other embodiments, the fastening mechanism 52 may comprise a one-piece strap attached directed to the collapsible box 12 by sewing, stitching, glue or the like.

The strap of the fastening mechanism 52 is formed from a suitable high strength, durable and cut resistant material such as Kevlar™ or UHMWPE (ultra-high-molecular-weight polyethylene). The strap may be 1" or 2" in width to increase strength and cut resistance. The strap may be reinforced with steel or other materials to improve cut resistance.

The swivel 50 is attached to the back panel 20 in a central part of a top portion thereof via a rivet, bolt or the like. The swivel 50 allows at least 180 degrees of rotation, possibly 360 degrees of rotation, allowing the strap connected thereto to be repositioned by the user with ease. Although an example construction of the swivel 50 is shown, any suitable swivel construction may be used. The first strap 54 is attached to the swivel 50 and a combination (quick release) buckle and lock 58. The first strap 54 is secured about slotted openings in the swivel 50 and combination quick release buckle and lock 58. The first strap 54 is looped through the slotted openings and sewn back onto itself. The lock of the combination quick release buckle and lock 58 in the first embodiment is a combination lock, in particular, a 3-digit combination lock. In other embodiments, the lock of the combination quick release buckle and lock 58 may be a key lock or other suitable lock.

Figure 11A:
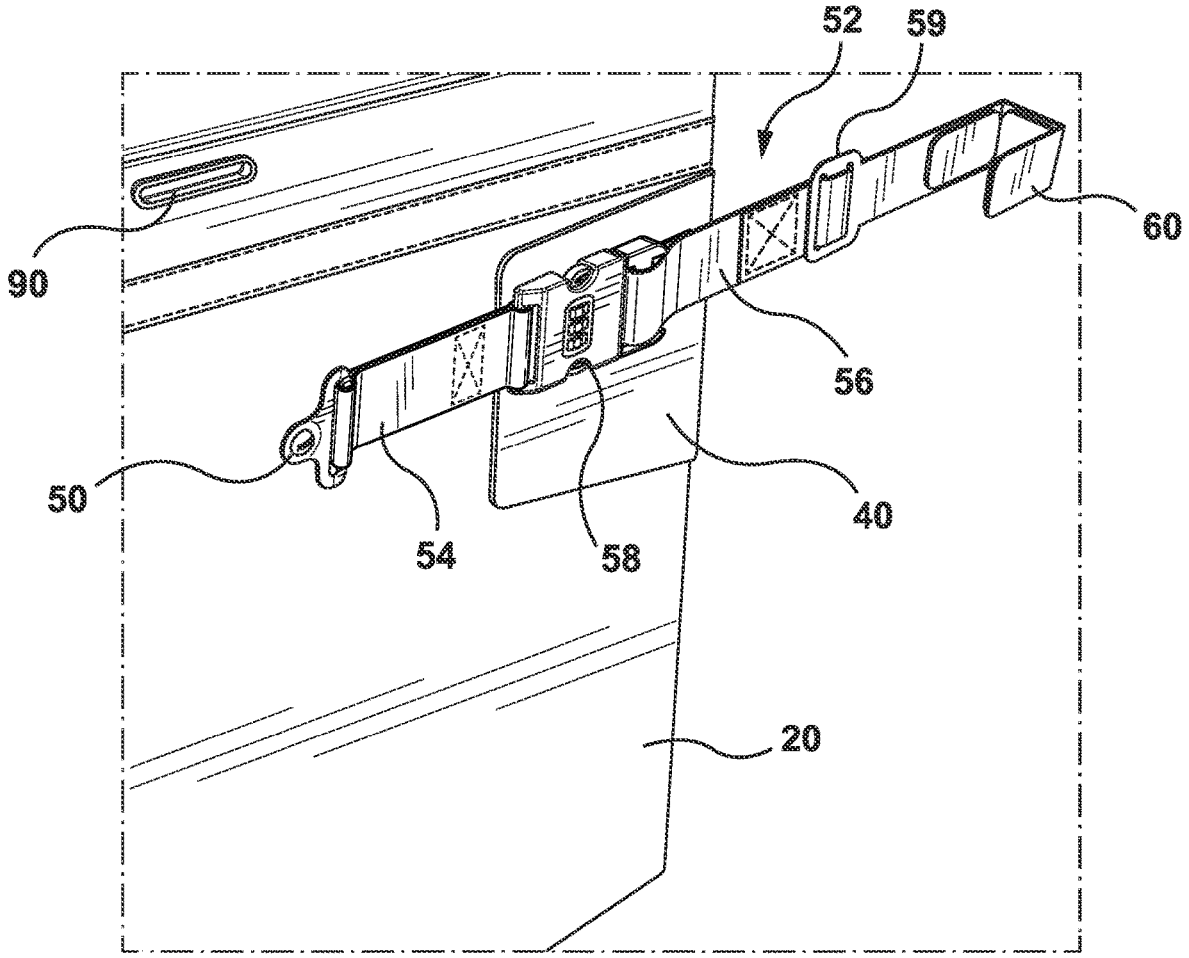
FIG. 11A is an enlarged view of the strap of the collapsible security container of FIG. 1.
Figure 11B:
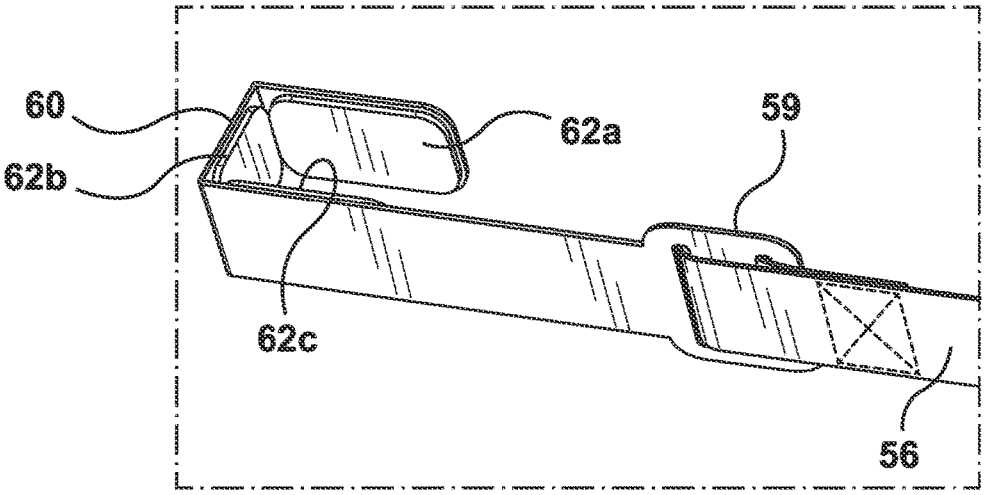
FIG. 11B is an enlarged view of the hook of the strap of FIG. 11A.

The combination quick release buckle and lock 58 comprise a male and female component. In the first embodiment, the first strap 54 is secured to the female component of the lock which houses the lock whereas the second strap 56 is secured to the male of the lock. The second strap 56 terminates in a door hook 60 sized and configured for securing about the free end or edge of a standard front door of a house, apartment, condo or the like. The swivel 50 allows the two-part strap to be pivoted for securing to either side of a door depending on the location of the door hinges. As best shown in FIGS. 11A and 11B, the door hook 60 includes a buckle 59 for adjusting the length of the second strap 56 according to user preference and fastening type and location. In the first embodiment, the door hook is L-shaped. The door hook 60 also comprises protective pads on the inside thereof to protect the door from scratches and the like. In the first embodiment, pads 62*a*, 62*b*, 62*c* are located on the shank, saddle and tip or end of the door hook 60 to protect the front, back and end of the door about which the door hook 60 is secured. The pads 62*a*, 62*b*, 62*c* may be formed from foam or other cushioning materials. The pad 62*a*, 62*b*, 62*c* may be formed from adhesive-backed pads (e.g., adhesive-backed neoprene pads) attached to the door hook 60. Although the buckle 59 is part of the door hook 60 in the first embodiment, in other embodiments the buckle may be separate from the door hook 60.

The box 12 may also include a pair of wedge (or fin) panels 40 sewn, glued or otherwise affixed at or near the edges between the back panel 20 and the left side panel 16 and right side panel 18. The wedge panels 40 are trapezoidal in shape in the first embodiment but may have a different shape in other embodiments. The wedge panels 40 may have a construction the same as or similar to the flap panels 25, 27 and flap 29.

The bottom of the wedge panels 40 are located on the box 12 more than 12" from the bottom of the box 12 so that the wedge panels 40 do not interfere with the door hinges, the top of which is commonly 12" above the floor. The bottom of the wedge panels 40 are typically located on the box 12 so that the bottom of the wedge panels 40 is ½" to 2" above the top of where standard door hinges are located. In other words, the bottom of the wedge panels 40 are located approximately 12½ to 14" from the bottom of the box 12. The wedge panels 40 are 6" wide at the base thereof in the first embodiment.

The wedge panels 40 are intended to be secured between a door and door frame so that, in cooperation with the fastening mechanism 52 including the door hook 60 on the two-part strap, may be used to secure the collapsible security container to the edge of the door. Only one wedge panel 40 is used in combination with the door hook 60, the wedge panel 40 near the door hinges while the door hook 60 is secured about the free end of the door opposite to the door hinges. A pair of HNL fastener strips 41 and 42 for each wedge panel 40, one HNL fastener strip 41 located on an inward facing side of the wedge panel 40 and the other HNL fastener strip 42 located on the back panel 20 at a corresponding position for engagement with the HNL fastener strip 41. The HNL fastener strip 41 on the wedge panels 40 is one of a linear fabric strip of hooks and a linear fabric strip of loops, whereas the HNL fastener strip 42 on the back panel 20 is the other of a linear fabric strip of hooks and a linear fabric strip of loops.

Figure 12A:
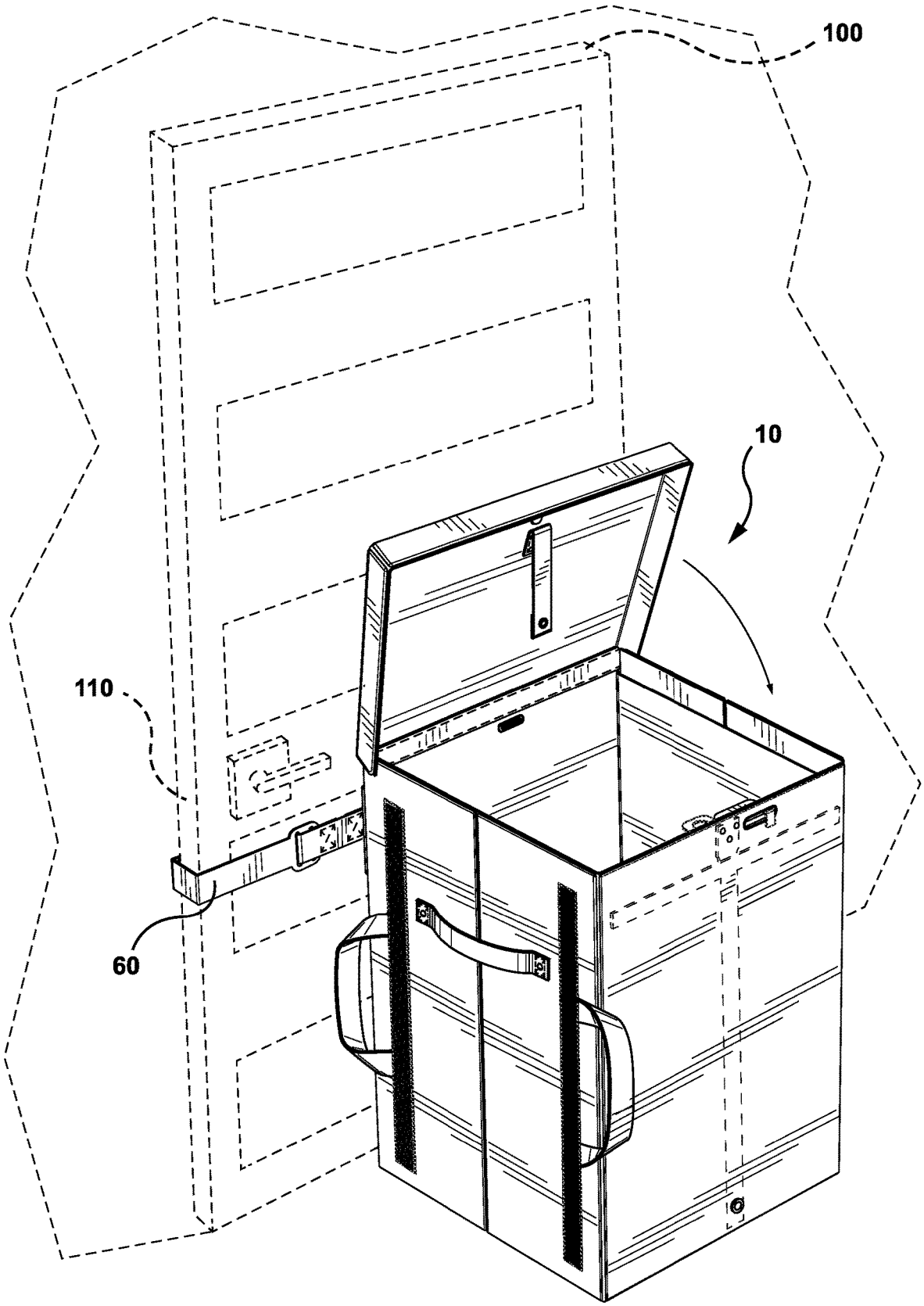
FIG. 12A is a front, left perspective view of the collapsible security container of FIG. 1 with the hinged-lid in an open position and secured to a door.
Figure 12B:
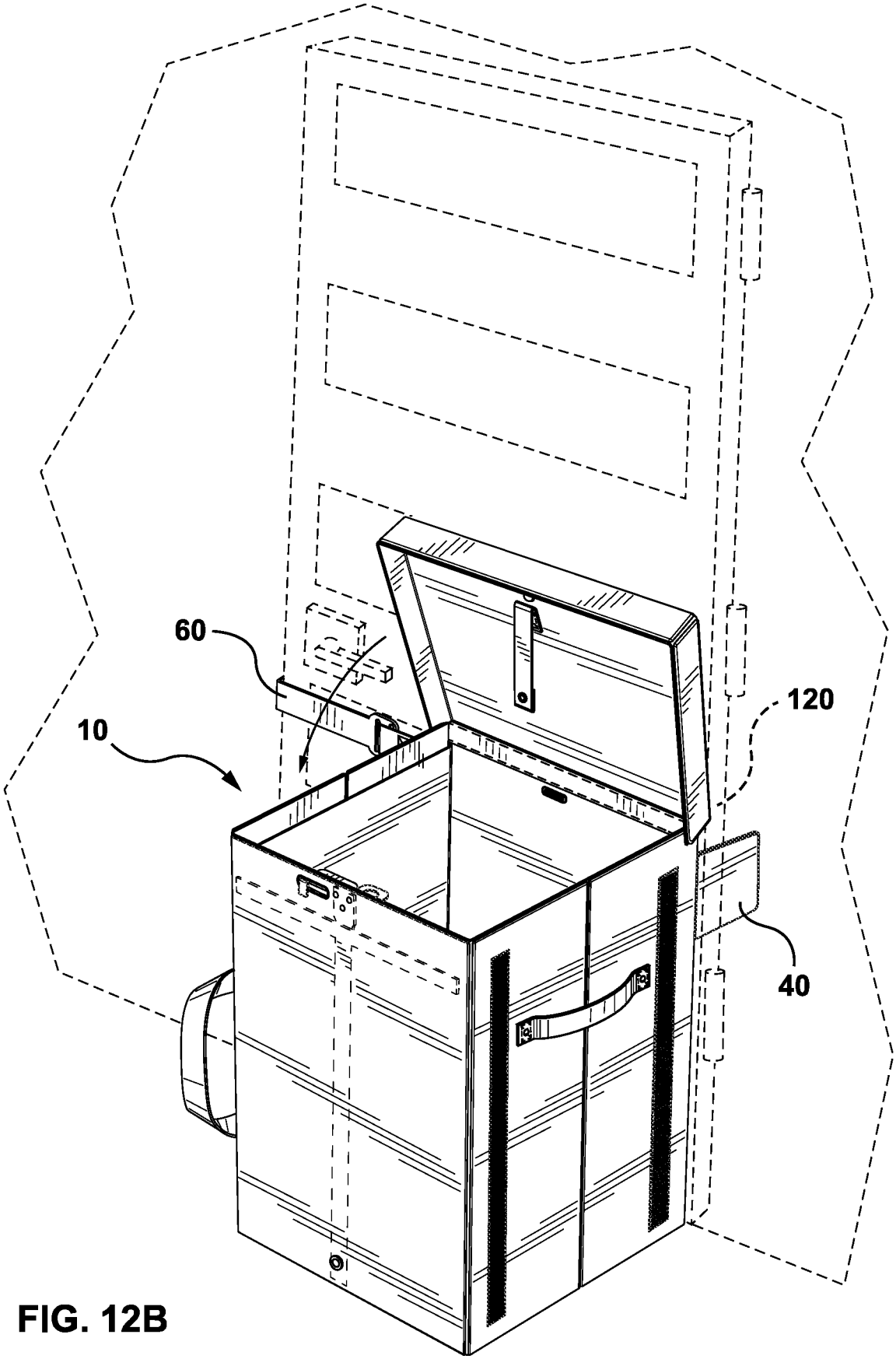
FIG. 12B is a front, right perspective view of the collapsible security container of FIG. 1 with the hinged-lid in an open position and secured to a door.
Figure 13:
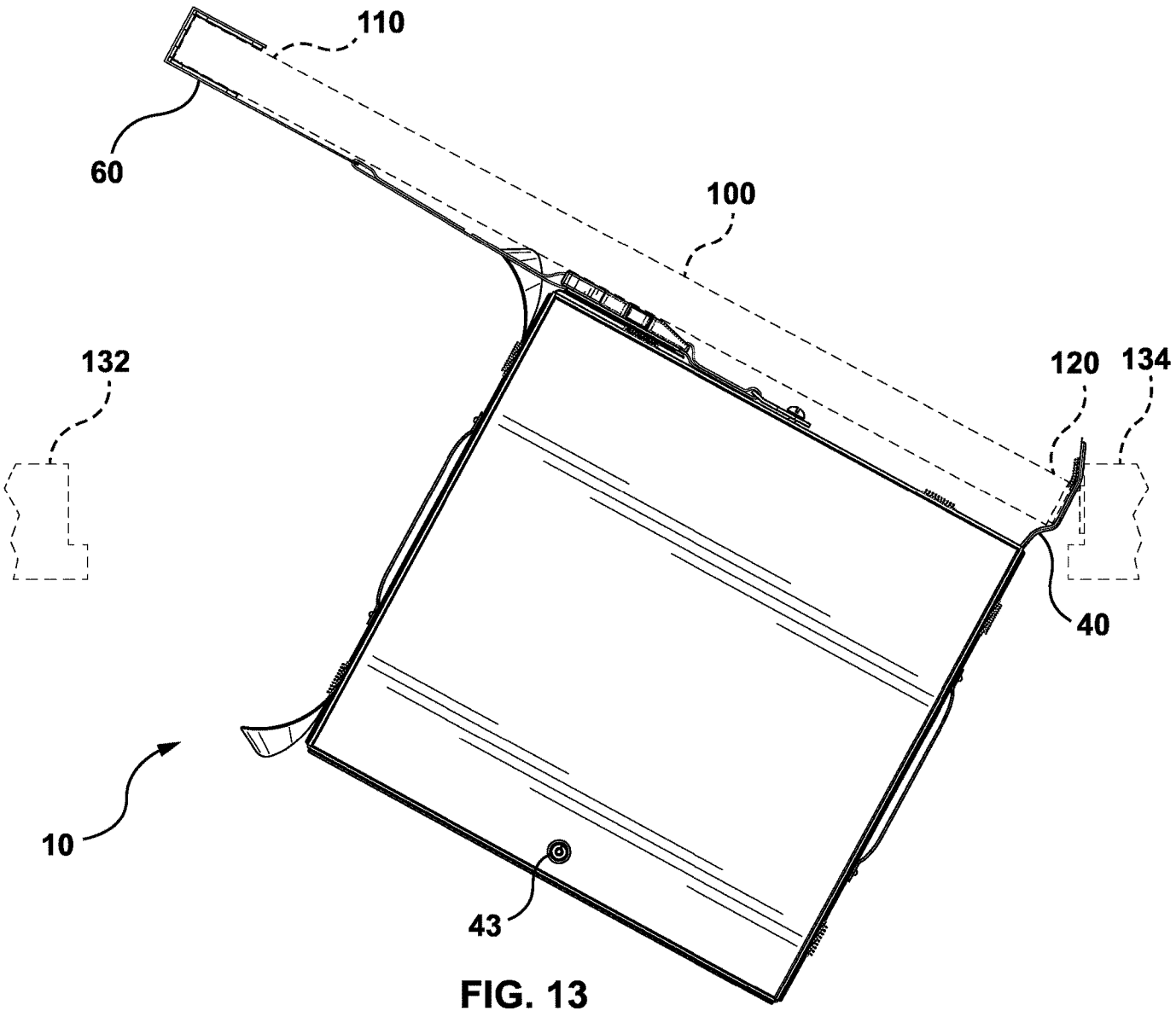
FIG. 13 is a top view of the collapsible security container of FIG. 1 with the hinged-lid in a closed position and secured to a door with the door partially open.
Figure 14:
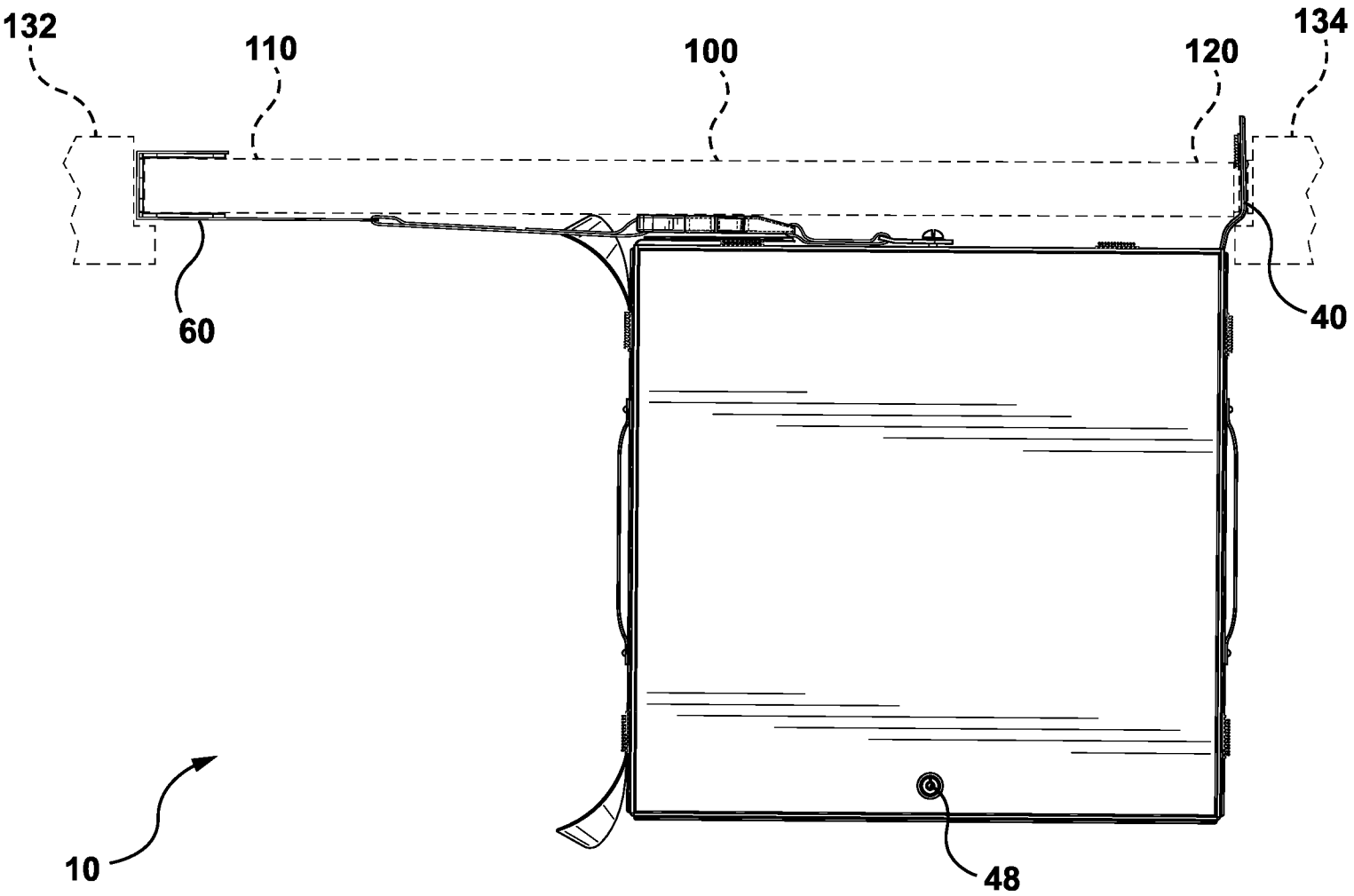
FIG. 14 is a top view of the collapsible security container of FIG. 1 with the hinged-lid in a closed position and secured to a door with the door closed.

Referring to FIG. 12A to FIG. 14, the securement of the security container 10 to a door 100 will be described. FIG. 12A illustrates a front, left perspective view of the security container 10 with the hinged-lid 22 in an open position and secured to the free end 110 of the door 100 by way of the door hook 60. FIG. 12B is a front, right perspective view of the security container 10 showing a wedge panel 40 received between the hinge end 120 of the door 100 and the door frame. FIG. 13 is a top view of the security container 10 with the hinged-lid 22 in a closed position and secured to the door 100 with the door 100 partially open. FIG. 14 is a top view of the security container 10 with the hinged-lid 22 in a closed position and secured to the door 100 with the door 100 closed. The door hook 60 is secured between the free end 100 of the door 100 and the left side door frame 132 whereas the wedge panel 40 is secured between the hinge end 120 of the door 110 and the right side door frame 134. The buckle 59 of the strap may be used to tighten the strap and the security container 10 to the door 100 when secured thereto. This makes the security container 10 more difficult to move and tamper with the security container 10.

Figure 10A:
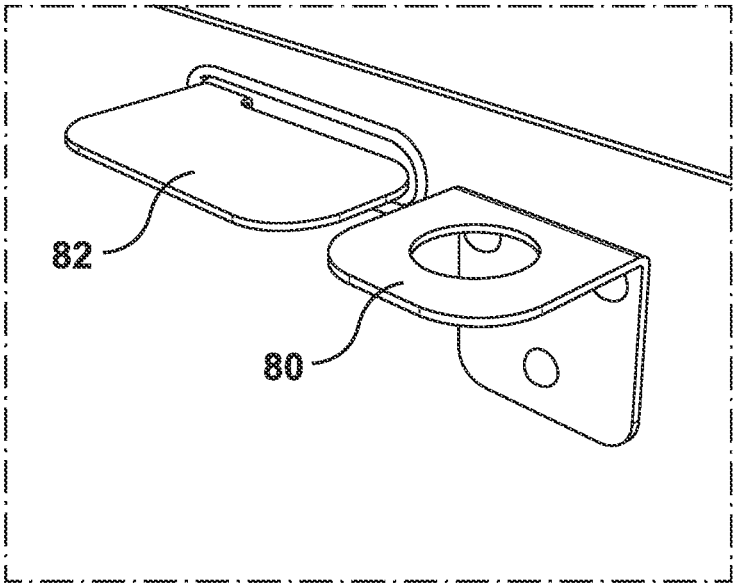
FIG. 10A-10E illustrate components of a locking mechanism of the collapsible security container of FIG. 1 with the hinged-lid in an open position.
Figure 10B:
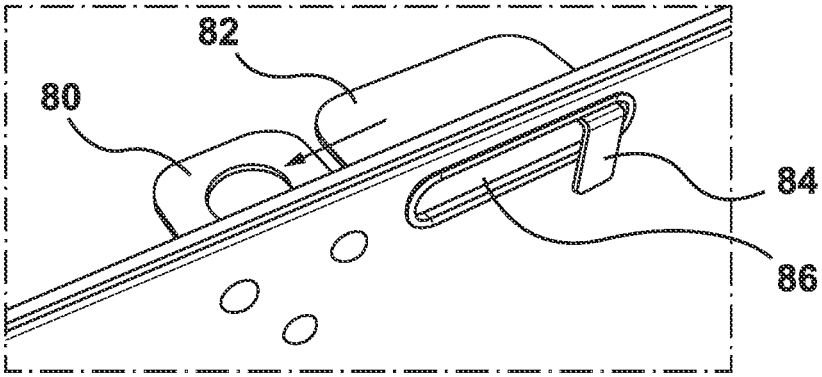
Figure 10C:
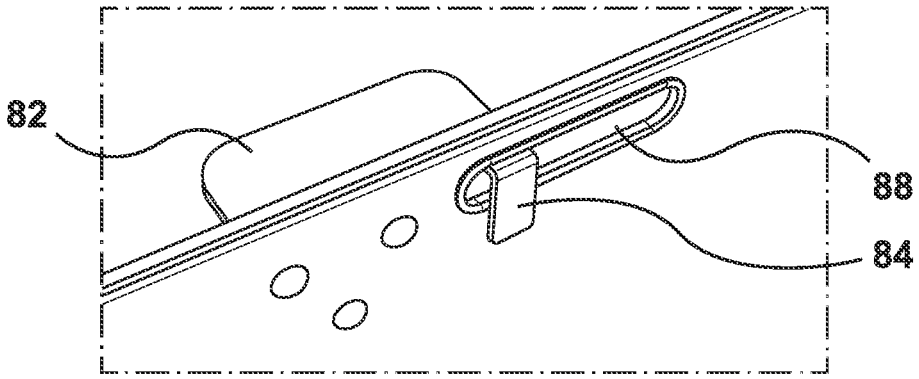
Figure 10D:
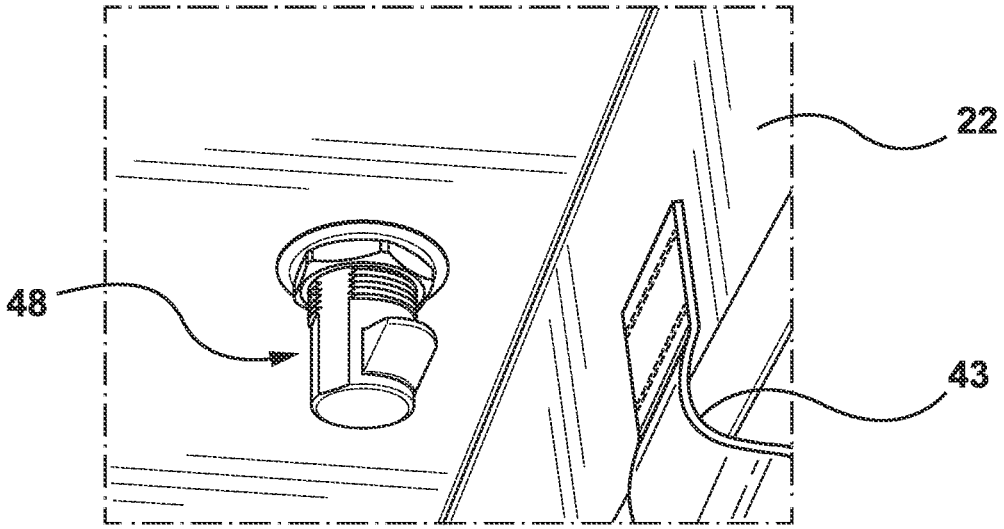
Figure 10E:
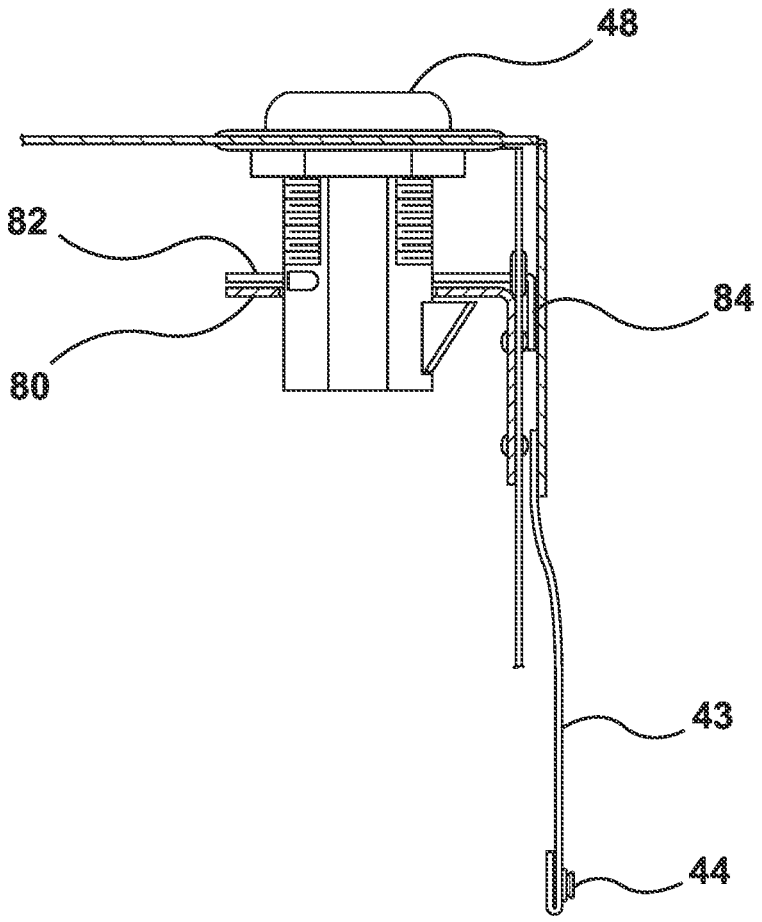

Referring now to FIG. 10A-10E, the locking mechanism of the security container 10 will be described in more detail. FIG. 1 with the hinged-lid in an open position. The locking mechanism comprises a slam lock 48 located in the top panel 21 of the hinged-lid 22 having a spring-loaded latch that automatically catches a receiver 80 located on the inside of the box 12 when the hinged-lid 22 is closed. The slam lock 48 may comprise a tubular pin tumbler lock (also known as a circle pin tumbler lock, radial lock, or Ace™ lock), a cylinder lock, or other suitable type of lock. A keyway (e.g., key cylinder) of the slam lock 48 for receiving a lock key is exposed in an outward facing side of the top panel 21 and the spring-loaded latch is exposed in an inward facing side of the top panel 21. As best shown in FIG. 10A, the receiver 80 defines opening through which the spring-loaded latch passes when the hinged-lid 22 is closed, engaging the receiver 80 when the spring-loaded latch has passed through the opening. Once closed, the slam lock 48 can be unlocked by a mated key. The receiver 80 is formed of a suitable, such as a steel. The receiver 80 may be formed from an angled (90 degree) bracket having a generally horizontally extending portion in which the opening in the receiver 80 is defined and a generally vertically extending portion. Referring to FIG. 1, the receiver 80 may be attached to a support structure 92 comprising a vertical support member 94 extending generally vertically between the top and bottom edges of the front panel 14, and a horizontal support member 96 extending generally horizontally between the left and right bottom edges of the front panel 14. The support structure 92 may from a general T-shape with the horizontal support member 96 at or near the top edge of the support structure 92 proximate to the top edge of the front panel 14 of the box 12. The receiver 80 may be integrally formed with the support structure 92. The support structure 92 may be located within the fabric layers of the front panel 14. Similarly, the receiver 80 may be partially located within the fabric layers of the front panel 14 with the exception of the generally horizontally extending portion in which the opening in the receiver 80 is defined, so that the opening for engaged by the hatch of the slam lock is suitably exposed.

A lock prevention slider 82 may be provided to prevent the hinged-lid 22 from accidentally closing and locking. The lock prevention slider 82 includes a lever 84 that a user can use to move the lock prevention slider 82 between an open or free state shown in FIG. 10B and a locked-out state shown in FIG. 10C. In the open state, the opening in the receiver 80 is exposed and ready for engagement by the latch of the slam lock 48. In the locked-out state, the opening in the receiver 80 is covered and unavailable for engagement by the latch of the slam lock 48. A lock indicator 88 may show the state of the locking mechanism—either open or locked-out. As the lock prevention slider 82 is moved, different colors are exposed, indicating the state of the locking mechanism. For example, the lock indicator 88 in the open state with the receiver 80 open may be red and the lock indicator 88 in the locked-out state with the receiver 80 closed may be green.

As shown in FIG. 2, the back panel 20 may include a receiver slot 90 providing an opening for accepting or receiving the receiver 80 when the security container 10 is collapsed. In other embodiments, the receiver slot 90 is large enough to accept both the receiver 80 and the lock prevention slider 82 in one or both of the open or locked-out state. Alternatively, the top edge of the rigid insert in the back panel 20 may be curved or scalloped to define a recess for receiving the receiver 80 and the lock prevention slider 82. Alternatively, the lock prevention slider 82 may be omitted.

The security container 10 comprises a handles or hand straps for used when the security container 10 is collapsed and uncollapsed (expanded). A set of handles (or hand straps) 30 are attached to the left side panel 16 and right side panel 18, extending between the respective first portions 16*a*, 18*a* and second portions 16*b*, 18*b* thereof. The handles 30 are intended for use when the security container 10 is uncollapsed (expanded). A set of secondary handles (or hand straps) 34L, 34R are attached to the left side panel 16, with the secondary handle 34L located in the first portion 16*a* of the left side panel 16 towards the edge thereof just outside the strip of HNL fastener 32, and the secondary handle 34R located in the second portion 16*b* of the left side panel 16 towards the edge thereof just outside the strip of HNL fastener 32. In other embodiments, the secondary handles 34L, 34R may be located at an equivalent position on the right side panel 18.

Figure 15:
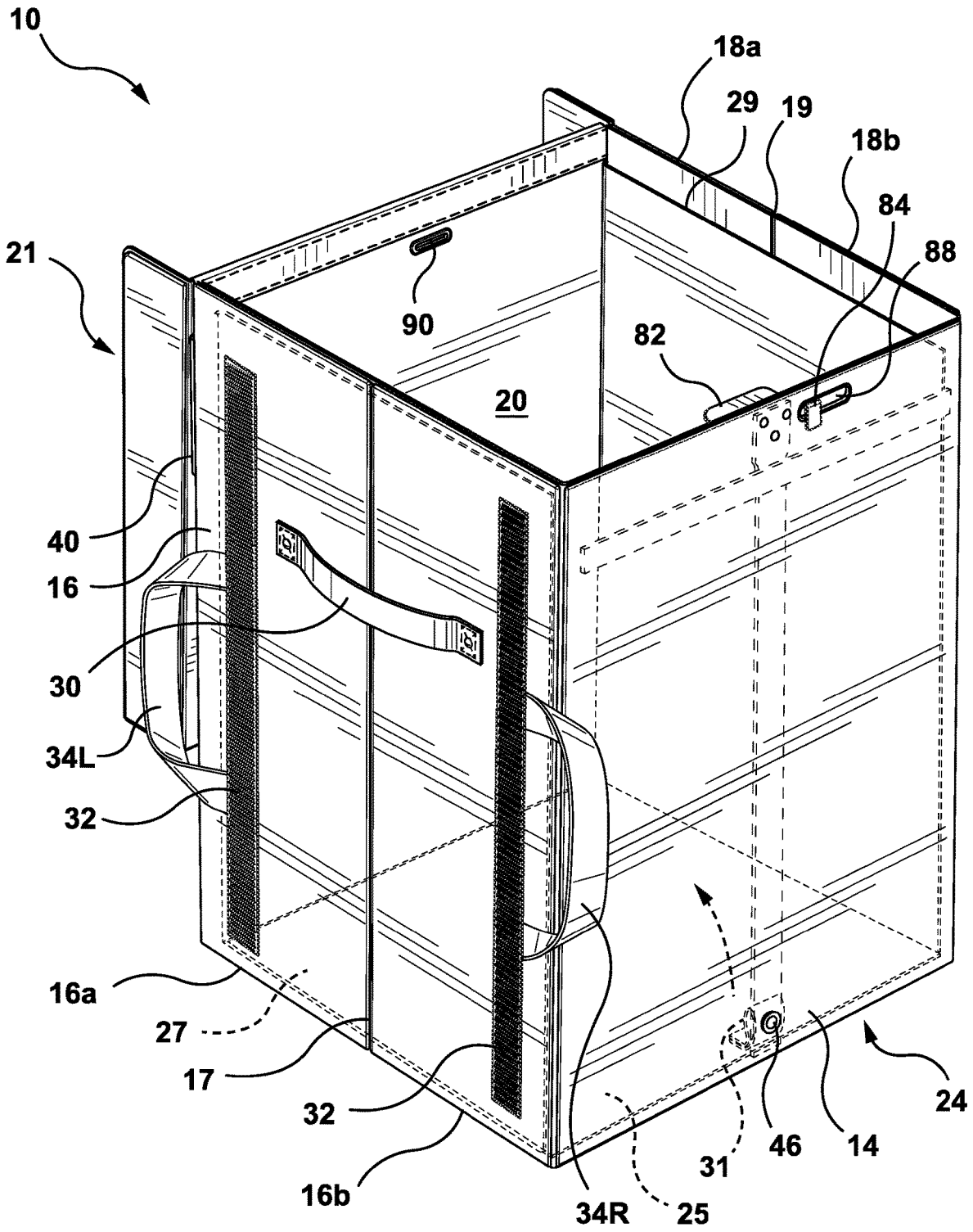
Figure 16A:
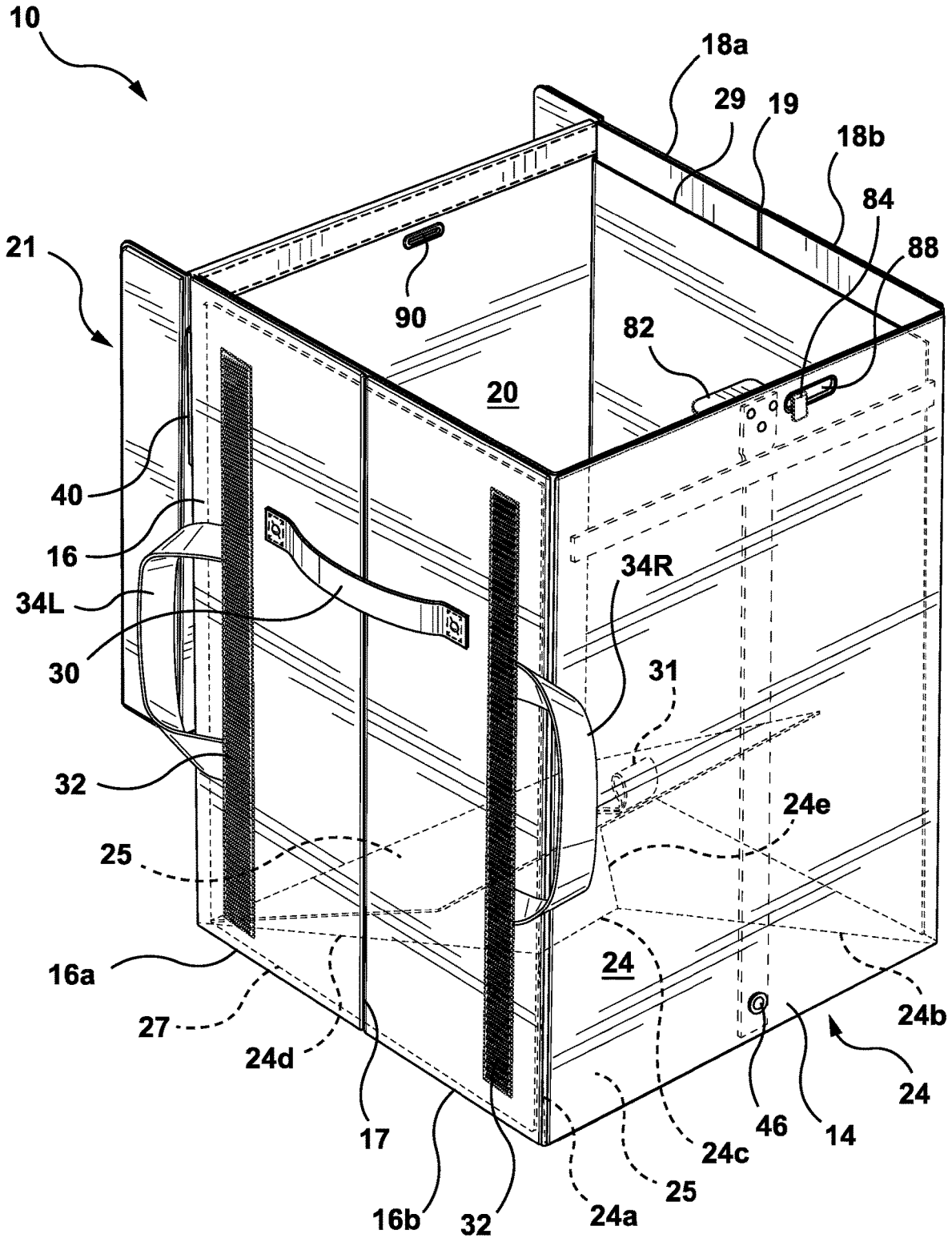
FIG. 16A is a front perspective view of the collapsible security container with the bottom flap panel being lifted.
Figure 16B:
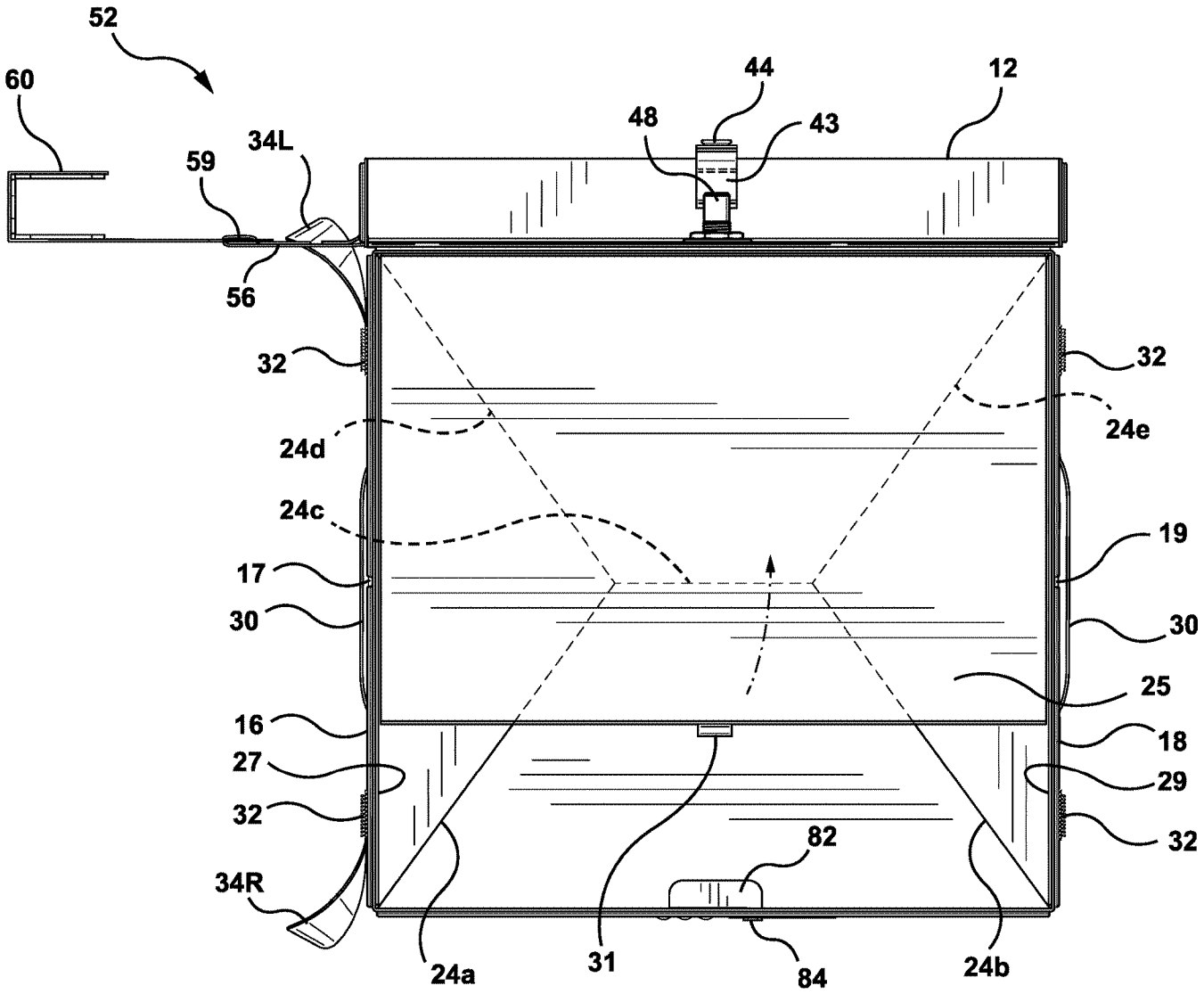
FIG. 16B is a top view of the collapsible security container with the bottom flap panel being lifted.
Figure 17A:
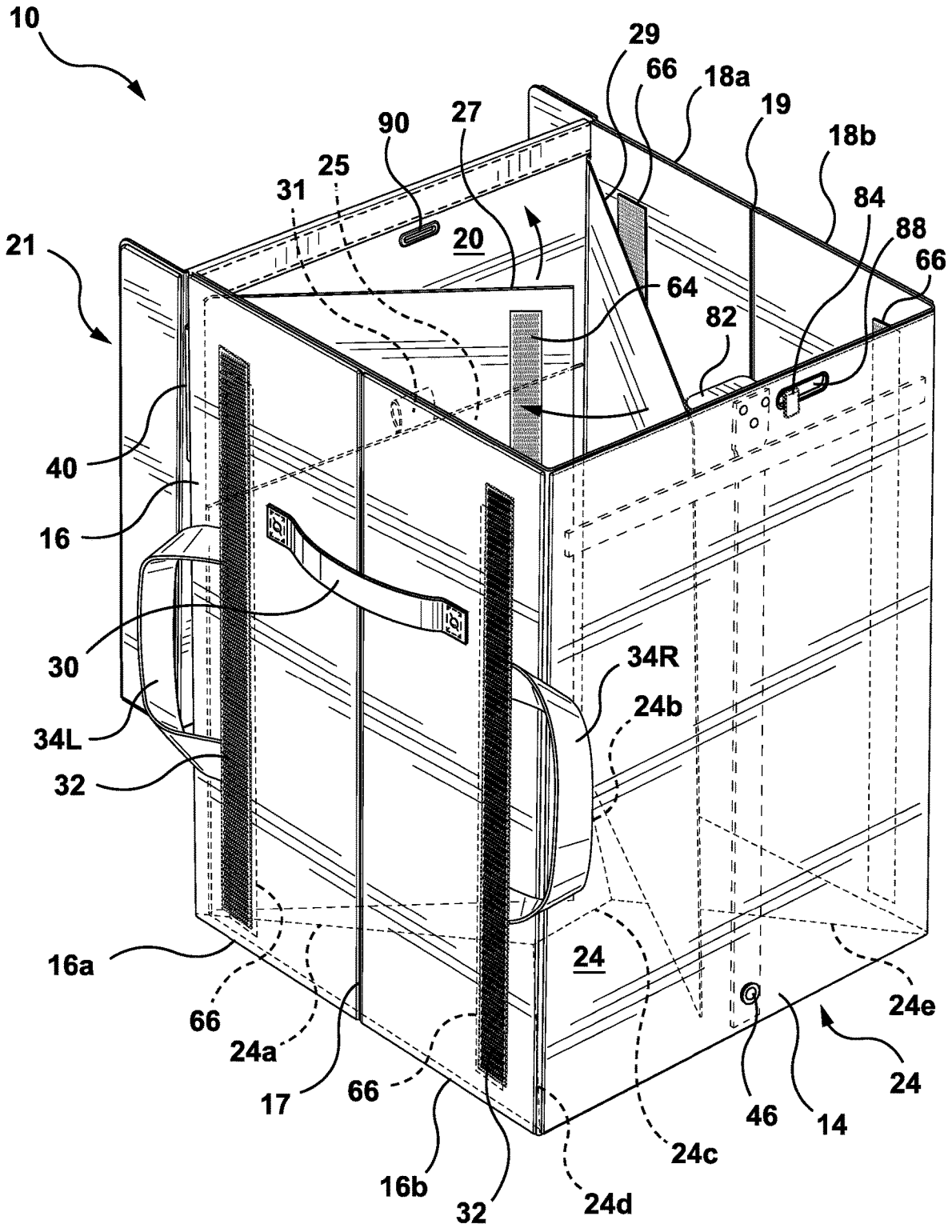
FIG. 17A is a front perspective view of the collapsible security container with the side flap panels being folded.
Figure 17B:
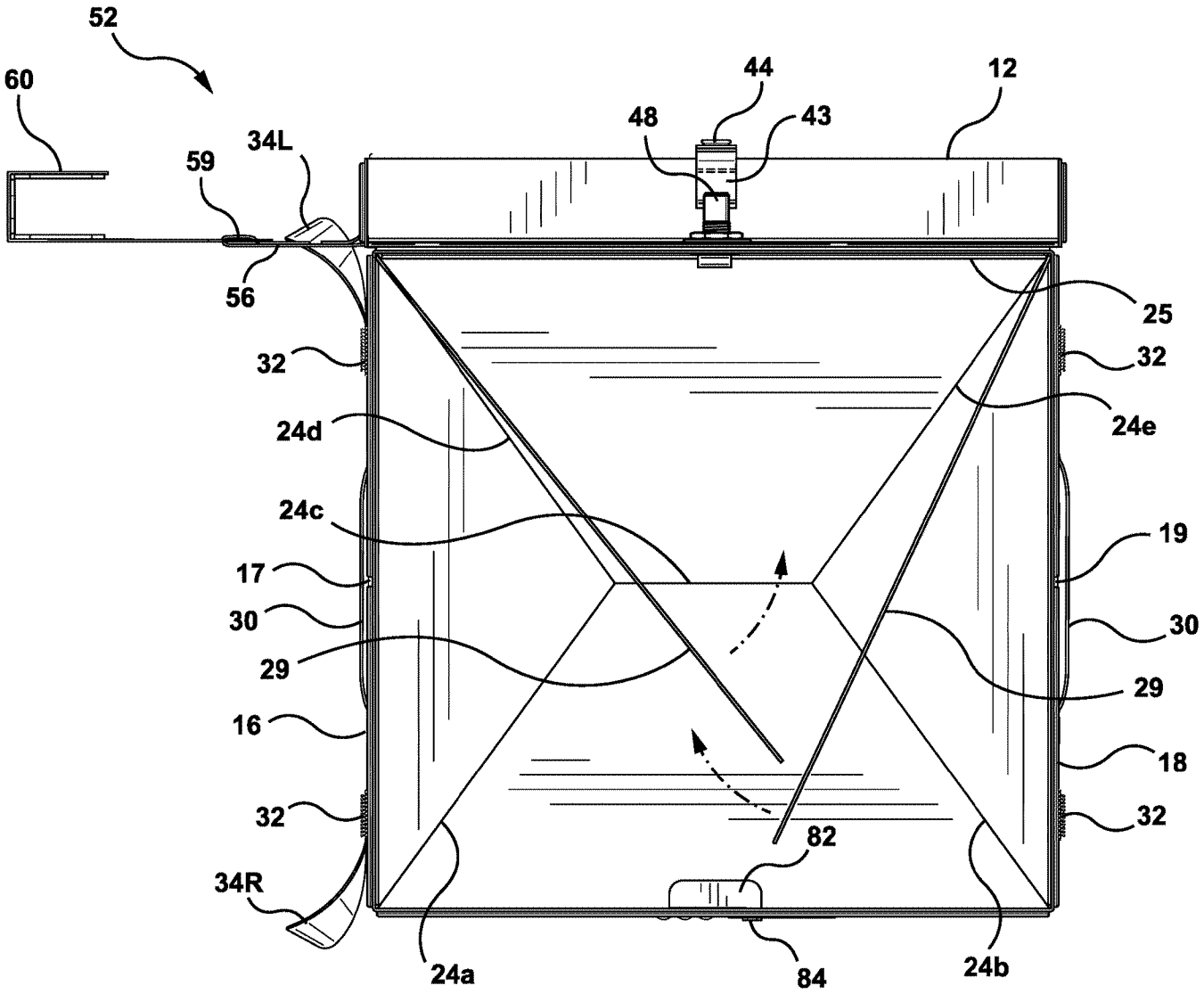
FIG. 17B is a top view of the collapsible security container with the side flap panels being folded inwards.
Figure 18:
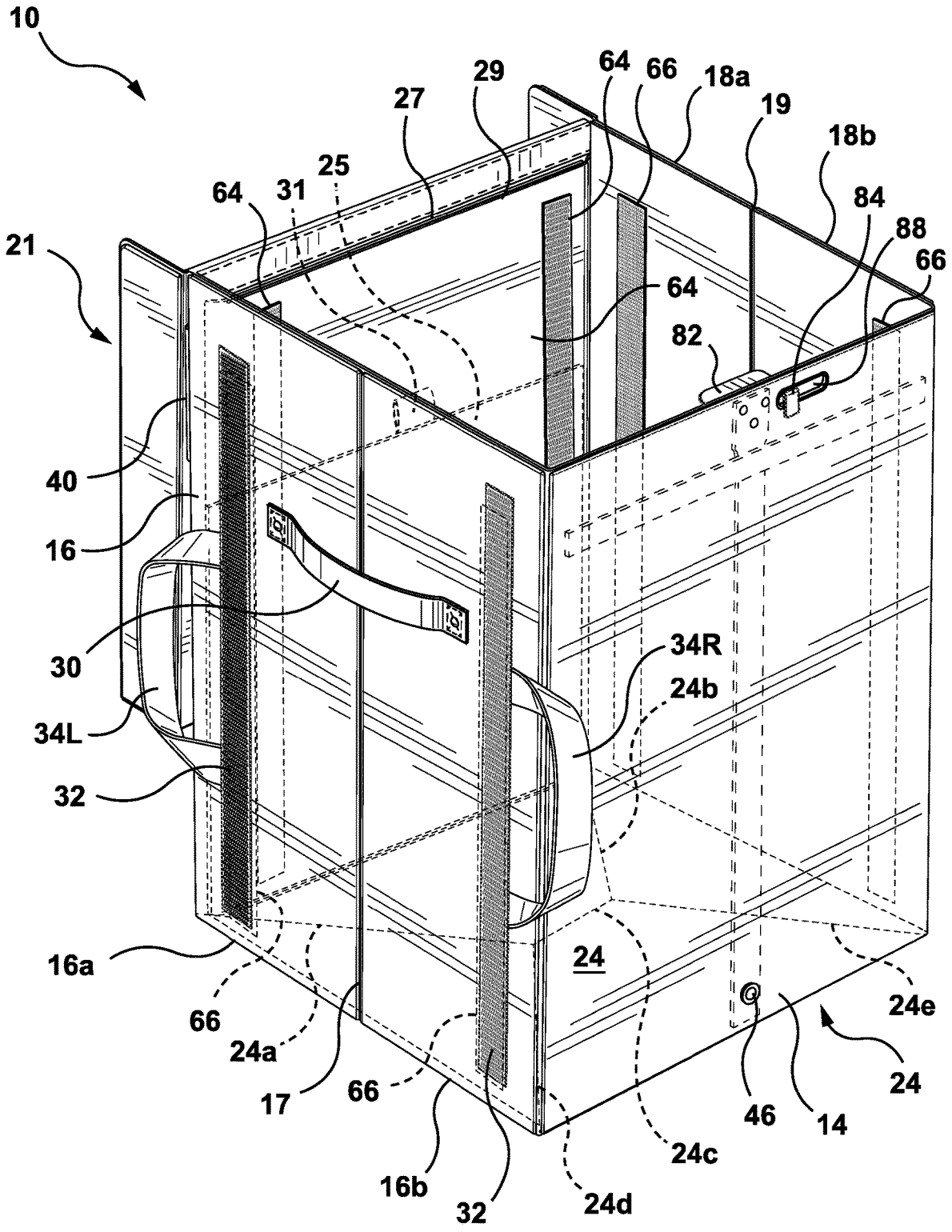
Figure 19:
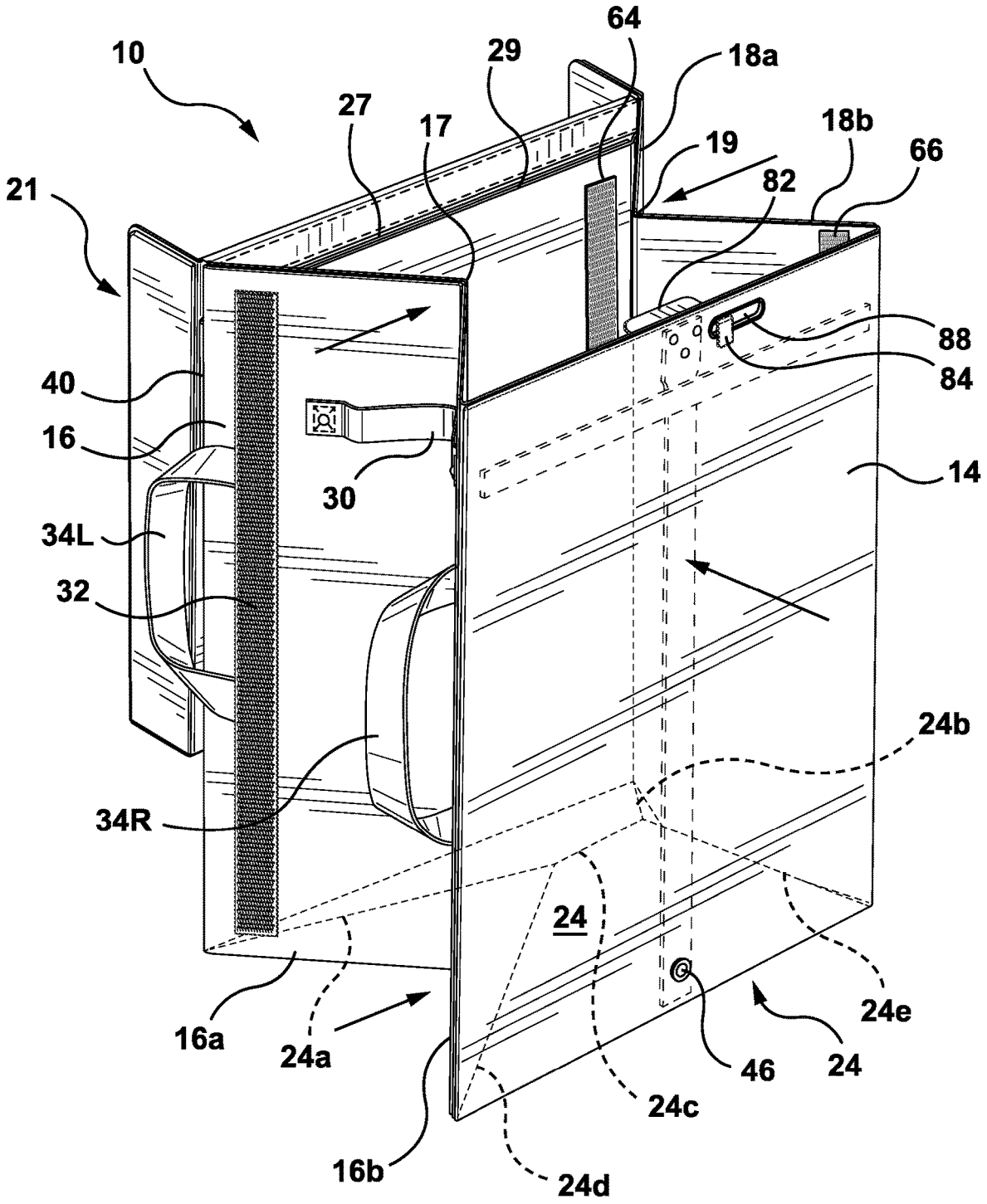
Figure 20:
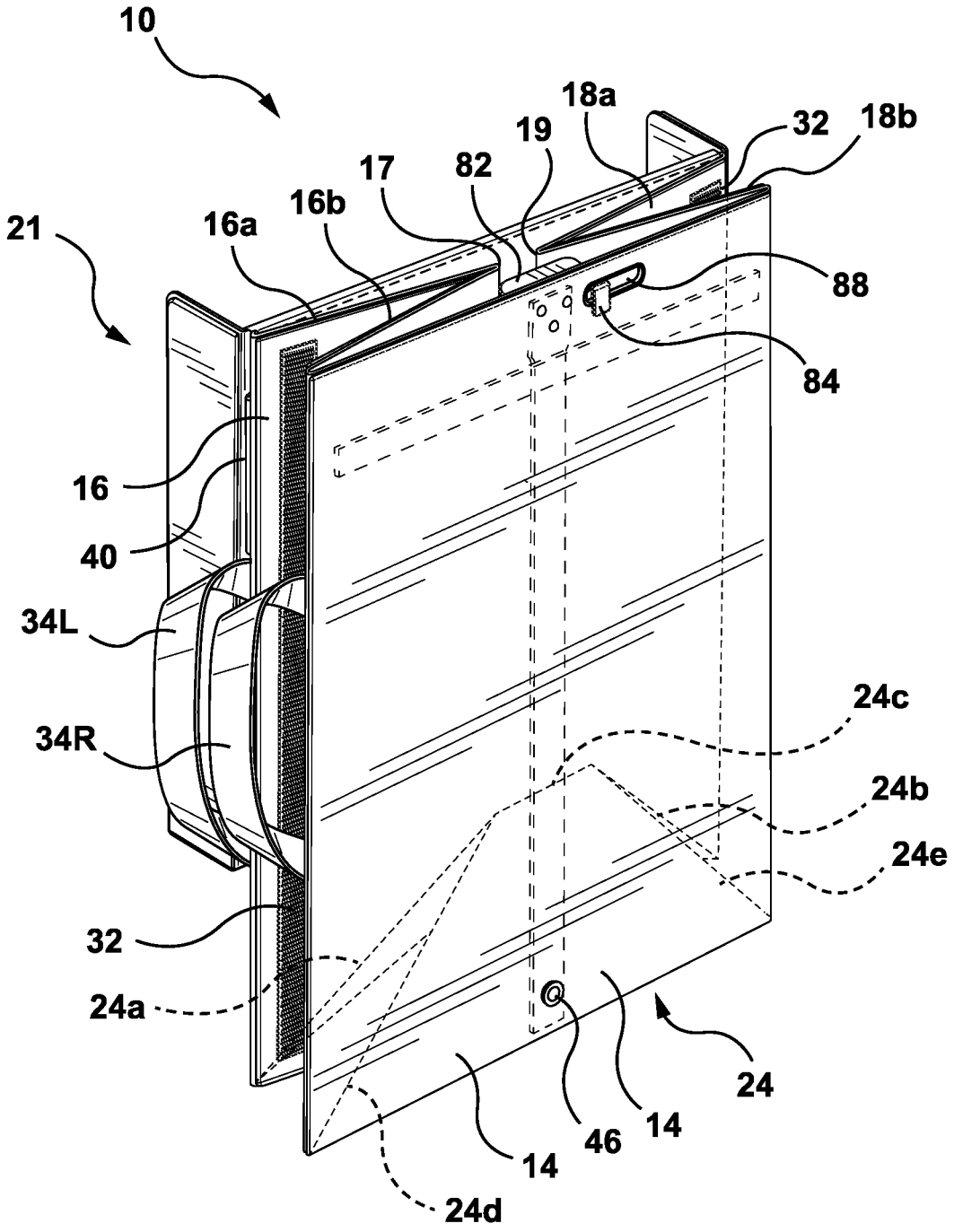
Figure 21:
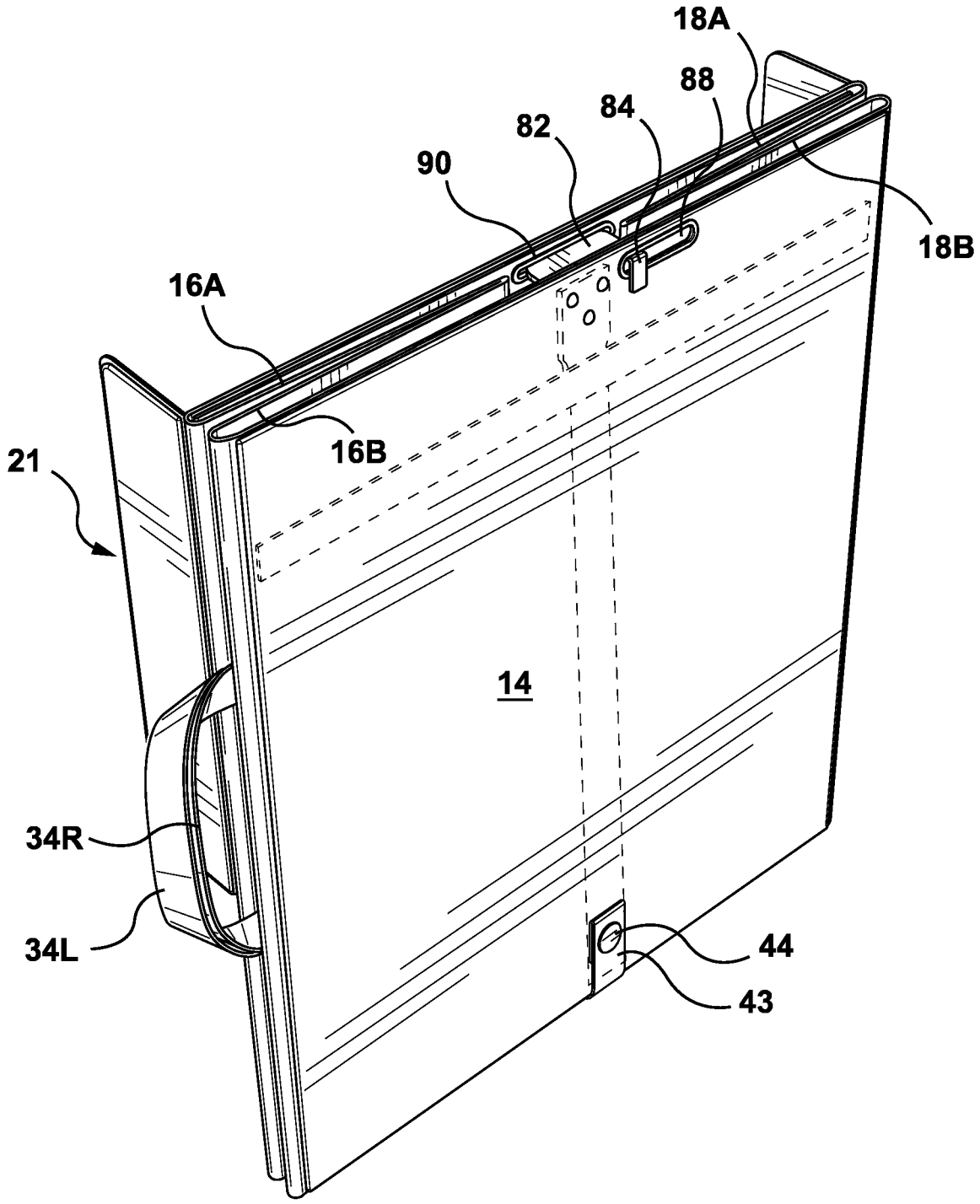

Referring now to FIGS. 15-21, the transformation of the security container from a fully open position to a fully closed position during the collapse of the security container 10 will be described. In FIG. 15, the hinged-lid 22 is folded back so that the hinged-lid 22 is substantially parallel to the back panel 20. In FIGS. 16A and 16B, the bottom flap panel 25 is lifted by the user by pulling on the hand strap 31. The hand strap 31 makes it easier for the user to interact with the bottom flap panel 25 when the security container 10 which may be relatively tall and the bottom flap panel 25 located relatively deep for some users. When the bottom flap panel 25 is fully retracted, it is substantially parallel to the back panel 20 with the hand strap 31 facing upwards. In FIGS. 17A and 17B, after the bottom flap panel 25 is fully retracted, the left flap panel 27 and right flap panel 29 are retracted by the user by pulling on the top of the flap panels 27, 29. The user must pull sufficiently hard to overcome the attachment of the HNL fasteners 64, 66 securing the flap panels 27, 29 to the left side panel 16 and right side panel 18. FIG. 18 shows the left flap panel 27 and right flap panel 29 in the fully retracted position. In FIG. 19, with the flap panels 27, 29 in the fully retracted position, the box 12 may be collapsed by pushing inwardly on the front panel 14 and back panel 20, which causes the left side panel 16 and right side panel 18 to fold about the fold lines 17, 19. In FIG. 20, the box 12 is in the fully closed position (also known as fully collapsed position). In FIG. 21, the hinged-lid 22 is secured to the box 12 using the locking strap 43 by connecting the snap fitting 44 of the locking strap 43 to the snap fitting 46 on the front panel 14.

A four-sided temperature control sleeve (or pack) such as a cooler sleeve, hot sleeve, or hot and cold sleeve, or a set of temperature control panels sized and configured for the interior of the security container 10 may be provided or use therewith and removable inserted into the security container 10 on demand to keep the contents of the security container 10 warm or cold, as desired. The temperature control sleeve/panels comprise hard or soft case (or shell) containing a gel or liquid that may be activated for cooling or heating by freezing or heating in a microwave or the like by the user, as desired. A temperature control sleeve may also be provided for the hinged-lid 22 and/or bottom panel 24. The temperature control sleeve/panel may be received in a pocket or pouch located on the interior of the hinged-lid 22 and/or bottom panel 24. The temperature control sleeves/panels may be useful, for example, for receiving products requiring refrigeration, such as groceries, or products requiring heating or warming, such as delivered hot food. The temperature control sleeves/panels are particularly advantageous when the outer panels of the box 12 and the hinged-lid 22 are insulated.

Figure 22:
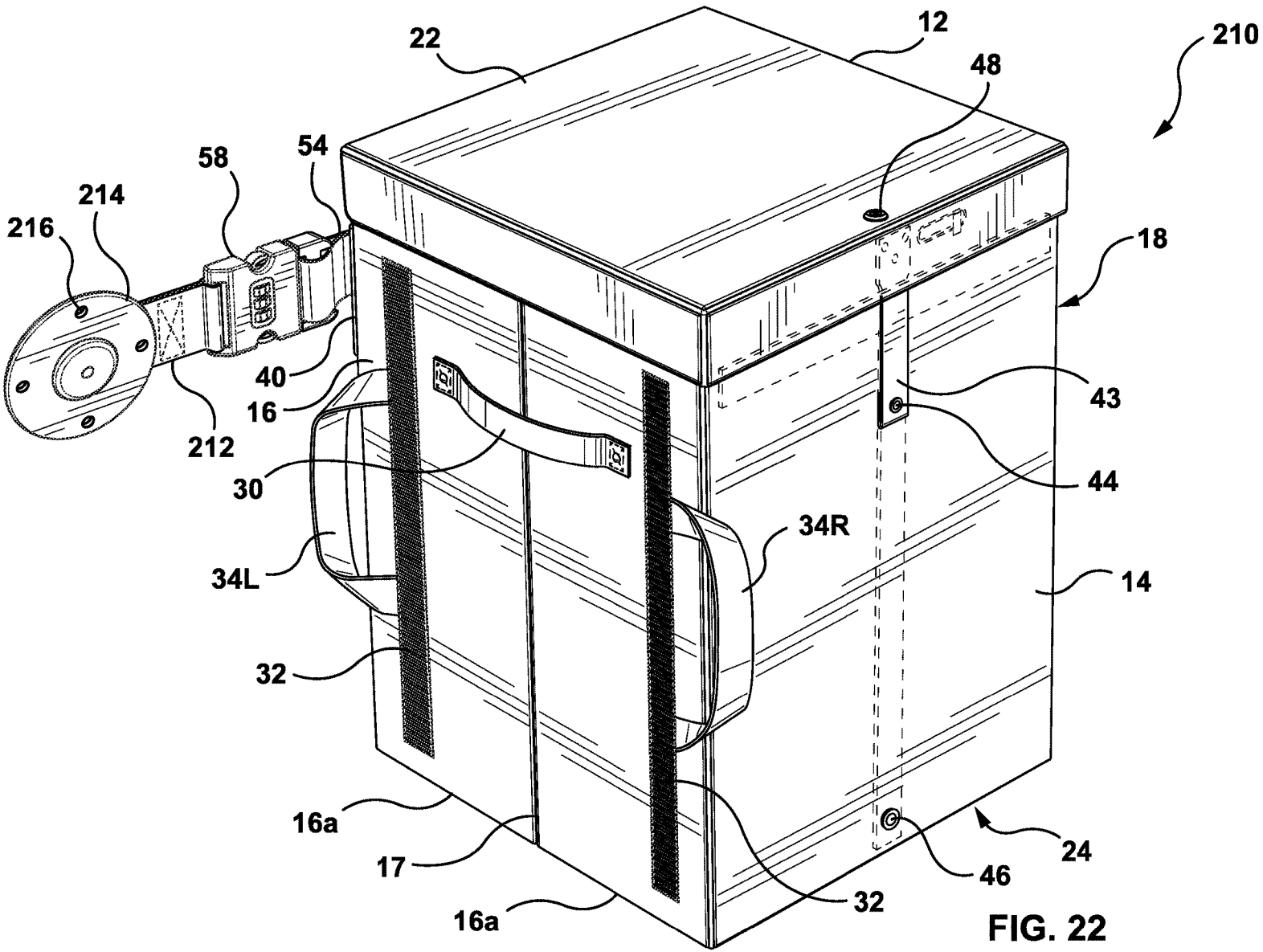
FIG. 22 is a front perspective view of a second embodiment of a collapsible security container in accordance with the present disclosure with the hinged-lid in a closed position.
Figure 23A:
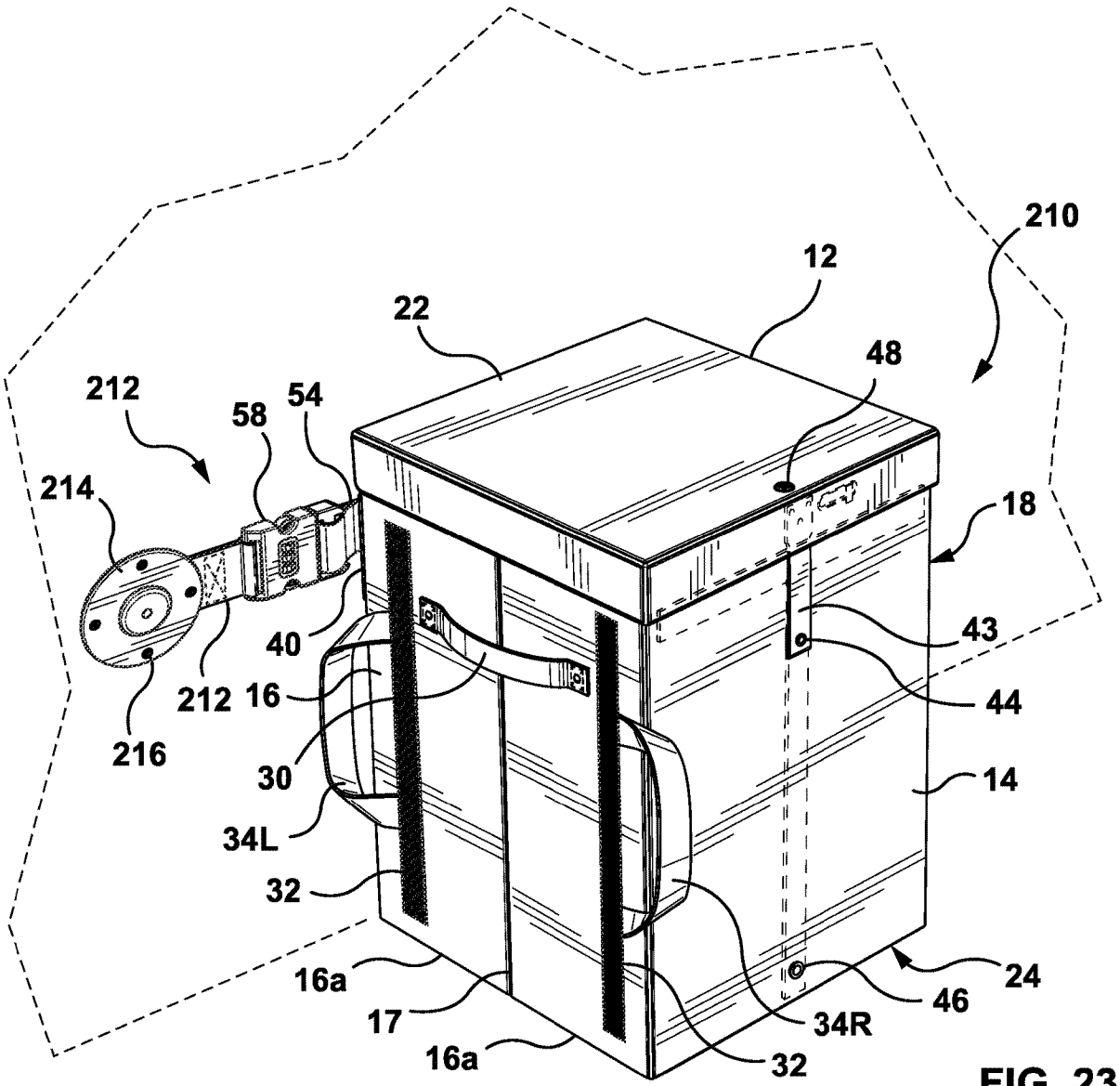
FIG. 23A is a front, left perspective view of the collapsible security container of FIG. 22 secured to a wall.
Figure 23B:
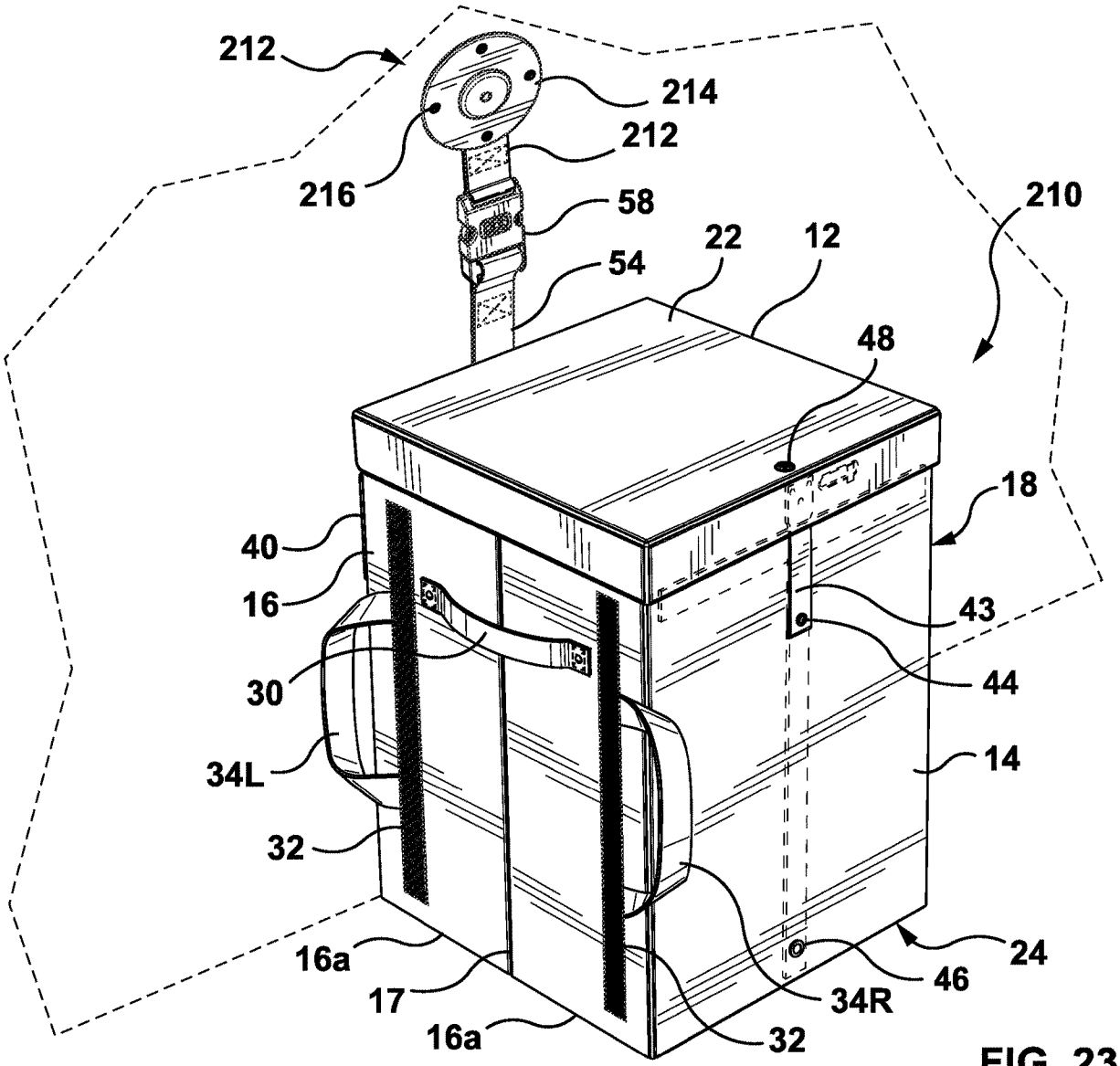
FIG. 23B is an alternative front, left perspective view of the collapsible security container of FIG. 22 secured to a wall.

FIGS. 22 to 23B illustrate a second embodiment of a collapsible security container 210 in accordance with the present disclosure. The second embodiment is like the first embodiment except that the second part of the two-part strap, denoted 212, is configured with a wall mounting plate 214 rather than the door hook 60. The wall mounting plate 214 includes a swivel (not shown) which connects to the strap 212 and allows at least 180 degrees of rotation, possibly 360 degrees of rotation, allowing the strap 212 to be repositioned by the user with ease. Although not shown, the second part of the two-part strap may include a buckle so that the length of the strap may be adjusted. The wall mounting plate 214 includes mounting holes 216 for mounting the wall mounting plate 214 to a wall using fasteners (not shown). To increase security, the fasteners may be security screws for which tools for removing are much less common and less readily available or anchor bolts which cannot be readily removed with a wrench or the like. The strap 212 with the wall mounting plate 214 may be used instead of the strap of the first embodiment with the door hook 60 when the securing amount the door is not possible, not convenient, not permitted, no door is present, or other reason. For example, the strap 212 with the wall mounting plate 214 may be used if the door in the door area or porch has a screen and securing the door hook 60 amount the door is not possible or not convenient.

FIG. 22 is a front perspective view of the security container 210 with the hinged-lid in a closed position. FIG. 23A is a front, left perspective view of the security container 210 of FIG. 22 secured to a wall with the wall mounting plate 214 located on one side of the security container 210. FIG. 23B is an alternative front, left perspective view of the security container 210 of FIG. 22 secured to a wall with the wall mounting plate 214 located above the security container 210.

Figure 24:
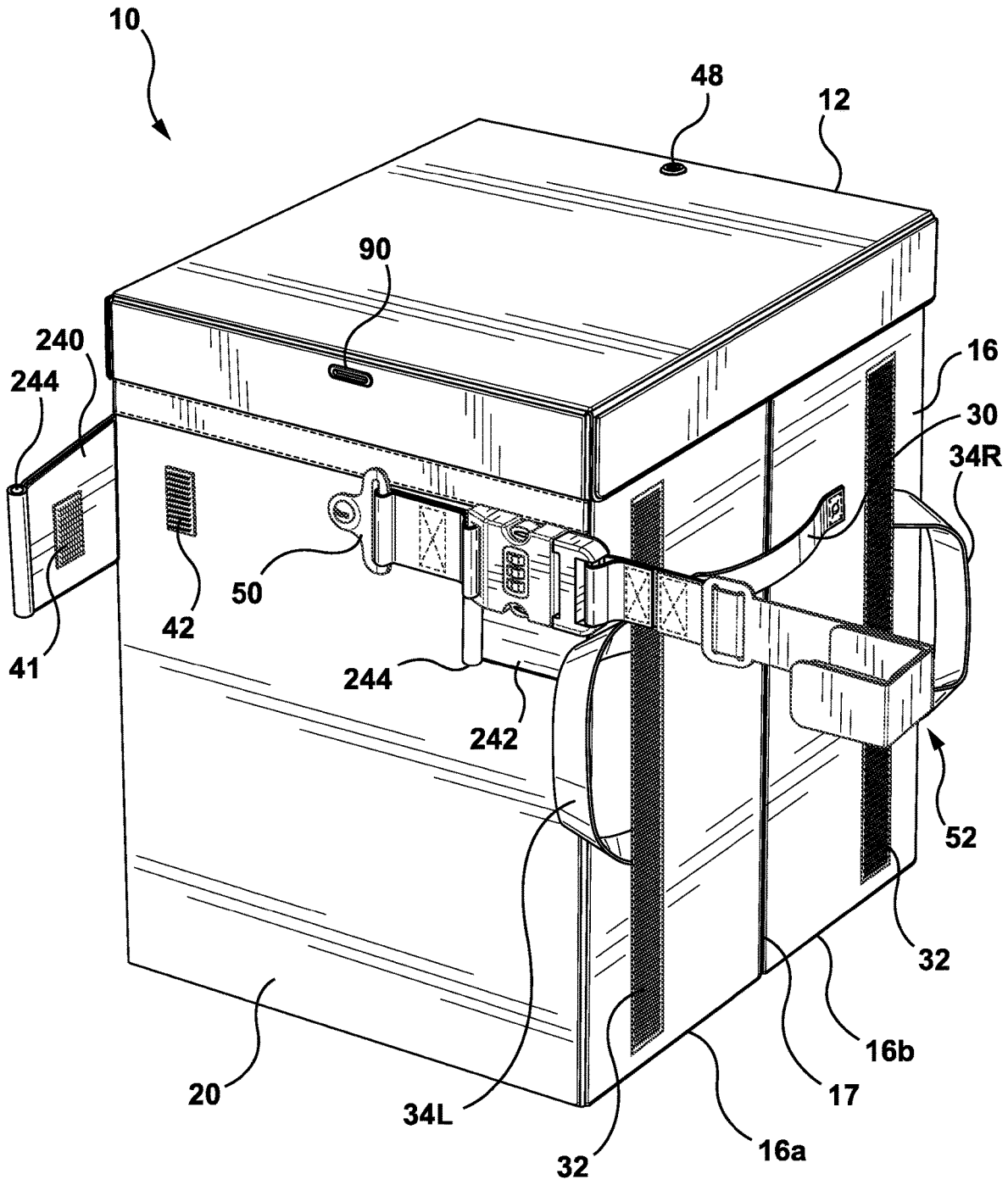
FIG. 24 is a front perspective view of a third embodiment of a collapsible security container in accordance with the present disclosure with the hinged-lid in a closed position.

FIG. 24 is a front perspective view of a third embodiment of a security container in accordance with the present disclosure with the hinged-lid 22 in a closed position. In the third embodiment, the security container 10 comprises wedge panels 240 having stoppers 244 at the distal end thereof to further restrict the movement of the wedge panels 240, making it more difficult to remove the wedge panels 240 from a door when secured thereabout. In the third embodiment, the stoppers 244 are cylindrical members (e.g., cylindrical rod) extending generally vertically and parallel to the wedge panels 240. In other embodiments, the stoppers 244 may have a different shape.

Figure 25:
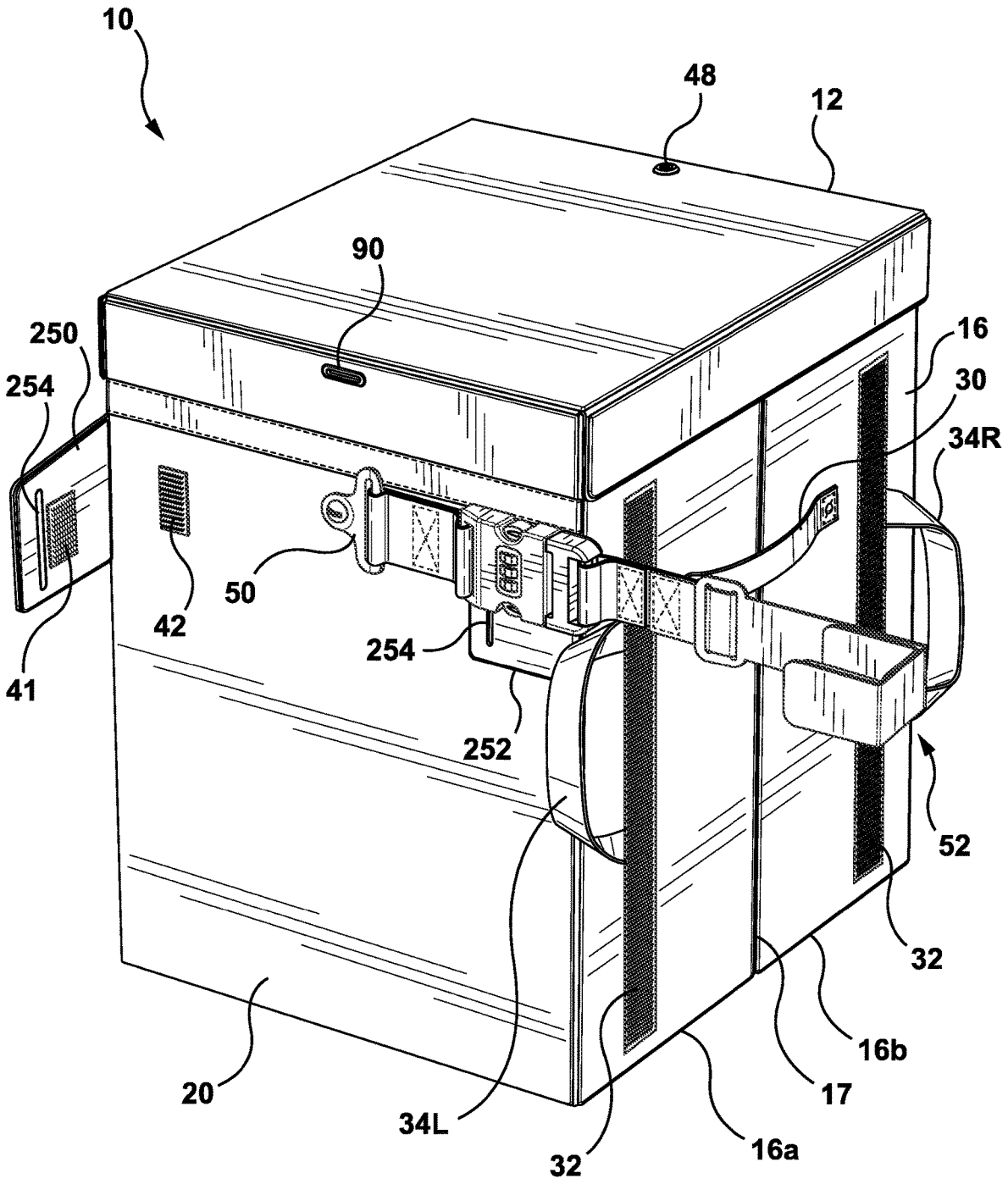
FIG. 25 is a front perspective view of a fourth embodiment of a collapsible security container in accordance with the present disclosure with the hinged-lid in a closed position.

FIG. 25 is a front perspective view of a fourth embodiment of a security container in accordance with the present disclosure with the hinged-lid 22 in a closed position. In the fourth embodiment, the security container 10 comprises wedge panels 250 having slots 254 near the distal end thereof. The slots 254 may be used to receive a securing strap from the inside of a door when secured thereof. The strap attached to a wedge panel 250 via the slot 254 may be attached to the wall via a wall mount plate 214 to further restricts the movement of the wedge panel 250, making it more difficult to remove the wedge panels 250 from a door when secured thereabout.

Figure 26:
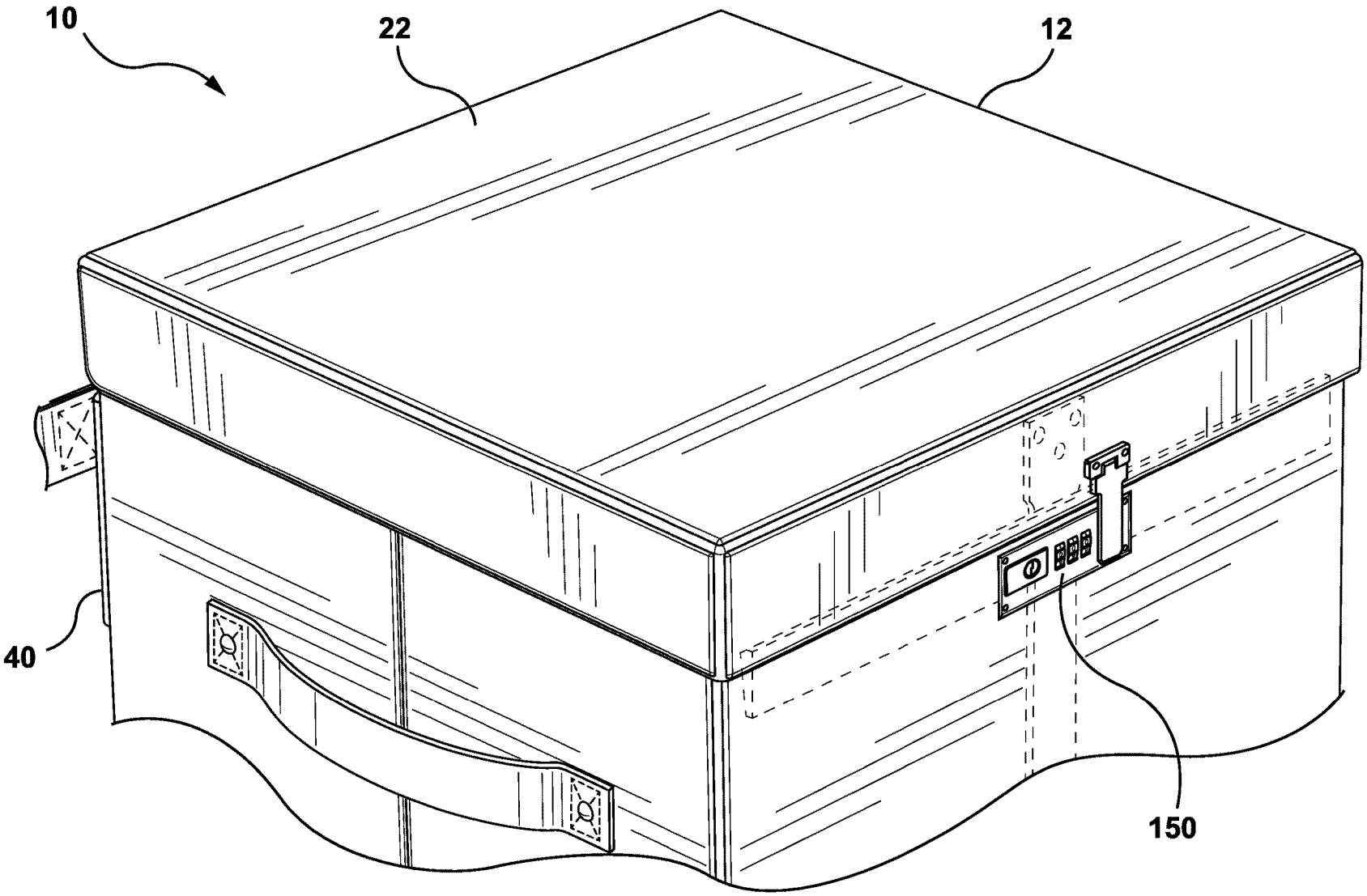
FIG. 26 is a front perspective view of a fifth embodiment of a collapsible security container in accordance with the present disclosure with the hinged-lid in a closed position.

The above-described embodiments use a slam lock 48 to secure the hinged-lid 22 to the box 12. In other embodiments, a lock other than a slam lock may be used. For example, a conventional keyed lock may be used. FIG. 26 is a front perspective view of a fifth embodiment of a security container in accordance with the present disclosure with the hinged-lid 22 in a closed position. In the fifth embodiment, a latch-based key and combination lock 150 is provided. The latch component is mounted in the multi-sided rim 23 of the hinged-lid 22 with the key and combination lock in the front panel 14 of the box 12. The fifth embodiment effectively incorporates a locking mechanism similar to that used in briefcases and the like.

Figure 27:
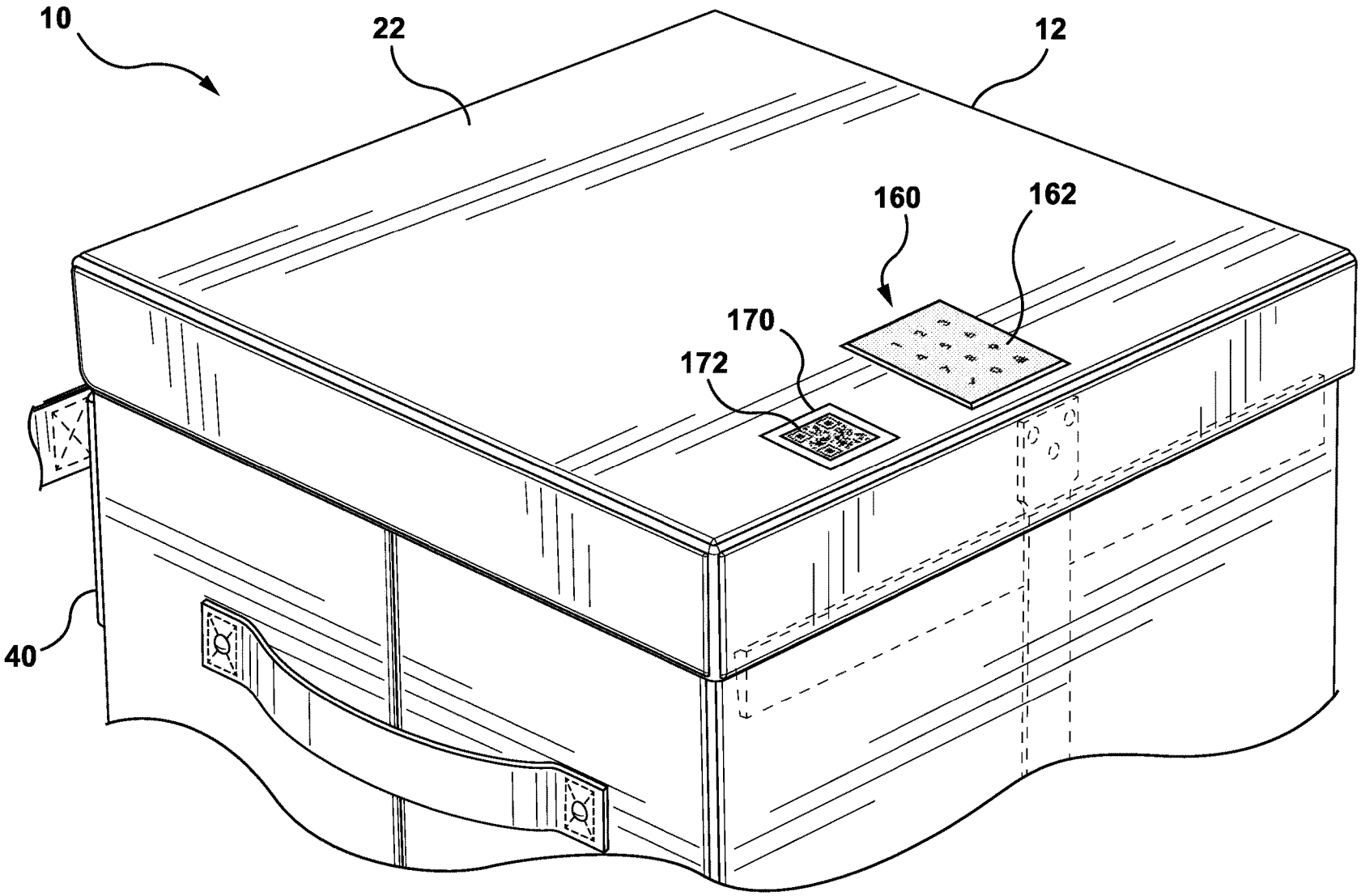
FIG. 27 is a front perspective view of a sixth embodiment of a collapsible security container in accordance with the present disclosure with the hinged-lid in a closed position.

FIG. 27 is a front perspective view of a sixth embodiment of a security container in accordance with the present disclosure with the hinged-lid 22 in a closed position. In the sixth embodiment, an electronic lock 160 is provided with a keypad 162 exposed in the top panel 21 of the hinged-lid 22. In other embodiments, the keypad 162 may be provided in the front panel 14 of the box 12. The mechanical components of the electronic lock 160 are not shown, however the mechanical components of the electronic lock 160 are located in the hinged-lid 22 and front panel 14 of the box 12. The electronic lock 160 may be an electronic slam lock incorporating a spring-loaded latch or the like. he keypad 162 provides a manual code entry interface for inputting a keycode or personal identification number (PIN). Other manual code entry interfaces may be provided in other embodiments, such as a touchscreen, microphone, etc. In other embodiments, the electronic lock 160 may be a keyed lock coupled with a physical electronic key such as a magnetic card or (radio frequency identification) RFID device. In yet other embodiments, the electronic lock 160 may provide both coded access and keyed access.

The security container 10 also comprises a smart tag 170 attached to an outer surface of the security container 10, such as an outer surface of the top panel 21. The smart tag 170 has a machine-readable bar code in the form of a QR code (Quick Response code) 172 provided thereon. Alternatively, a bar code or other machine-readable bar code may be provided. The smart tag 170 comprises an RFID tag such as an NFC (near field communication) tag. The smart tag 170 may be provided by sticker or label attached to the security container 10 via suitable means to be durable attached (e.g., strong adhesive, sticking, cable or tie, or the like) depending on the form of the sticker or label. In other embodiments, the smart tag 170 and QR code may be separate elements provided on an outer surface of the security container. In other embodiments, the smart tag 170 and/or QR code 172 may be omitted.

An identifier (ID), such as number or name of the security container 10, a user associated therewith, or a residential address may be provided on the security container 10, for example, with the smart tag 170 and QR code 172, for example, on the top panel 21 of the hinged-lid 22. The security container 10 may include a GPS tracking device or fob for tracking. The security container 10 may further comprise a camera or be wireless connected to a camera positioned in the door area or the other area where the security container 10 is located to image the camera. The camera may be a video or still camera. The camera may record image data continuously, periodically, or in response to lock and unlock events of the security container 10.

Figure 30:
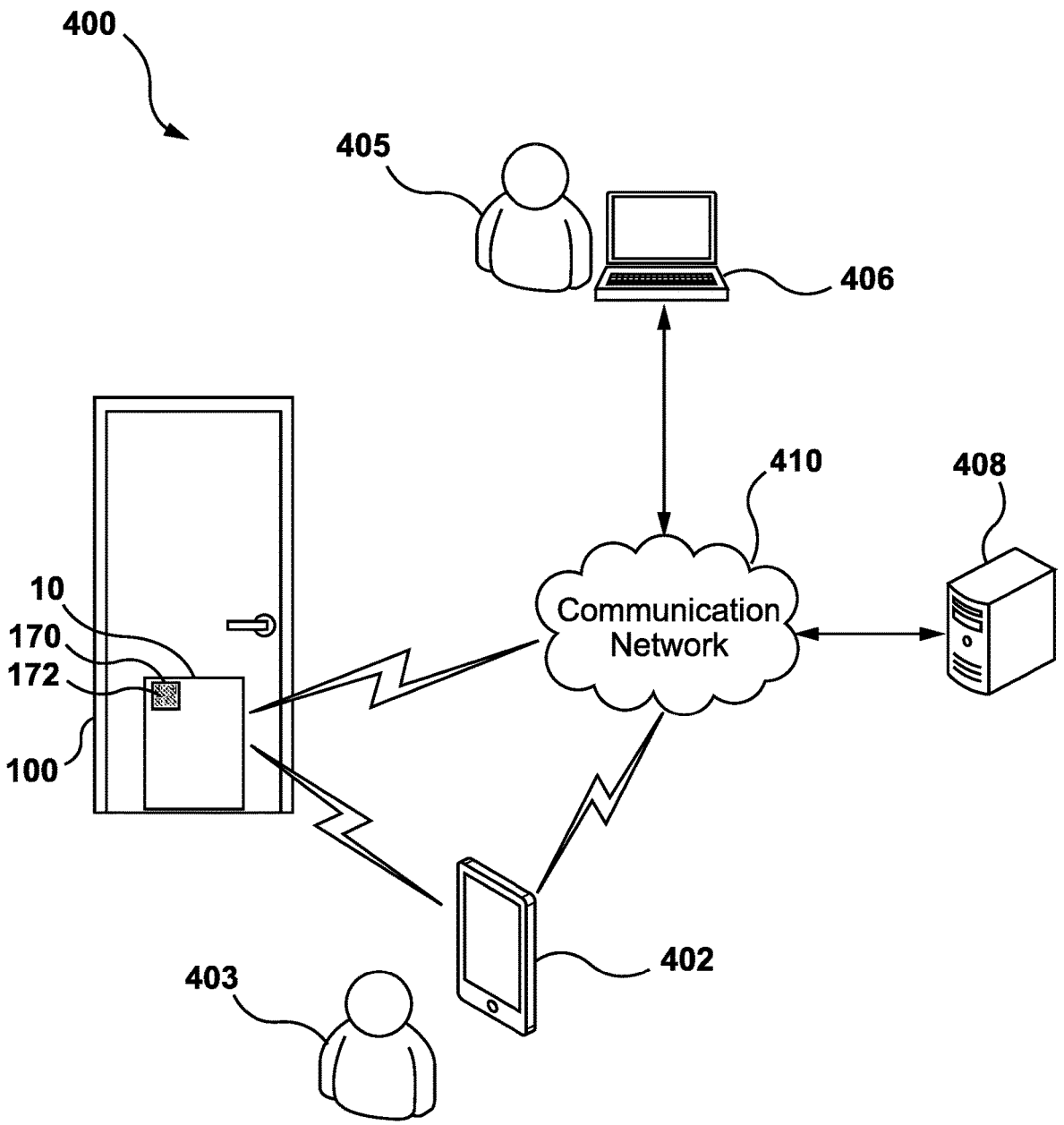
FIG. 30 is a schematic block diagram of a wireless communication system useful for opening the security container in accordance with an example embodiment of the present disclosure.

The electronic lock 160 may be a networked or unnetworked lock. In networked embodiments, the electronic lock 160 may comprise a user interface such as the keypad 162 for inputting codes, processor, memory, communication system comprising one or wireless transceivers, battery, and mechanical locking mechanism. The wireless transceivers provide two-way wireless Radio Frequency (RF) communications device having data and/or voice communications capabilities. The electronic lock 160 may also comprise one or more sensors for detecting lid close and lid open events, such as contact sensors. The memory of the electronic lock 160 stores one or more unlock codes for unlocking it. The unlock codes may also be used to lock the security container 10 in some embodiments. The unlock codes are stored on an access control server 408 (FIG. 30).

FIG. 28 is a front perspective view of a seventh embodiment of a security container in accordance with the present disclosure with the hinged-lid 22 in a closed position. In the seventh embodiment, the second part of the two-part strap 300 is attached to a stopper 310 such as wedge block by a fastener 312 such as a screw, bolt, rivet or the like. With the security container 10 located on the outside of the door, the strap 300 is located under the door as shown in FIG. 28. Although the shown door is a residential front door, the door may be a garage door. The stopper 310 is configured to be caught or wedged between the door and the floor should any one attempt to remove the security container 10 from the door area or porch in an act or theft of the like. Examples of suitable shapes for the stopper 310 include an elongate member having a square, circular, triangular, X-shaped or L-shaped cross-section. Examples of a suitable size of the stopper are 3-4" in diameter, 3-4" in length and 1-2" in cross-section. The size and shape of the stopper 310 may vary. Although not shown, the second part of the two-part strap may include a buckle so that the length of the strap may be adjusted. The stopper 310 may be a decorative item. The decorative item may define a recess or cavity for receiving the strap 300 when not in use. When not in use, the decorative item with the strap 300 received therein or underneath may be stored near the door 100, for example on a table, rather than within the collapsible box 12. In other embodiments, a one-piece strap as described above may be used instead of a two-part strap.

Figure 29:
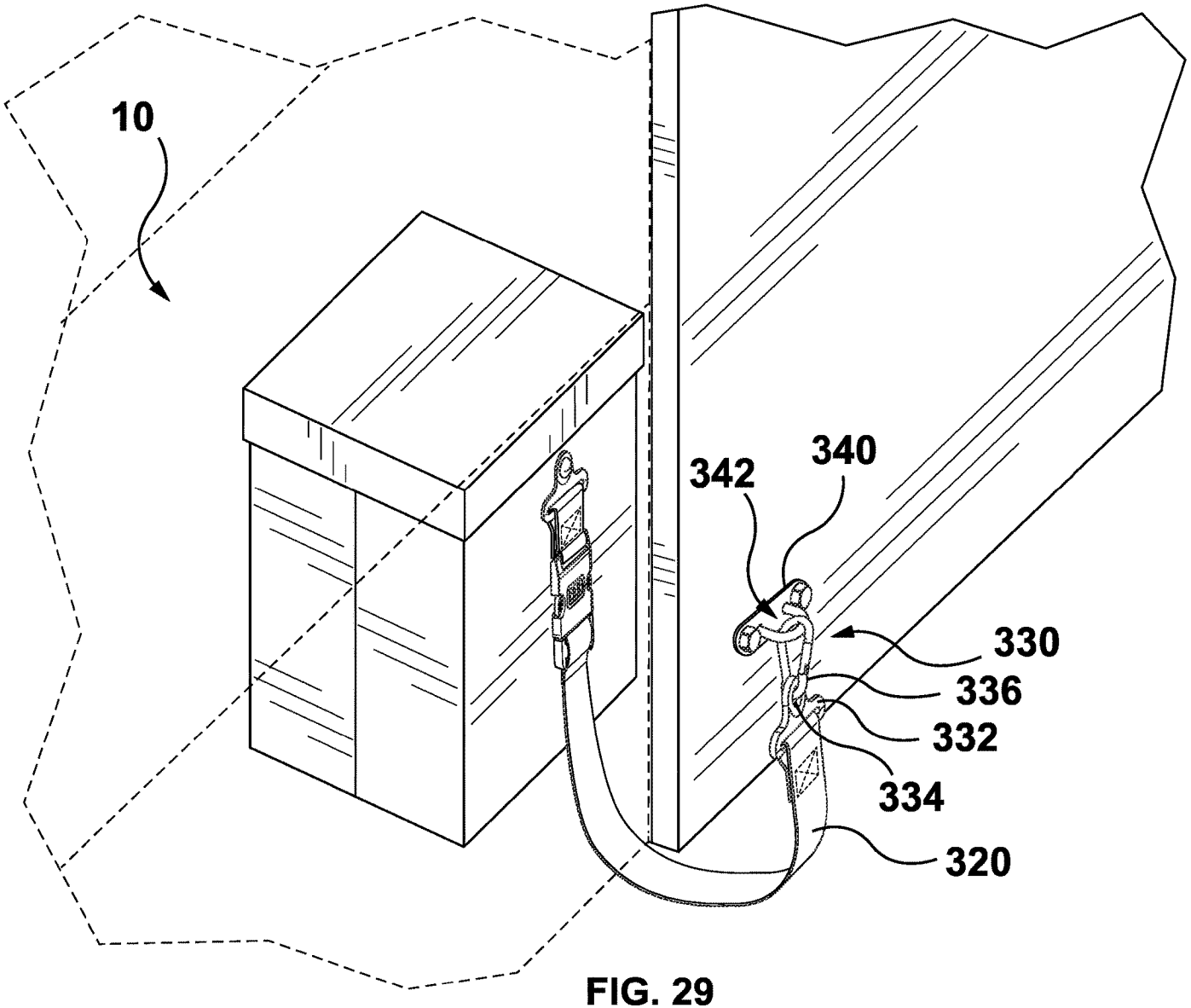
FIG. 29 is a front perspective view of an eighth embodiment of a collapsible security container in accordance with the present disclosure with the hinged-lid in a closed position.

FIG. 29 is a front perspective view of an eighth embodiment of a collapsible security container in accordance with the present disclosure with the hinged-lid 22 in a closed position. In the eighth embodiment, the second part of the two-part strap 320 is attached to a hanger 332 defining a hole 334 therein for which a hook connector 336 is attached such as a carabiner (e.g., locking carabiner), spring snap hook, spring clip, slip hook with safety latch, etc. The hook connector 336 may be used to secure the security container 10 to a wall anchor 340 attached to a nearby wall. The wall anchor 340 may comprise a U-hook anchor hanger, D-hook anchor hanger or J-hook anchor hanger. With the security container 10 located on the outside of the door, the strap 320 is located under the door as shown in FIG. 29. Although the shown door is a residential front door, the door may be a garage door. Although not shown, the second part of the two-part strap may include a buckle so that the length of the strap may be adjusted. The hook connector 336 and wall anchor 340 provide an alternative wall mounting solution that can be used instead of the second embodiment.

FIGS. 32-34 show a ninth embodiment of a collapsible security container 601 in accordance with the present disclosure. The collapsible security container 601 comprises a one-part strap with a stopper 310 similar to the seventh embodiment of FIG. 28. FIGS. 32 and 33 show the collapsible security container 601 in a fully open position with the hinged-lid in a closed position. FIG. 34 shows the collapsible security container 601 in a fully closed position with the hinged-lid secured to the box using a locking strap 43.

The collapsible security container 601 also comprises a hasp lock 600 for securing the hinged-lid 12. In FIG. 32, the hasp lock 600 is in a closed and locked position. In FIG. 33, the hasp lock 600 is in an open position. The hasp lock 600 may be used with or without a support structure, such as the support structure 92 described above in connection with the first embodiment of FIG. 1, depending on the strength and construction of the front panel 14. With the exception of a keyed lock of the hasp lock 600, the hasp lock 600 may be substantially constructed from a strong, rigid plastic such as polycarbonate to make the hasp lock 600 strong and light.

The hasp lock 600 includes a hasp 610 and a swivel handle 622 adapted to be received in an opening 614 in the hasp 610. The hasp 610 comprises a mounting plate 616 that is connected by a hinge to a hasp plate 612 in which the opening 614 is defined. The mounting plate 616 is secured to the outer surface (also known as the front side) of the front panel of the hinged-lid 22 via mounting screws fastened into mounting holes in the mounting plate 616. The mounting screws are hidden when the hasp is closed. The hasp 610 is mounted in a front panel of the multi-sided rim 23 of the hinged-lid 12 and the swivel handle 622 is mounted in the front panel of the collapsible box 12. In the shown embodiment, the swivel handle 622 has a keyed lock 624 with an exposed keyway (e.g., key cylinder). The swivel handle 622 is rotatably mounted to a base or mount 620. The mount 620 is secured to the front panel 14 of the box 12 with mounting screws fastened into mounting holes in the mount 620. The mounting screws of the mount 620 are hidden when the hasp is closed. The swivel handle 622 can be turned to latch the hasp 610 before locking the keyed lock 624. The swivel handle 622 has a shape that corresponds to a shape of the opening 614 in the hasp 610. When the swivel handle 622 is an open position as shown in FIG. 33, the hasp 610 may be latched about the swivel handle 622. Once latched, the swivel handle 622 is turned from the open position to a closed position to secure the hasp 610 to the swivel handle 622. A mated key (not shown) may be used to lock the keyed lock 624 so that the swivel handle 622 cannot be moved to the open position. Alternatively, in other embodiments a swivel staple or fixed loop may be used in combination with a padlock or combination lock instead of the switch handle 622 with keyed lock 624.

In the collapsible security container 601, the bottom panel, front panel, left side panel, right side panel, back panel, and bottom flap panel are rigid panels, and the bottom panel is a flexible panel. In the collapsible security container 601, the bottom panel, front panel, left side panel, right side panel and back panel comprise a rigid insert between an outer fabric layer and inner fabric layer. In the collapsible security container 601, the rigid insert is a corrugated plastic sheet. In the collapsible security container 601, the hinged-lid 22 comprises a top panel and a multi-sided rim 23.

In the collapsible security container 601, the outer fabric layer may be formed of polyvinyl chloride (PVC)-coated polyester fabric.

In the collapsible security container 601, the inner fabric layer may be formed of ballistic nylon fabric.

In the collapsible security container 601, the bottom panel, front panel, left side panel, right side panel, back panel and top panel may be insulated panels, and the inner fabric layer may be a reflective foil foam insulation layer.

In the collapsible security container 601, the outer fabric layer is formed of a durable water repellent material.

In the collapsible security container 601, the outer fabric layer is formed of an antimicrobial and/or antiviral material.

In the collapsible security container 601, the flexible panel is formed of Kevlar or UHMWPE (ultra-high-molecular-weight polyethylene).

In the collapsible security container 601, the left side panel and the right side panel each comprise a first portion and a second portion connected about a fold line, wherein the left side panel and the right side panel are each foldable about the respective fold lines. In the collapsible security container 601, the first portion of the left side panel, second portion of the left side panel, first portion of the right side panel, second portion of the right side panel each comprise a rigid insert between an outer fabric layer and inner fabric layer.

In the collapsible security container 601, the hinged-lid 22 is connected to the collapsible box by a hinge extending across the back panel.

In the collapsible security container 601, the strap 300 may be formed of Kevlar or UHMWPE.

In the collapsible security container 601, the strap 300 may be attached to the back panel of the collapsible box in a central part of a top portion thereof via a swivel.

The collapsible security container 601 may further comprises a left flap panel and a right flap panel located within the interior compartment, wherein the left flap panel is connected proximate to an intersection between respective edges of the back panel and the left side panel, wherein the right flap panel is connected proximate to an intersection between respective sedges of the back panel and the right side panel, wherein the left flap panel and right flap panel are each parallel to the left side panel and right side panel, respectively, and are each foldable to form a double panel on the left and right side of the collapsible box when folded parallel thereto. The collapsible security container 601 may further comprise corresponding portions of hook-and-loop fastener are provided on left side panel and left flap panel to releasably secure the left side panel and left flap panel together when folded parallel thereto, and corresponding portions of hook-and-loop fastener are provided on right side panel and right flap panel to releasably secure the right side panel and right flap panel together when folded parallel thereto. The bottom flap panel, the left flap panel and the right flap panel are rigid panels. The bottom flap panel, the left flap panel and the right flap panel are formed of a rigid plastic sheet.

FIG. 30 illustrates a wireless communication system 400 in accordance with an example embodiment of the present disclosure. The system 400 comprises a security container 10 secured to or near a door 100. The security container 10 is provided with one or more wireless transceivers for sending and receiving communications from an access control server 408 via a communication network 410 to provide a wirelessly connected electronic lock. The security container 10 is also provided with one or more of a smart tag 170 and/or QR code 172. A user 405 may connect to access control server 408 to set or modify access control settings for the security container 10 via a user terminal 406, such as a personal computer, smartphone, tablet or the like. A user 403 may be user 405 may connect to access control server 408 to set or modify access control settings for the security container 10 via a mobile wireless communication device 402, such as a smartphone, scanner, tablet or similar handheld, mobile wireless communication device. It will be understood that the access control server 408, user terminal 406 and mobile wireless communication device 402 each comprise processor (not shown), memory and communication subsystem as well known in the art.

The communication subsystem of the electronic lock 160 provides long-range and short-range communication capabilities. The communication subsystem is configured to receive one or more unlock codes from the access control server 408 which can be used to electronic lock 160 unlock the security container 10. The access control server 408 is located remotely and may be managed by a seller or delivery service.

The electronic lock 160 typically communicates with the access control server 408 via a wireless Wide Area Network (WAN) communication subsystem for two-way communication with a wireless WAN, such as a cellular network, and/or a Wireless Local Area Network (WLAN) communication subsystem for two-way communication with a WLAN via wireless access points (not shown), e.g. Wi-Fi™.

The communication subsystem is also configured to receive an unlock code from the wireless mobile wireless communication device 402 (e.g., smartphone or scanner) of the user 403, who may be an untrusted third party user (such as a delivery person). The electronic lock 160 typically communicates with the mobile wireless communication device 402 via a short-range communication link, such as Bluetooth™ or NFC. Other possible types of short-range communications subsystems 262 include IEEE 802.11, IEEE 802.15.3a (also referred to as UltraWideband (UWB)), Z-Wave, ZigBee, and infrared (e.g., such as an Infrared Data Association (IrDA) communications).

An unlock code may be temporary unlock code such as a onetime code. The temporary unlock code may expire after a threshold duration of time from a time at which it was generated or received. Alternatively, an unlock code may be valid until revoked or changed by the user 405 via the user terminal 406. Alternatively, an unlock code may be permanently valid. The unlock code may be set (or generated) by the user 405, who may be an owner or manager of the security container 10. The unlock code may be intended for use by a third party that may not be a trusted third party, such as a delivery service. The unlock code(s) set (or generated) by the user 405 are stored by the access control settings associated with the user and/or security container via an unique ID or the like, and are sent wirelessly to the security container 10 via the Internet, which receives the unlock code(s) from the access control server 408 via a corresponding wireless transceiver, and automatically stores the unlock code(s) in memory. This may comprise updating existing unlock code(s) by removing, overwriting, or replacing the existing unlock code(s). Temporary unlock codes may be automatically removed from the memory of the electronic lock 160 upon expiry, or the expiry time or duration may be used to determine whether an unlock code is a valid when received by or input into electronic lock 160. The unlock code to be used by the user 403 (e.g., untrusted third party user) is sent to the mobile wireless communication device 402 (e.g., smartphone or scanner) of the user 403 who will unlock (or lock) the security container 10. The unlock code may be sent in advance when the ID of the user 405 and/or security container 10 is already known or "on demand" when the user 403 arrives by scanning the smart tag 170 or QR code 172.

The unlock code may be sent from the mobile wireless communication device 402 of the user 403 to the wireless transceiver of the security container 10 using a short-range wireless communication protocol such as Bluetooth™ or NFC which automatically unlocks the electronic lock 160 and security container 10 in response to receiving a valid unlock code.

The unlock codes received by the mobile wireless communication device 402 may be stored in secure (or protected) memory of the mobile wireless communication device 402 such that it cannot be accessible by the user of the mobile wireless communication device 402. In such cases, the unlock code is not shown and ever known to the user 403 of the mobile wireless communication device 402. The unlock code may be configured to be deleted from the mobile wireless communication device 402 after use or after a predetermined amount of time after which it was receiver from the access control server 408.

Figure 31:
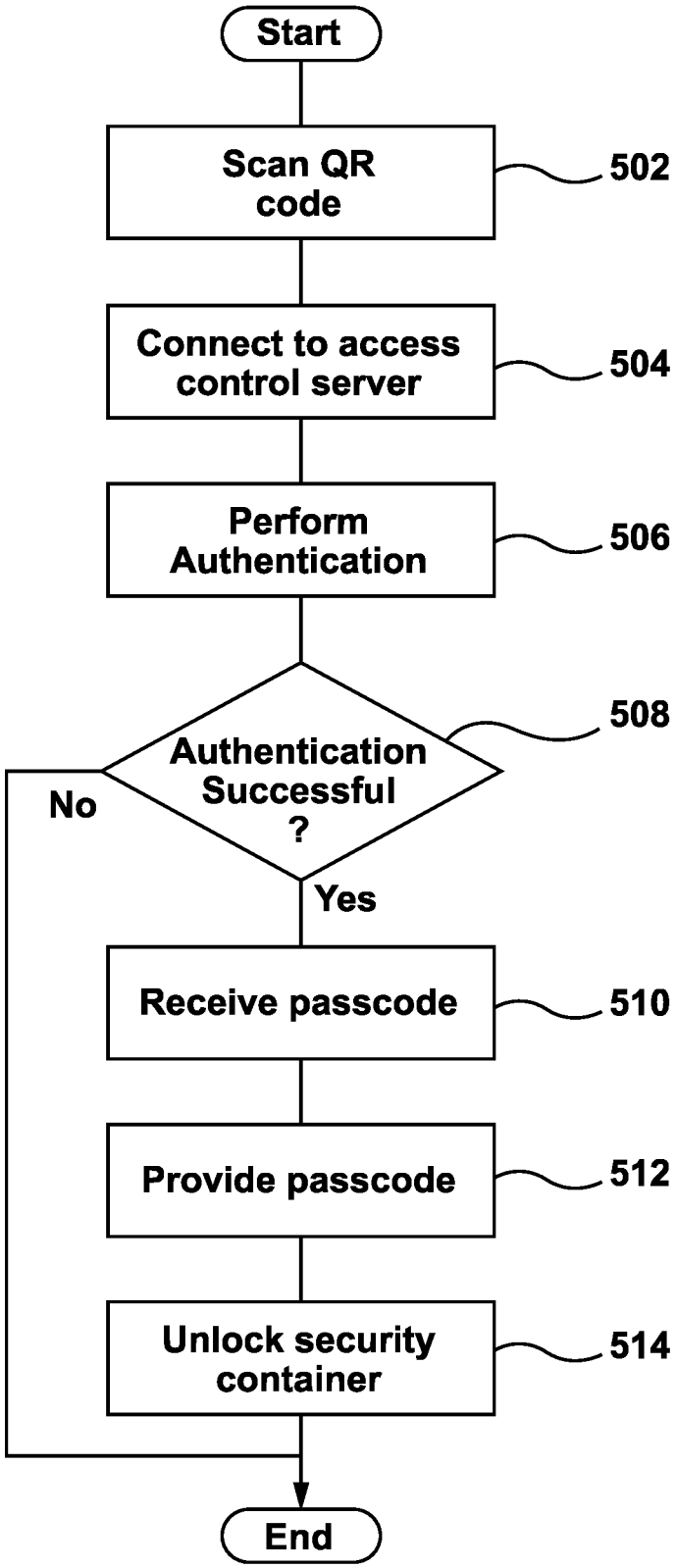
FIG. 31 is a flowchart of a method of opening the security container in accordance with example embodiments of the present disclosure.

FIG. 31 is a flowchart of a method of opening the security container in accordance with example embodiments of the present disclosure. At least parts of the method 500 are carried out by software executed by the processing unit 104 of an electronic lock 160 and mobile wireless communication device 402. The method 500 allows the mobile wireless communication device 402 of the user 403, such as a delivery person or the like, to obtain an unlock code for unlocking the security container 10 if the unlock code is not known.

At step 502, the user 403 scans the QR code 172 provided on the security container 10 using mobile wireless communication device 402 (e.g., smartphone or scanner). The mobile wireless communication device 402 reads and interprets the QR code 172 and extracts data and/or instructions therefrom such as the ID associated with the security container 10. The access control server 408 stores access control settings, such as unlock codes and any expiry times or durations, in association with the IDs associated with security containers 10. Alternatively, the user 403 may scans the smart tag 17 provided on the security container 10 using mobile wireless communication device 402 and extract data and/or instructions therefrom.

At step 504, a communications link between the mobile wireless communication device 402 and the access control server 408 is established in accordance with data and/or instructions extracted from the QR code 172 (or smart tag 172).

At step 506, an authorization and authentication check of the mobile wireless communication device 402 is performed by the access control server 408 to ensure that the user 403 is authorized to access the security container 10 and that the user 403 is who they purport to be. For example, the user 403 may be prompted on the mobile wireless communication device 402 by the access control server 408 to provide a user identifier (e.g., name, email address, etc.) and passcode (e.g., password, PIN, thumbprint, facial scan or the like). The user 403 follows instructions provided in the prompt to complete the authorization and authentication check.

At operation 508, the access control server 408 determines whether the authorization and authentication check was successful. If the authorization and authentication check is not successful, the unlock code (also known as a passcode) for the electronic lock 160 of the security container 10 is not provided to the mobile wireless communication device 402. Additional attempts to pass the authorization and authentication check may be permitted. If the authorization and authentication check is successful, the unlock code for the electronic lock 160 of the security container 10 is provided to the mobile wireless communication device 402 at step 510. The unlock code for the electronic lock 160 of the security container 10 may be displayed on a display of the mobile wireless communication device 402 and/or stored temporality in memory. Alternatively, in other embodiments the user 403 and the mobile wireless communication device 402 may be preauthorized and/or reauthenticated, and the corresponding steps may be omitted.

At step 512, the unlock code for the electronic lock 160 of the security container 10 is provided to the security container 10 via a short-range wireless link between the mobile wireless communication device 402 and the wireless transceiver of the security container 10, such as a Bluetooth™ or NFC connection. Alternatively, the unlock code may be provided by the keypad 162 of the electronic lock via manual entry by the user 403.

At step 514, the electronic lock 160 is unlocked in response to receiving the wireless transceiver or the keypad 162. The electronic lock 160 compares the received unlock code with a stored unlock code, and if the unlock code matches, generates a lock release signal which cause the electronic lock 160 to unlock, i.e. by causing the latch of the electronic lock 160 to unlatch from the receiver 80. The user 403 can then lift the hinge-lid 22, place the parcel(s) for delivery in the interior compartment of the security container 10, and close the hinge-lid 22, which will re-lock automatically via the slam lock mechanism or via detection of a lid close event via a corresponding sensor of the security container 10. Alternatively, the unlock code may be used a lock code which the user 403 can used to relock the security container 10 by re-entering the unlock code when the hinged-lid 22 is closed.

An electronic notification of the delivery or unlock event may be sent in response to the unlocking of the security container 10. An unlock event may be detected, or recognized, by the electronic lock 160 via the determination that a valid (e.g., matching) unlock code has been entered or received, or detection of a lid open event via a corresponding sensor of the security container 10. The delivery or unlock event is reported to the access control server 408 via the wireless transceiver of the security container 10. The access control server 408 then sends an electronic message, such as an email or text message, to a designated address associated with an ID of the user 405 or the security container 10 storing a database storing access control settings for a plurality of users and/or security containers, the database being maintained or accessible to the access control server 408. The delivery or unlock event and/or electronic message may include information such as the date and time of the event, an ID of the user 403 which can be determined from mobile wireless communication device 402, a delivery schedule or the like, and/or a photo or brief video captured by the camera showing the delivery and/or delivery person.

The described embodiments refer to fold lines between and/or in various panels. The fold lines may be formed by ceases or seams, depending on the panel.

Although embodiments of fastening mechanism for securing the security container 10 to a door, wall or the like are described, other fastening mechanisms may be used in other embodiments. For example, a pair of mated fasteners may be used, one attached to the door 100, wall or other mounting surface and the other provided by the container. For one example, a magnet may be attached to the front of the door 100, wall or other mounting surface and a matching magnet may be provided by the container in the back panel 20 thereof. For another example, a screw, bolt or other thread fastener may be attached to the door 100, wall or other mounting surface, protruding therefrom, and received in a hole in the container in the back panel 20 of the container and secured by a wing nut or the like. For yet another example, a thread hole may be provided in the door 100, wall or other mounting surface which is used to receive a thumb screw protruding from the back panel 20 of the security container 10 from a hole therein.

Although the security container of the present disclosure is described primarily with respect to several distinct embodiments, it will be appreciated that features from these embodiments may be combined or substituted to make alternative embodiments. Features from one or more of the above-described embodiments may be selected to create alternative embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present disclosure as a whole. Although example values and ranges are disclosed, all values and sub-ranges within the disclosed ranges are also disclosed.

The present disclosure may be embodied in other specific forms without departing from the subject matter of the claims. The described example embodiments are to be considered in all respects as being only illustrative and not restrictive. The present disclosure intends to cover and embrace all suitable changes in technology. The scope of the present disclosure is, therefore, described by the appended claims rather than by the foregoing description. The scope of the claims should not be limited by the preferred embodiments set forth in the examples, but should be given the broadest interpretation consistent with the description as a whole.

The invention claimed is:

1. A collapsible security container, comprising:

a collapsible box comprising:

a bottom panel; and a front panel, a left side panel, a right side panel and a back panel connected to the bottom panel by fold lines along respective edges of the bottom panel, wherein the bottom panel, front panel, left side panel, right side panel and back panel define an interior compartment; and a bottom flap panel located within the interior compartment, wherein the bottom flap panel is connected proximate to an intersection between respective edges of the back panel and bottom panel, wherein the bottom flap panel is foldable between a first position in which the bottom flap panel is parallel to the bottom panel and a second position in which the bottom flap panel is parallel to the back panel, and wherein the bottom panel and bottom flap panel form a double panel on the bottom of the collapsible box when the bottom flap panel is the first position;

a hinged-lid connected to the collapsible box;

a locking system for securing the hinged-lid to the collapsible box; and a strap attached to the collapsible box, the strap having an attachment end that is attached to the collapsible box and a free end that terminates in a fastener or stopper for securing the security container about or to a structure.

2. The collapsible security container of claim 1, wherein the front panel, left side panel, right side panel, back panel, and bottom flap panel are rigid panels, and wherein the bottom panel is a flexible panel.

3. The collapsible security container of claim 2, wherein the bottom flap panel, front panel, left side panel, right side panel and back panel comprise a rigid insert between an outer fabric layer and inner fabric layer.

4. The collapsible security container of claim 3, wherein the rigid insert is a corrugated plastic sheet.

5. The collapsible security container of claim 3, wherein the outer fabric layer is formed of polyvinyl chloride (PVC)-coated polyester fabric.

6. The collapsible security container of claim 3, wherein the inner fabric layer is formed of ballistic nylon fabric.

7. The collapsible security container of claim 3, wherein the bottom panel, front panel, left side panel, right side panel, back panel and top panel are insulated panels, and wherein the inner fabric layer is a reflective foil foam insulation layer.

8. The collapsible security container of claim 3, wherein the outer fabric layer is formed of a durable water repellent material.

9. The collapsible security container of claim 3, wherein the outer fabric layer is formed of an antimicrobial and/or antiviral material.

10. The collapsible security container of claim 2, wherein the flexible panel is formed of Kevlar or UHMWPE (ultra-high-molecular-weight polyethylene).

11. The collapsible security container of claim 1, wherein the hinged-lid comprises a top panel and a multi-sided rim.

12. The collapsible security container of claim 11, wherein the locking system comprises a hasp lock comprising a hasp mounted to a front panel of the multi-sided rim of the hinged-lid and a swivel handle mounted to the front panel of the collapsible box.

13. The collapsible security container of claim 1, wherein the locking system comprises:

a lock located towards a front of the hinged-lid, wherein a keyway of the lock is exposed by an outer surface of the hinged-lid and a latch of the lock is exposed by an inner surface of the hinged-lid; and a receiver for engaging the latch of the lock attached to the front panel.

14. The collapsible security container of claim 1, wherein the left side panel and the right side panel each comprise a first portion and a second portion connected about a fold line, wherein the left side panel and the right side panel are each foldable about the respective fold lines.

15. The collapsible security container of claim 14, wherein the bottom panel, front panel, first portion of the left side panel, second portion of the left side panel, first portion of the right side panel, second portion of the right side panel, and back panel comprise a rigid insert between an outer fabric layer and inner fabric layer.

16. The collapsible security container of claim 1, wherein the hinged-lid is connected to the collapsible box by a hinge extending across the back panel.

17. The collapsible security container of claim 1, wherein the strap is formed of Kevlar or UHMWPE.

18. The collapsible security container of claim 1, wherein the strap is attached to the back panel of the collapsible box in a central part of a top portion thereof via a swivel.

19. The collapsible security container of claim 1, wherein the collapsible box further comprises:

a left flap panel located within the interior compartment, wherein the left flap panel is connected proximate to an intersection between respective edges of the back panel and the left side panel, wherein the left flap panel is foldable between a first position in which the left side flap panel is parallel to the left side panel and a second position in which the left side flap panel is parallel to the back panel, and wherein the left side panel and left side flap panel form a double panel on the left side of the collapsible box when the left side flap panel is in the first position; and a right side flap panel located within the interior compartment, wherein the right side flap panel is connected proximate to an intersection between respective edges of the back panel and right side panel, wherein the right side flap panel is foldable between a first position in which the right side flap panel is parallel to the right side panel and a second position in which the right side flap panel is parallel to the back panel, and wherein the right side panel and right side flap panel form a double panel on the right side of the collapsible box when the right side flap panel is in the first position.

20. The collapsible security container of claim 19, wherein corresponding portions of hook-and-loop fastener are provided on left side panel and left flap panel to releasably secure the left side panel and left flap panel together when folded parallel thereto, and corresponding portions of hook-and-loop fastener are provided on right side panel and right flap panel to releasably secure the right side panel and right flap panel together when folded parallel thereto.

21. The collapsible security container of claim 1, wherein the structure is a door or wall.

* * * * *